US007780159B2

(12) United States Patent
Nishimura et al.

(10) Patent No.: US 7,780,159 B2
(45) Date of Patent: Aug. 24, 2010

(54) SHEET PROCESSING APPARATUS WITH CONTROLLER FOR CONTROLLING SHEET SUPPLY UNIT

(75) Inventors: Shunsuke Nishimura, Ibaraki (JP); Yoshinori Isobe, Ibaraki (JP); Masatoshi Yaginuma, Ibaraki (JP); Naoto Watanabe, Chiba (JP); Masahiro Yonenuma, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/342,673

(22) Filed: Dec. 23, 2008

(65) Prior Publication Data

US 2009/0115125 A1 May 7, 2009

Related U.S. Application Data

(62) Division of application No. 11/856,294, filed on Sep. 17, 2007, now Pat. No. 7,472,901, which is a division of application No. 10/788,404, filed on Mar. 1, 2004, now abandoned.

(30) Foreign Application Priority Data

Mar. 7, 2003 (JP) ..... 2003-062594

(51) Int. Cl.
*B65H 37/04* (2006.01)

(52) U.S. Cl. ..... 270/58.11; 270/58.01; 270/58.08; 270/58.12; 270/58.17; 270/58.27

(58) Field of Classification Search ..... 270/58.01, 270/58.12, 58.08, 58.09, 59, 58.11, 58.18, 270/58.14, 58.16, 58.17, 58.27
See application file for complete search history.

(56) References Cited

U.S. PATENT DOCUMENTS 5,112,034 A 5/1992 Uto et al. ..... 270/58.12

(Continued)

FOREIGN PATENT DOCUMENTS

JP 6-171815 6/1994

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

The present invention provides a sheet processing apparatus comprising a sheet holding device capable of storing supplied sheets, a first sheet stacking tray on which sheets are stacked at a downstream side of the sheet holding device in a sheet conveying direction and on which the sheets are subjected to processing, a sheet discharging device for discharging the sheets stacked on the first sheet stacking tray, a second sheet stacking tray on which the sheets discharged by the sheet discharging device are stacked, and a controller for controlling the sheet discharging device and the sheet holding device if sheet jam occurs at an upstream side of the sheet holding device, in such a manner that, after the sheets on the first sheet stacking tray are discharged onto the second sheet stacking tray, the sheets stored in the sheet holding device are discharged onto the first sheet stacking tray.

17 Claims, 48 Drawing Sheets

U.S. PATENT DOCUMENTS

| | | | | |
|---|---|---|---|---|
| 5,164,770 | A | 11/1992 | Furuichi et al. | 399/11 |
| 5,765,824 | A | 6/1998 | Kawano et al. | 270/58.11 |
| 6,219,503 | B1 | 4/2001 | Miyake et al. | 399/85 |
| 6,371,472 | B1 | 4/2002 | Miyake et al. | 270/58.14 |
| 6,386,080 | B1 | 5/2002 | Okamoto et al. | 83/73 |
| 6,398,214 | B1 | 6/2002 | Moteki et al. | 271/220 |
| 6,471,429 | B1 | 10/2002 | Isobe et al. | 400/582 |
| 6,517,065 | B2 | 2/2003 | Miyake et al. | 270/58.09 |
| 7,165,764 | B2 | 1/2007 | Nakamura et al. | 270/58.11 |
| 2002/0129690 | A1 | 9/2002 | Yaginuma et al. | 83/628 |
| 2003/0049063 | A1 | 3/2003 | Suzuki et al. | 399/407 |

FOREIGN PATENT DOCUMENTS

| | | |
|---|---|---|
| JP | 2001-89009 | 4/2001 |
| JP | 2001-220050 | 8/2001 |
| JP | 2003-81517 | 3/2003 |

SHEET PROCESSING APPARATUS WITH CONTROLLER FOR CONTROLLING SHEET SUPPLY UNIT

This application is a divisional of U.S. patent application Ser. No. 11/856,294, filed Sep. 17, 2007, which is a divisional of U.S. patent application Ser. No. 10/788,404, filed Mar. 1, 2004.

BACKGROUND OF THE INVENTION

1. Field of the Invention

The present invention relates to a sheet processing apparatus provided in a main body of an image forming apparatus such as a copier, a printer or the like and adapted to process a sheet sent from the main body of the image forming apparatus, and, more particularly, it relates to a sheet processing apparatus which can store sent sheets while the sheet is processed.

2. Related Background Art

In recent years, as an option for an image forming apparatus such as an electrophotographic copier, a laser beam printer or the like, a sheet processing apparatus such as a sorter for sorting imaged sheets has been developed. Such a sheet processing apparatus performs at least one of sorting processing, stapling processing and aligning processing operations with respect to the sheet.

In a sheet processing apparatus having a stapler for performing the stapling processing, after sheets conveyed into a main body of the sheet processing apparatus are stacked on a processing tray through a conveying path provided within the main body, the stapling operation is performed.

In the sheet processing apparatus for stapling a sheet stack (or a bundle of sheets), the sheets are stacked on the processing tray as a sheet stack and the sheet stack is stapled at one position or plural positions (normally, two positions) while shifting the stapler as stapling means. While the stapling operation is being performed, sheets for a next job cannot be stacked on the processing tray. Thus, a sheet-to-sheet distance between the successive jobs for the stapling operation must be lengthened.

However, if the sheet-to-sheet distance is lengthened, productivity will be worsened. That is to say, the number of sheets to be processed per unit time will be reduced. In order to prevent the reduction in the productivity, there has been proposed a sheet processing apparatus in which a sheet holding portion (buffer portion) for storing sheets is provided in a conveying path for conveying the sheet to a processing tray.

In such a sheet processing apparatus, while plural sheets stacked on the processing tray are being processed, plural succeeding sheets are stored in the sheet holding portion, and, when the processing is finished, the sheets stored in the sheet holding portion are stacked on the processing tray and the succeeding sheets are supplied onto the processing tray until a desired number of sheets are stacked.

There are two kinds of sheet processing apparatuses having such a sheet holding portion. As a first kind, there is a sheet processing apparatus of sole stack discharging type in which, when the processing of the sheet stack on the processing tray is finished, the sheet stack on the processing tray is discharged and then the sheets stored in the sheet holding portion are discharged onto the processing tray (for example, refer to Japanese Patent Application Laid-open No. 9-48545 (FIGS. 1 and 2)). As a second kind, the Applicant proposed a sheet processing apparatus of simultaneous stack discharging type in which, when the processing of the sheet stack on the processing tray is finished, an operation for discharging the sheet stack on the processing tray from the processing tray and an operation for discharging the sheets stored in the sheet holding portion onto the processing tray are performed simultaneously. However, this sheet processing apparatus of simultaneous stack discharging type was not laid-opened on the priority date of this application and was laid-opened later (as Japanese Patent Application Laid-open No. 2003-81517).

However, the two kinds of conventional sheet processing apparatuses had the following problems.

In both the sheet processing apparatus of sole stack discharging type and the sheet processing apparatus of simultaneous stack discharging type, if a sheet is jammed at an upstream side of the sheet holding portion while the sheets are being stored in the sheet holding portion, since the entire apparatus is stopped, the sheet stack stacked on the processing tray and the sheets held in the sheet holding portion remain within the apparatus, and, thus, a jam recovering time is greatly increased, thereby worsening processing efficiency.

Further, in the sheet processing apparatus of simultaneous stack processing type as the second kind, in a case where the sheet stack is stacked on the processing tray and the sheets are being stored in the sheet holding portion, for example, if adjustment such as color adjustment is performed before a predetermined number of sheets are sent to the sheet holding portion, a succeeding sheet may be sent in a delayed manner. In such a case, while the succeeding sheet is being sent in the delayed manner, the processing of the sheet stack on the processing tray may be already finished.

However, in the sheet processing apparatus of this type, after the number of sheets sent during the processing of the sheet stack on the processing tray are held in the holding portion, since the simultaneous stack discharging operation in which the stored sheets are discharged onto the processing tray and, at the same time, the sheets stacked on the processing tray are discharged is performed, so long as the predetermined number of sheets are not sent to the holding portion, even if the processing of the sheet stack on the processing tray is finished, the sheet stack cannot be discharged outside. Thus, the sheet processing apparatus of simultaneous stack discharging type has poor processing efficiency.

SUMMARY OF THE INVENTION

An object of the present invention is to provide a sheet processing apparatus which enhances sheet processing efficiency.

Another object of the present invention is to provide an image forming apparatus which include a sheet processing apparatus having high sheet processing efficiency to enhance image processing efficiency.

A further object of the present invention is to provide a sheet processing apparatus comprising a sheet holding device capable of storing supplied sheets, a first sheet stacking tray on which sheets are stacked at a downstream side of the sheet holding device in a sheet conveying direction and on which the sheets are subjected to processing, a sheet discharging device for discharging the sheets stacked on the first sheet stacking tray, a second sheet stacking tray on which the sheets discharged by the sheet discharging device are stacked, and a controller for controlling the sheet discharging device and the sheet holding device when a succeeding sheet is not supplied to the sheet holding device for a predetermined time, in such a manner that, after the sheets on the first sheet stacking tray are discharged onto the second sheet stacking tray, the sheets stored in the sheet holding device are discharged onto the first sheet stacking tray.

A still further object of the present invention is to provide a sheet processing apparatus comprising a sheet holding device capable of storing supplied sheets, a first sheet stacking tray on which sheets stored by the sheet holding device or sheets passed without stopping at the sheet holding device are stacked and on which the sheets are subjected to processing, a second sheet stacking tray on which the sheets discharged from the first sheet stacking tray are stacked, a sheet conveying device for conveying the sheets stored in the sheet holding device and the sheets stacked on the first sheet stacking tray together and for stacking the sheets stored in the sheet holding device onto the first sheet stacking tray after the sheet stacked on the first sheet stacking tray are discharged onto the second sheet stacking tray, and a controller for controlling the sheet conveying device when a succeeding sheet is not supplied to the sheet holding device for a predetermined time, in such a manner that the sheets stacked on the first sheet stacking tray are discharged onto the second sheet stacking tray and the sheets stored in the sheet holding device are stacked onto the first sheet stacking tray.

A further object of the present invention is to provide a sheet processing apparatus comprising a sheet holding device capable of storing supplied sheets, a first sheet stacking tray on which sheets stored by the sheet holding device or sheets passed without stopping at the sheet holding device are stacked and on which the sheets are subjected to processing, a first sheet conveying device capable of conveying the sheets stacked on the first sheet stacking tray by a predetermined amount at a downstream side of the sheets stored in the sheet holding device, a second sheet stacking tray on which the sheets discharged from the first sheet stacking tray are stacked, a second sheet conveying device for conveying the sheets stacked on the first sheet stacking tray and the sheets stored in the sheet holding device together after the sheets stacked on the first sheet stacking tray are conveyed by the first sheet conveying device by the predetermined amount at the downstream side and for discharging the sheets stacked on the first sheet stacking tray onto the second sheet stacking tray and for stacking the sheets stored in the sheet holding device onto the first sheet stacking tray, and a controller for controlling the sheet holding device and the second sheet conveying device when a succeeding sheet is not supplied to the sheet holding device for a predetermined time, in such a manner that the sheets stacked on the first sheet stacking tray are discharged onto the second sheet stacking tray and the sheets stored in the sheet holding device are stacked onto the first sheet stacking tray.

A still further object of the present invention is to provide a sheet processing apparatus comprising a sheet holding device capable of storing supplied sheets, a first sheet stacking tray on which sheets are stacked at a downstream side of the sheet holding device in a sheet conveying direction and on which the sheets are subjected to processing, a sheet discharging device for discharging the sheets stacked on the first sheet stacking tray, a second sheet stacking tray on which the sheets discharged by the sheet discharging device are stacked, and a controller for controlling the sheet discharging device and the sheet holding device if sheet jam occurs at an upstream side of the sheet holding device, in such a manner that, after the sheets on the first sheet stacking tray are discharged onto the second sheet stacking tray, the sheets stored in the sheet holding device are discharged onto the first sheet stacking tray.

A further object of the present invention is to provide a sheet processing apparatus comprising a sheet holding device capable of storing supplied sheets, a first sheet stacking tray on which sheets stored by the sheet holding device or sheets passed without stopping at the sheet holding device are stacked and on which the sheets are subjected to processing, a second sheet stacking tray on which the sheets discharged from the first sheet stacking tray are stacked, a sheet conveying device for conveying the sheets stored in the sheet holding device and the sheets stacked on the first sheet stacking tray together and for stacking the sheets stored in the sheet holding device onto the first sheet stacking tray after the sheet stacked on the first sheet stacking tray are discharged onto the second sheet stacking tray, and a controller for controlling the sheet conveying device if sheet jam occurs at an upstream side of the sheet holding device, in such a manner that the sheets stacked on the first sheet stacking tray are discharged onto the second sheet stacking tray and the sheets stored in the sheet holding device are stacked onto the first sheet stacking tray.

The other object of the present invention is to provide a sheet processing apparatus comprising a sheet holding device capable of storing supplied sheets, a first sheet stacking tray on which sheets stored by the sheet holding device or sheets passed without stopping at the sheet holding device are stacked and on which the sheets are subjected to processing, a first sheet conveying device capable of conveying the sheets stacked on the first sheet stacking tray by a predetermined amount at a downstream side of the sheets stored in the sheet holding device, a second sheet stacking tray on which the sheets discharged from the first sheet stacking tray are stacked, a second sheet conveying device for conveying the sheets stacked on the first sheet stacking tray and the sheets stored in the sheet holding device together after the sheets stacked on the first sheet stacking tray are conveyed by the first sheet conveying device by the predetermined amount at the downstream side and for discharging the sheets stacked on the first sheet stacking tray onto the second sheet stacking tray and for stacking the sheets stored in the sheet holding device onto the first sheet stacking tray, and a controller for controlling the sheet holding device and the second sheet conveying device if sheet jam occurs at an upstream side of the sheet holding device, in such a manner that the sheets stacked on the first sheet stacking tray are discharged onto the second sheet stacking tray and the sheets stored in the sheet holding device are stacked onto the first sheet stacking tray.

BRIEF DESCRIPTION OF THE DRAWINGS

FIG. 13A shows a condition that a first sheet is sent into the sheet processing apparatus and FIG. 13B shows a condition that the first sheet is received;

FIG. 14A shows a condition that the first sheet is passed through the first sheet discharging roller pair and FIG. 14B shows a condition that the first sheet is dropped while straddling between a stack tray and a processing tray;

FIG. 15A shows a condition that the first sheet is sent to the processing tray and FIG. 15B shows a condition that the first sheet is further sent to the processing tray;

FIG. 16A shows a condition that a second sheet is sent into the sheet processing apparatus and FIG. 16B shows a condition that the first sheet abuts against a stopper;

FIG. 18A shows a condition that a sheet stack starts to be discharged from the processing tray to the stack tray and FIG. 18B shows a condition that the sheet stack is being discharged from the processing tray to the stack tray;

FIG. 20A shows a condition that a first sheet is sent into the sheet processing apparatus and FIG. 20B shows a condition that the first sheet is received up to a switchback point;

FIG. 21A shows a condition that the first sheet is received by a trailing end receiving portion and FIG. 21B shows a condition that the first sheet is pressed down against a lower conveying guide plate by a trailing end pressing member;

FIG. 22A shows a condition that a second sheet is sent into the sheet processing apparatus and FIG. 22B shows a condition that the second sheet is further sent;

FIG. 23A shows a condition that the second sheet is received up to the switchback point and FIG. 23B shows a condition that the second sheet is received by the trailing end receiving portion;

FIG. 25A shows a condition that a third sheet is sent in and FIG. 25B shows a condition that the third sheet is sent in;

FIG. 26A shows a condition that a sheet stack starts to be discharged from a processing tray to a stack tray and FIG. 26B shows a condition that the sheet stack and a buffer sheet are being conveyed toward a discharging direction;

FIG. 27A shows a condition that the sheet stack is discharged from the processing tray onto the stack tray and FIG. 27B shows a condition that the buffer sheet is being sent to the processing tray;

FIG. 28A shows a condition that the buffer sheet is being sent to the processing tray and FIG. 28B shows a condition that the buffer sheet is being further sent to the processing tray;

DESCRIPTION OF THE PREFERRED EMBODIMENTS

Now, a sheet processing apparatus according to an embodiment of the present invention, and a copier as an example of an image forming apparatus having such a sheet processing apparatus will be explained with reference to the accompanying drawings. Incidentally, the image forming apparatus may be a facsimile, a printer or a composite device thereof, as well as the copier, and, thus, the image forming apparatus in which the sheet processing apparatus is provided is not limited to the copier.

Incidentally, it is intended that dimensions, numerical values, materials, configurations and relative positions of constructional parts described in the embodiments are not limited to given ones so long as these are not specially identified.

In the embodiments, an example that a sheet processing apparatus is an optional apparatus in which the sheet processing apparatus is detachably mounted to a main body of an image forming apparatus as an independent apparatus will be explained. However, it should be noted that, although the sheet processing apparatus of the present invention can be applied to a sheet processing apparatus provided integrally with the image forming apparatus, since such a sheet processing apparatus of integral type does not differ specially from the sheet processing apparatus which will be described below, explanation thereof will be omitted.

Figure 1:
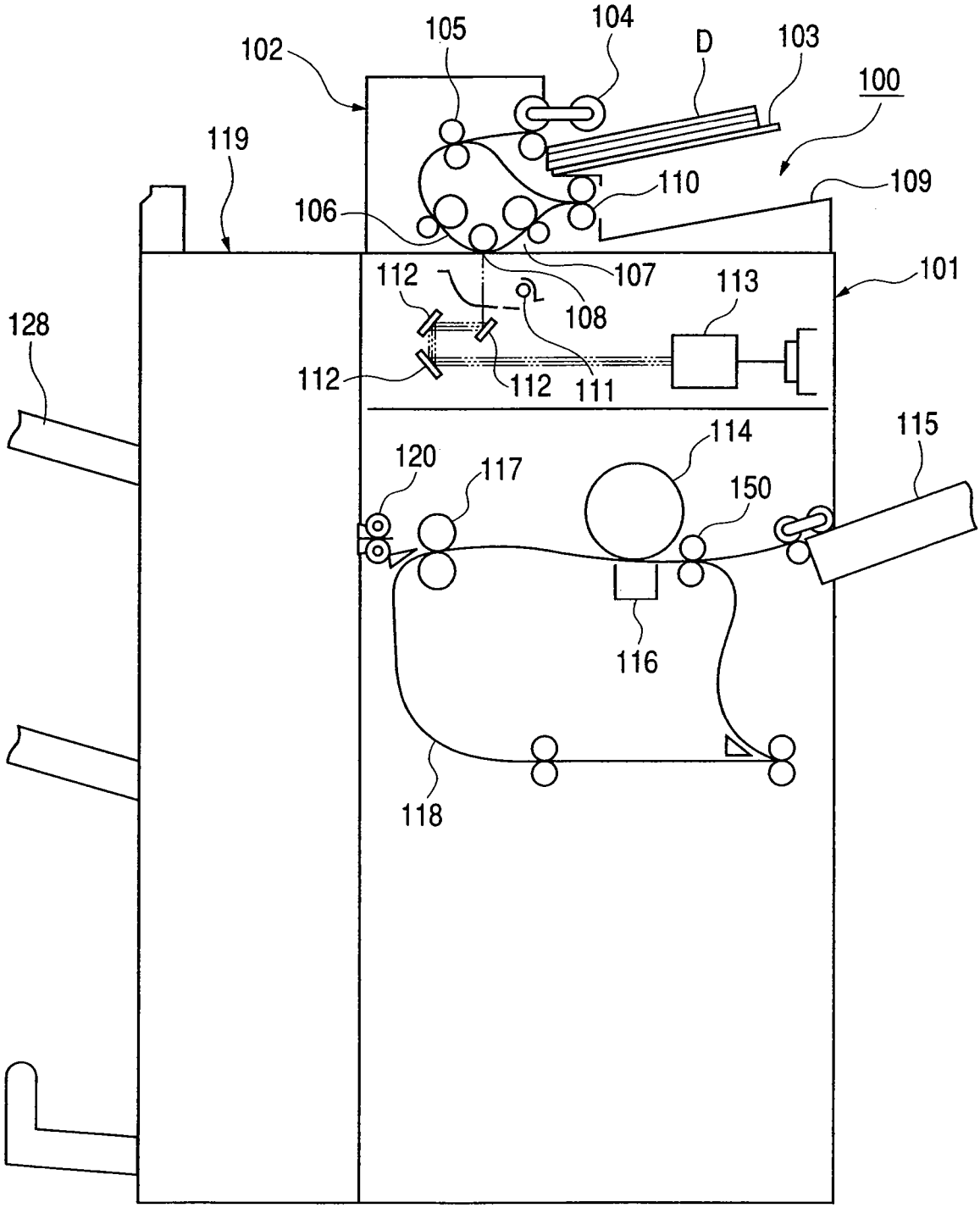
FIG. 1 is a schematic front sectional view of a copier as an image forming apparatus of which a main body is provided with a sheet processing apparatus according to an embodiment of the present invention.

FIG. 1 is a schematic sectional view showing a condition that the sheet processing apparatus is mounted to a copier. Incidentally, more concretely, the sheet processing apparatus is a finisher, for example.

(Image Forming Apparatus)

A copier 100 is constituted by a main body 101 and a sheet processing apparatus 119. A document feeding apparatus 102 is disposed on the main body 101 of the apparatus. Documents D are rested on a document resting portion 103 by an operator and are separated one by one by a feeding portion 104 and the separated document is sent to a registration roller pair 105. Then, the document D is temporarily stopped by the registration roller pair 105, so that a loop is formed in the document to correct skew-feeding. Thereafter, the document D is passed through an introduction path 6 to reach a reading position 107, where an image formed on a surface of the document is read. The document D left the reading position is passed through a discharging path 108 and then is discharged onto a discharging tray 109.

Further, in a case where both surfaces of the document are read, first of all, when the document D is passed through the reading position 107, the image on one surface of the document is read as mentioned above. Thereafter, the document D is passed through the discharging path 108 and is switchback-conveyed by turn-back roller pair 110, so that the document is sent to the registration roller pair 105 in a condition that a front surface of the document is turned over to a rear surface.

Then, similar to the reading of the image on one surface of the document D, skew-feeding of the document is corrected by the registration roller pair 105 and, then, the document is passed through the introduction path 106 to reach the reading position 107, where an image on the other surface of the document is read. Then, the document D is passed through the discharging path 108 and then is discharged onto the discharging tray 109.

On the other hand, the image on the document passing through the reading position 107 is illuminated by light from an illumination system 111. Reflection light reflected from the document is directed onto an optical element (CCD or other element) 113 by a mirror 112, where image data is obtained. On the basis of the image data, a laser beam is illuminated onto a photosensitive drum 114 as image forming means, thereby forming a latent image. Incidentally, although not shown, it may be designed so that the reflection light may be directly illuminated onto the photosensitive drum 114 by the mirror 112 to form the latent image.

The latent image formed on the photosensitive drum 114 receives toner supplied from a toner supplying device (not shown), thereby forming a toner image. Sheets as recording media such as papers or plastic films are stacked in a cassette 115. In response to a recording signal, the sheet is fed out from the cassette 115 and is sent between the photosensitive drum 114 and a transferring device 116 at a predetermined timing by a registration roller pair 150. Then, the toner image on the photosensitive drum 114 is transferred onto the sheet by the transferring device 116. The sheet to which the toner image was transferred is sent to a fixing device 117, where the toner image is fixed onto the sheet by heat and pressure.

In a case where images are formed on both surfaces of the recording medium, the sheet having one surface to which the image was fixed by the fixing device 117 is passed through a both-surface path 118 provided at a downstream side of the fixing device 117 and then is sent between the photosensitive drum 114 and the transferring device 116 again, where an toner image is also transferred onto a rear surface of the sheet. Then, the toner image is fixed onto the rear surface by the fixing device 117. Then, the sheet is discharged outside (toward the finisher 119).

Figure 2:
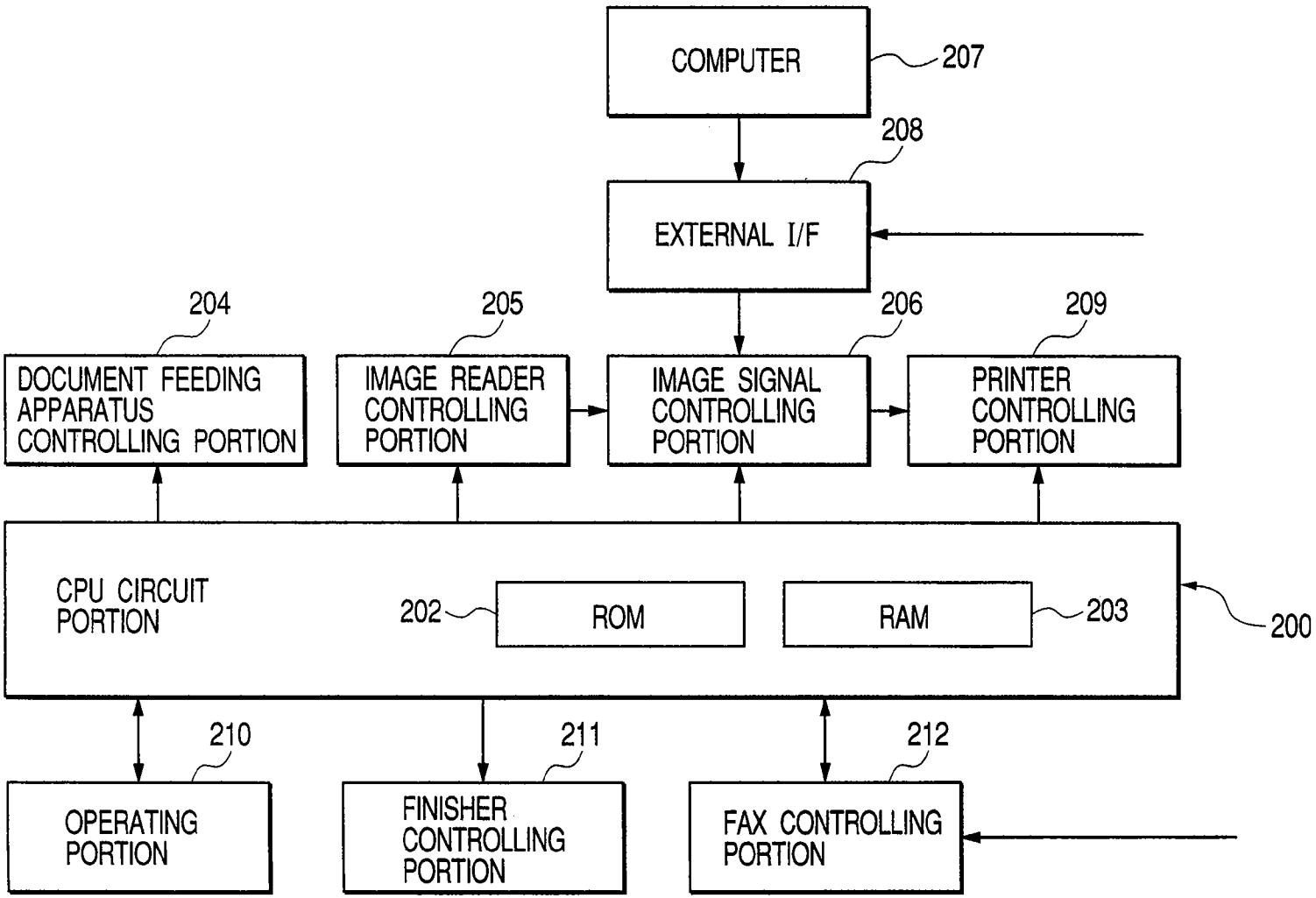
FIG. 2 is a control block diagram of the copier of FIG. 1.

FIG. 2 is a control block diagram of the entire copier. The entire copier 100 is controlled by a CPU circuit portion 200. The CPU circuit portion 200 includes therein a ROM 202 for storing sequence for various parts, i.e. control sequence, and a RAM 203 in which various information are temporarily stored as desired. A document feeding apparatus controlling portion 204 serves to control a document feeding operation of the document feeding apparatus 102. An image reader controlling portion 205 controls the illumination system 108 and the like thereby to control the reading of the document. An image signal controlling portion 206 serves to receive read information from the image reader controlling portion 205 or image information sent from an external computer 207 via an external I/F 208 and to process the information and then to send a processing signal to a printer controlling portion 209. The printer controlling portion 209 controls the photosensitive drum 114 and the like on the image processing signal from the image signal controlling portion 206 so that the image can be formed on the sheet.

An operating portion 210 can input sheet size information and information regarding the processing of the sheet (for example, stapling processing) by the operator utilizing the copier and can display information regarding operating conditions of the main body 101 of the copier and the finisher 119 as a sheet post-processing apparatus. A finisher controlling portion 211 serves to control an operation of the finisher 119 as the sheet post-processing apparatus. A FAX controlling portion 212 serves to control the copier so that the copier can be used as a facsimile and can be communicated with other facsimile by a signal.

(Sheet Processing Apparatus)

Figure 3:
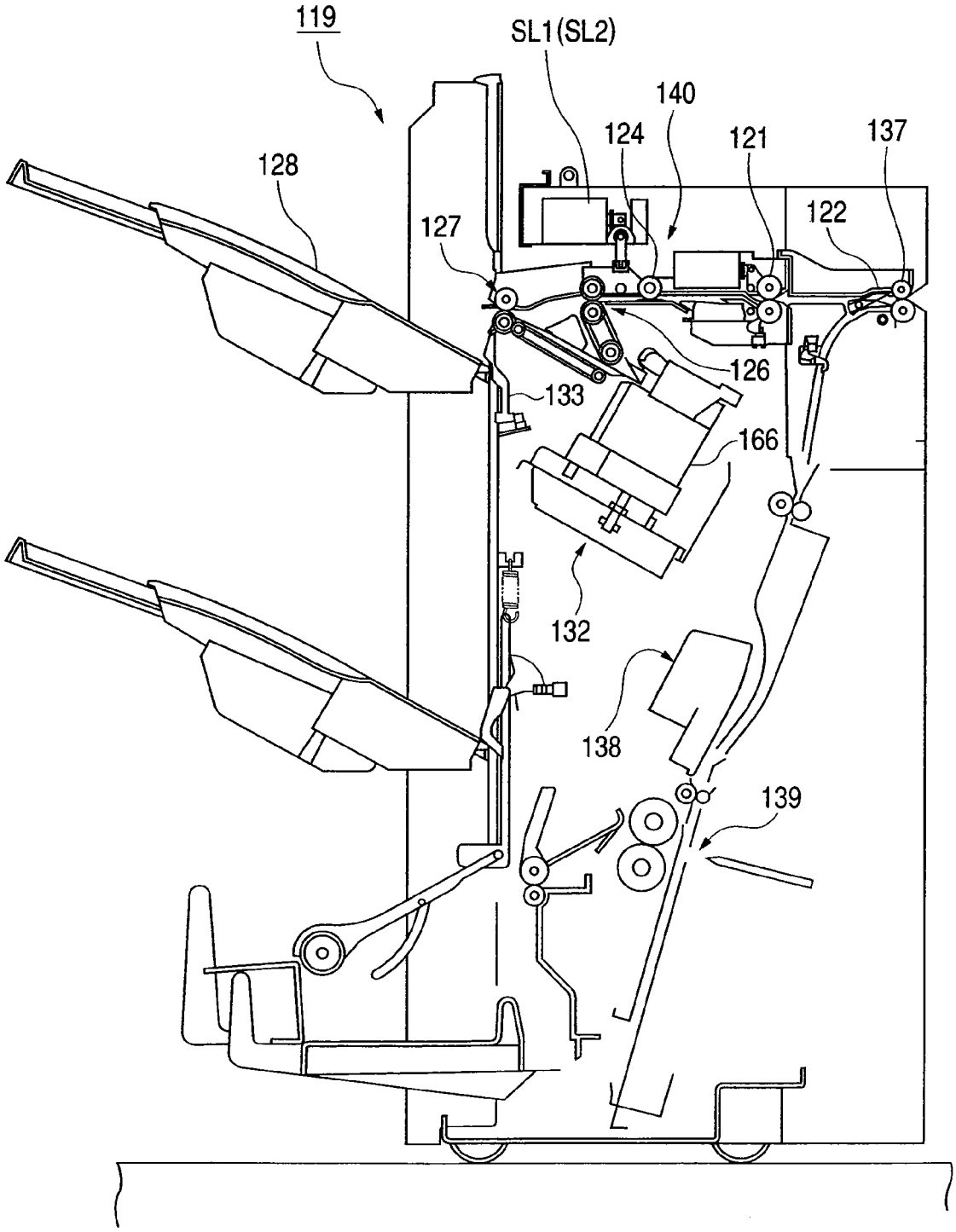
FIG. 3 is a schematic front sectional view of the sheet processing apparatus according to the embodiment of the present invention.
Figure 4:
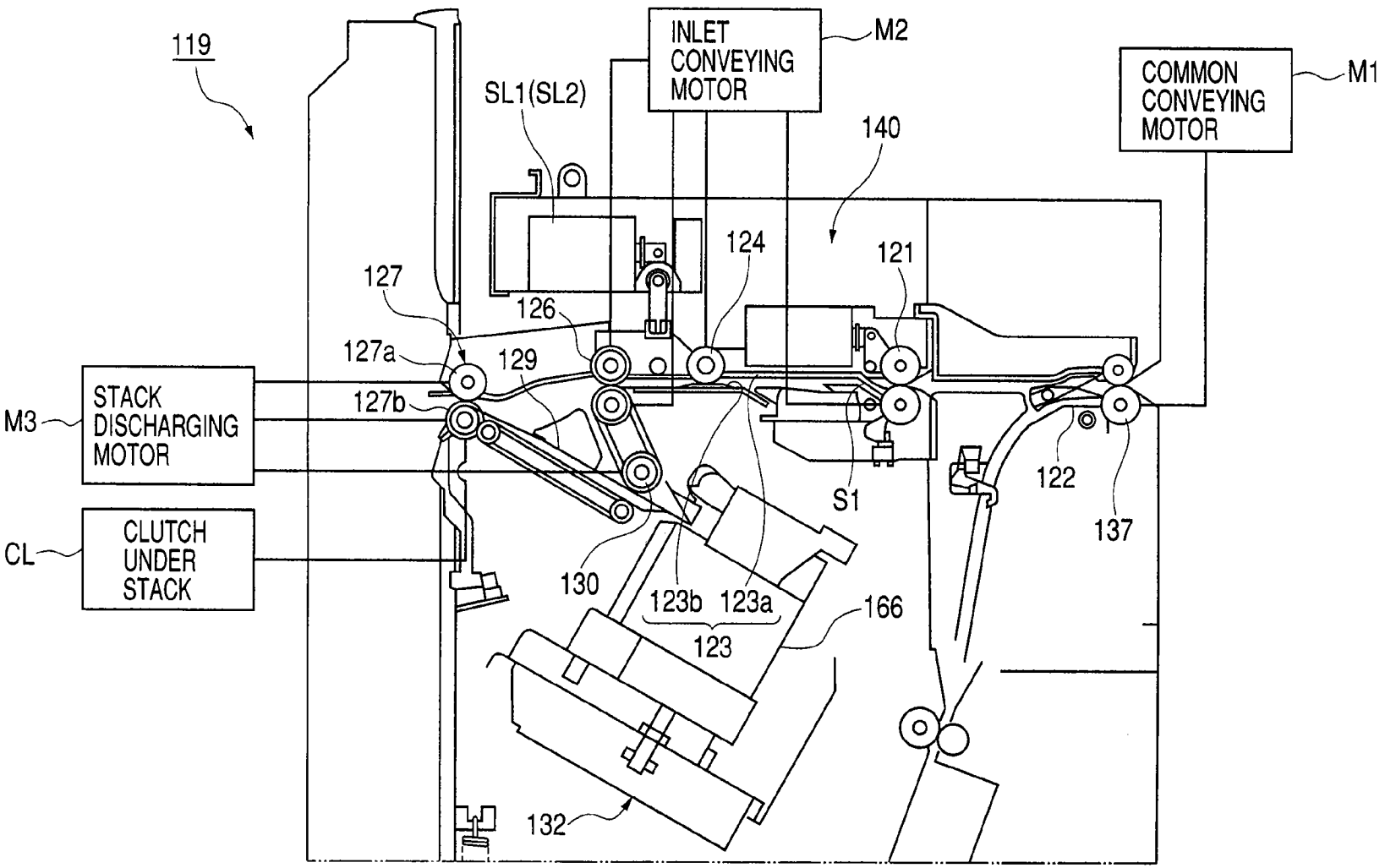
FIG. 4 is a schematic front sectional view showing various driving systems of the sheet processing apparatus according to the embodiment of the present invention.
Figure 8:
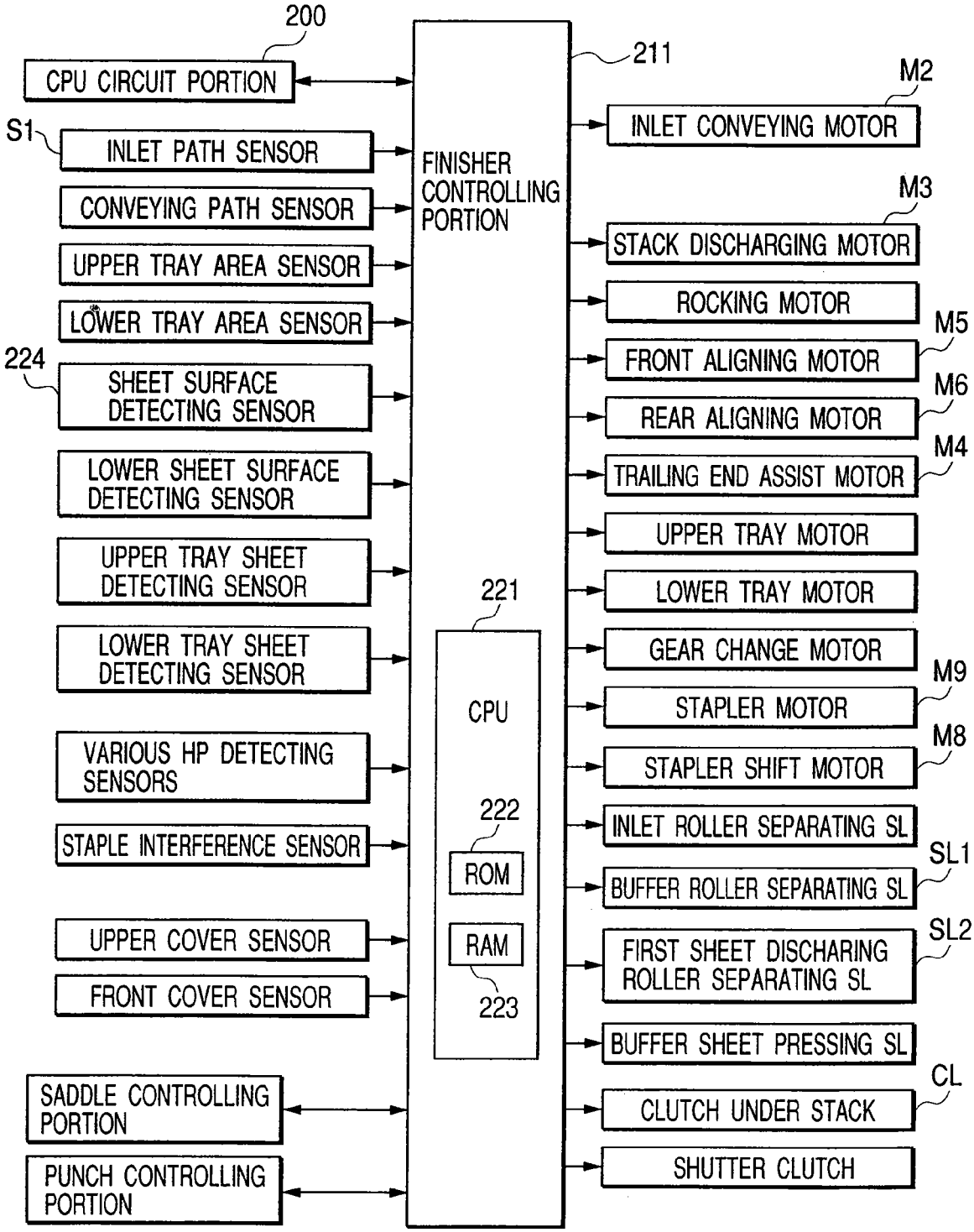
FIG. 8 is a control block diagram of the sheet processing apparatus of FIG. 3.
Figure 9:
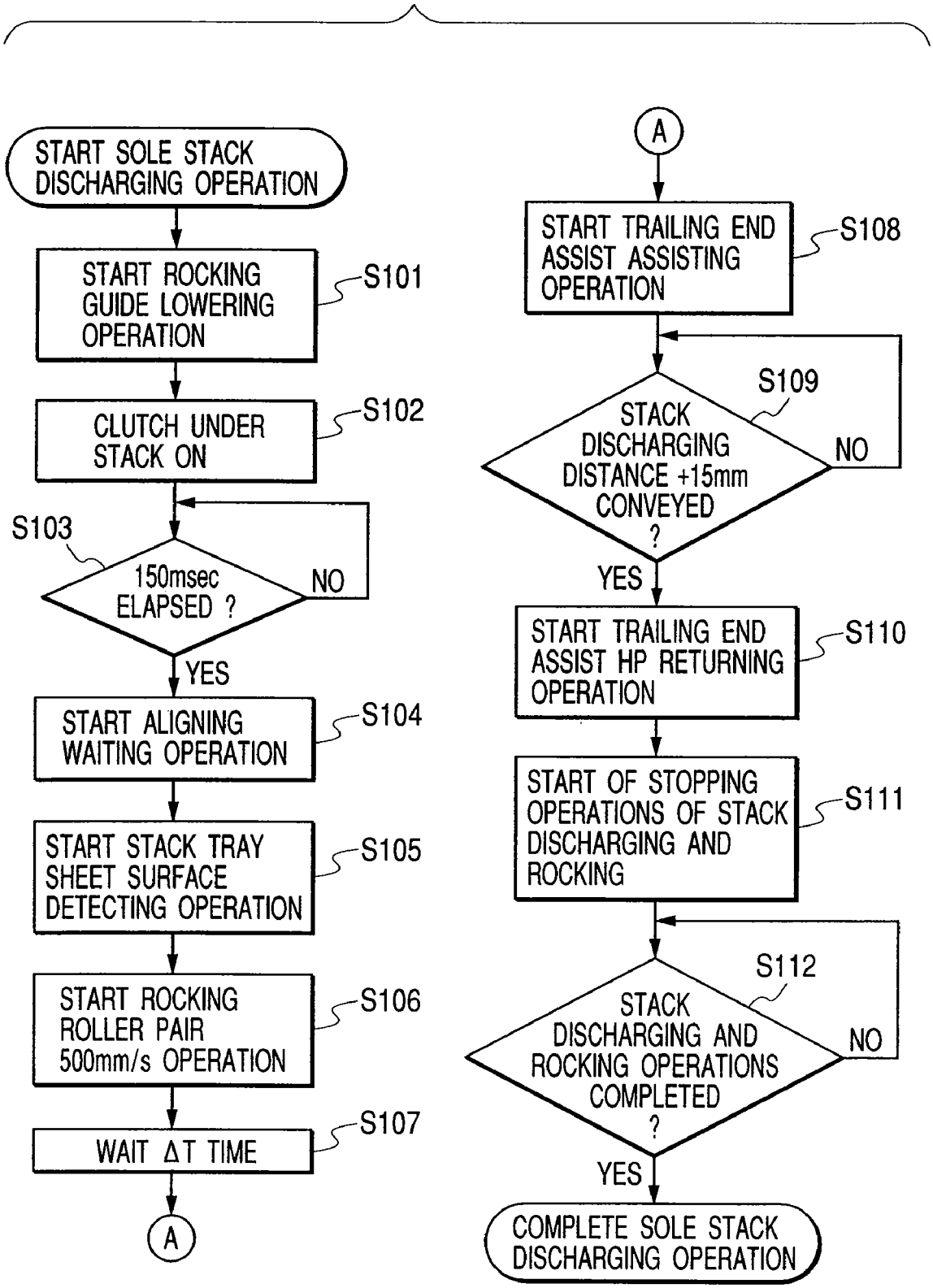
FIG. 9 is a flow chart for explaining an operation for discharging a sheet stack in the sheet processing apparatus of FIG. 3.
Figure 10:
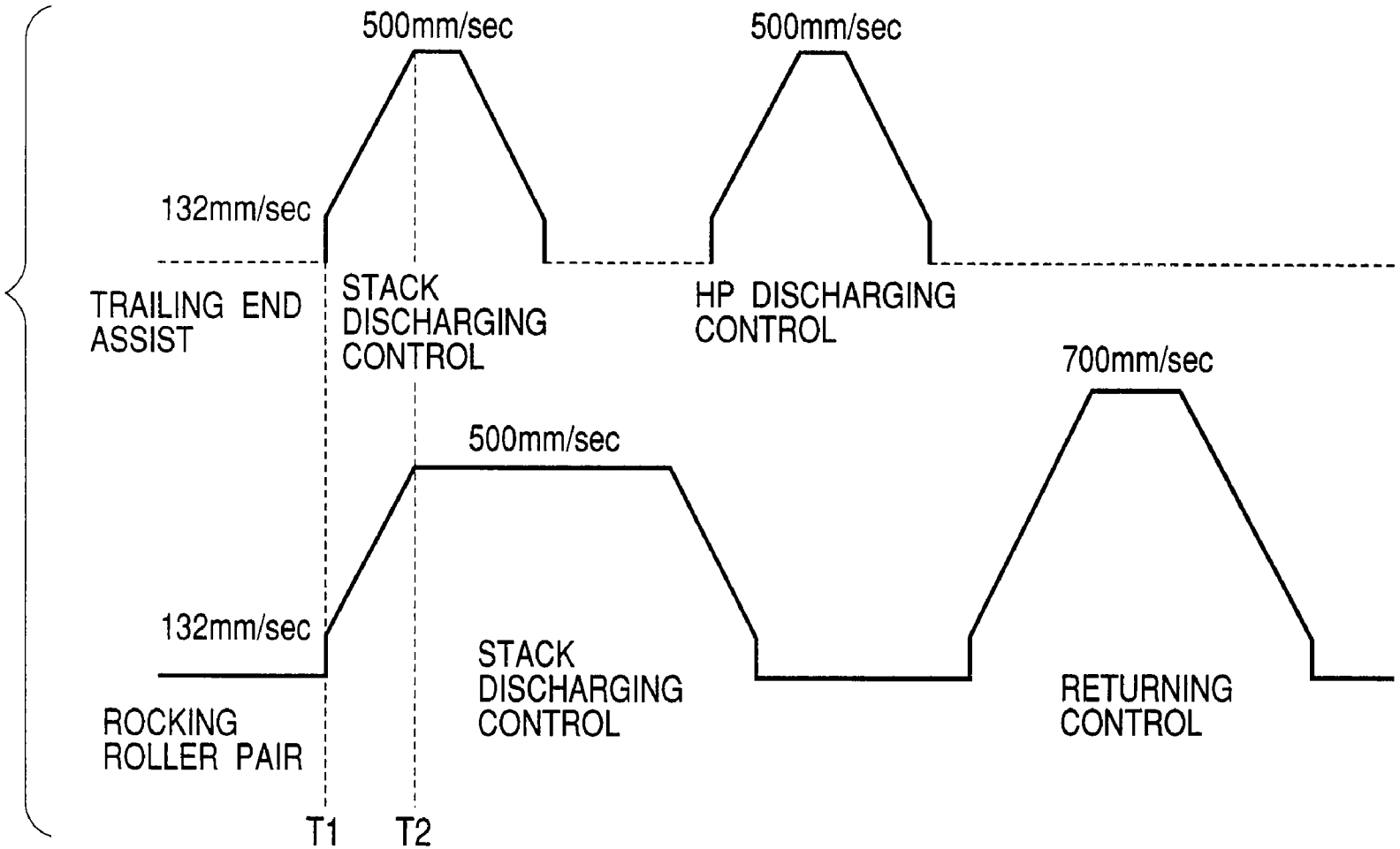
FIG. 10 is a view for explaining an operating timing between the trailing end assist and a rocking roller pair.
Figure 11:
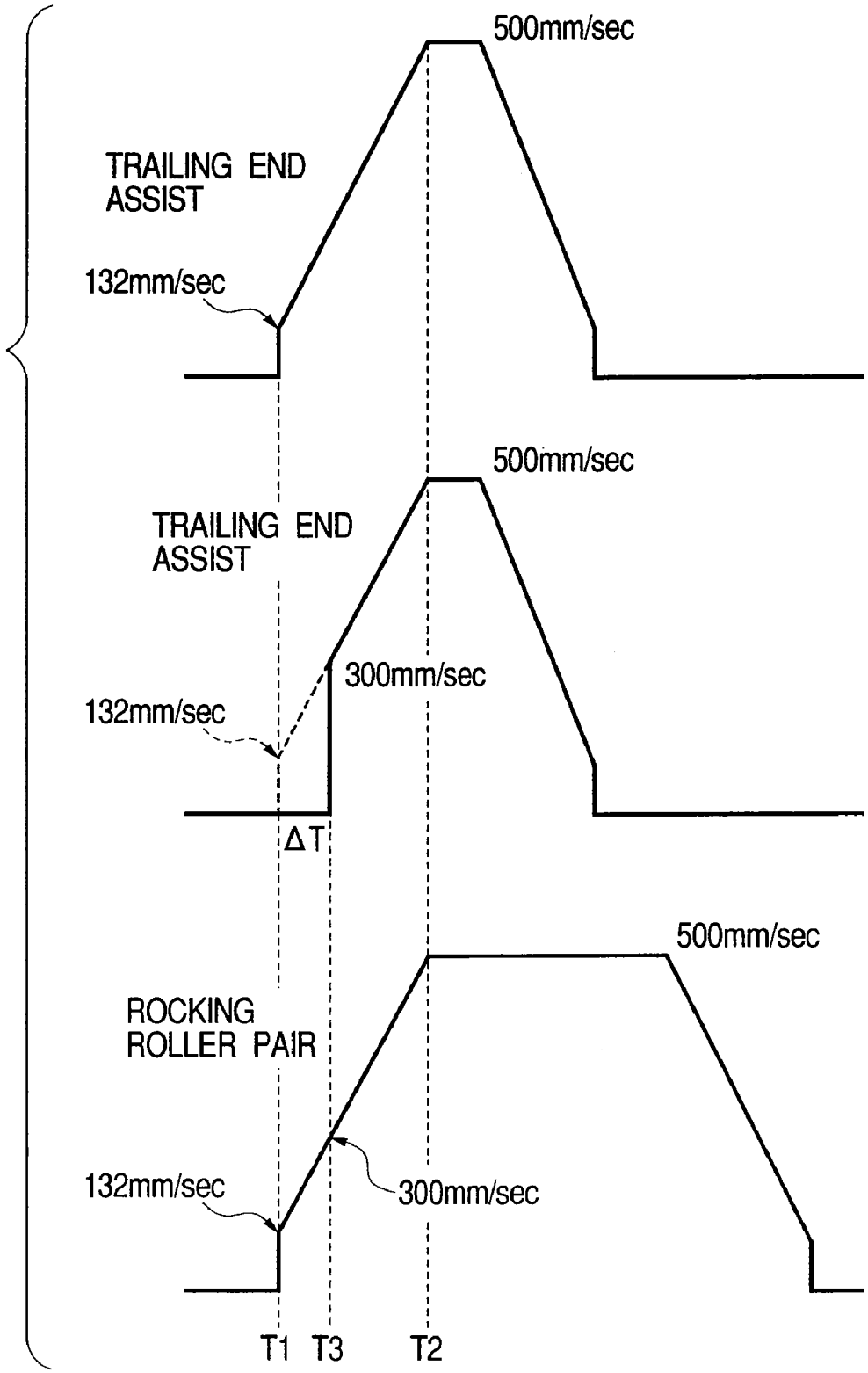
FIG. 11 is a view for explaining an operating timing between the trailing end assist and a rocking roller pair.
Figure 12:
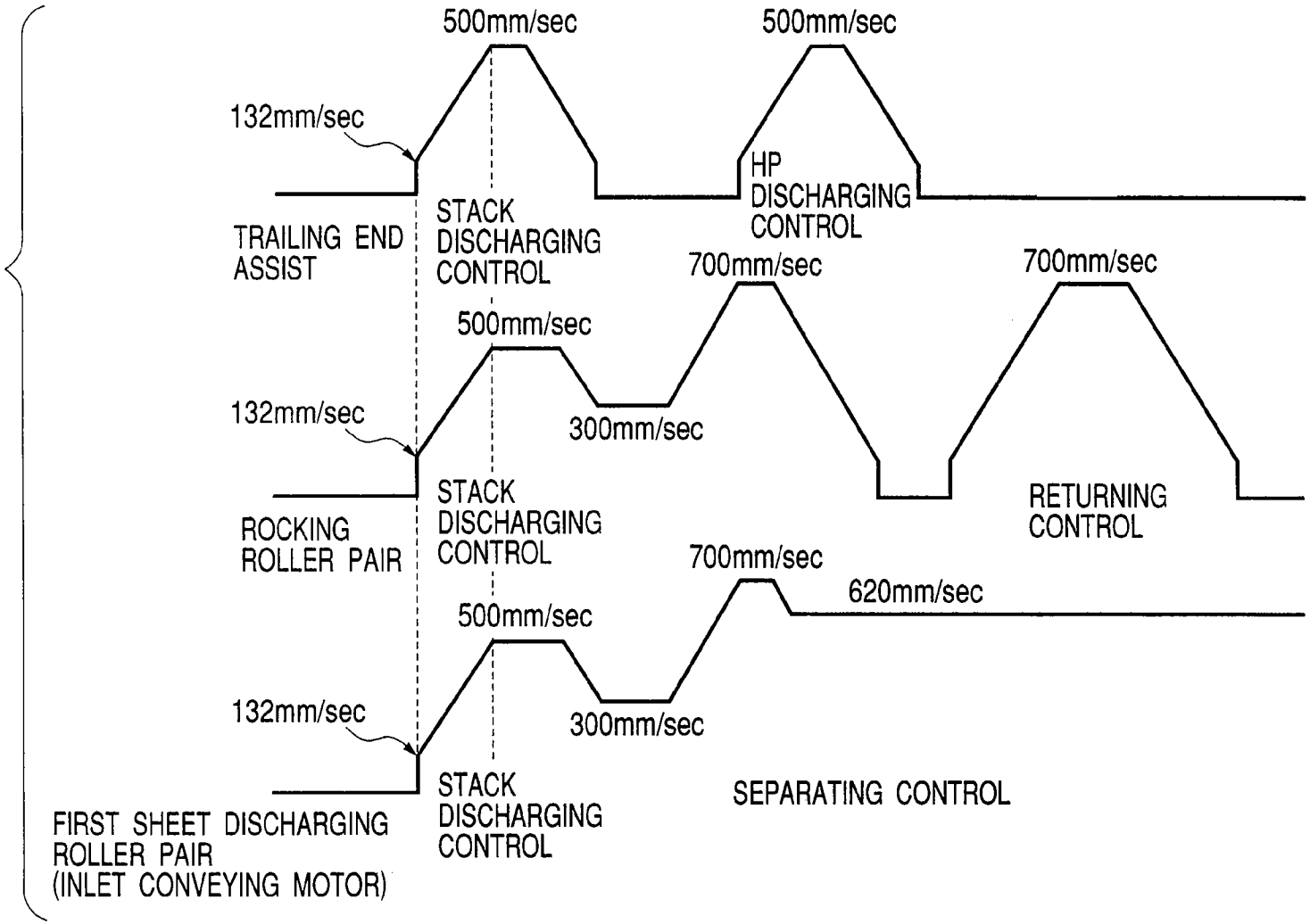
FIG. 12 is a view for explaining an operating timing between the trailing end assist and a rocking roller pair and a first sheet discharging roller pair.

FIG. 3 is a sectional view of the sheet processing apparatus. FIG. 4 is a sectional view showing various driving systems. FIG. 8 is a control block diagram of the sheet processing apparatus. FIG. 9 is a flow chart for explaining an operation of the sheet processing apparatus. FIGS. 10 to 12 are views showing a relationship between a shifting speed of a trailing end assist 134 and a sheet conveying speed of a rocking roller pair 127 along lapse of time. FIG. 10 shows sole stack discharging sequence in which a sheet stack is fed out by means of the trailing end assist 134 and the rocking roller pair 127. FIG. 11 is a view showing stack discharging control in a case where a starting speed of the trailing end assist 134 differs from that of the rocking roller pair 127. FIG. 12 shows simultaneously stack discharging sequence in which the sheet stack and buffer sheets stored in a buffer unit 140 are conveyed simultaneously by means of the trailing end assist, rocking roller pair and first conveying roller pair.

The sheet processing apparatus 119 has a function for book binding the sheet stack and thus includes a stapler unit 132 for stapling a portion near an edge of the sheet stack, a stapler 138 for stapling a central portion of the sheet stack, and a folding unit 139 for folding a stapled position portion of the sheet stack stapled by the stapler 138 to form a booklet.

The sheet processing apparatus 119 according to the illustrated embodiment includes a buffer unit 140 for storing (buffering) a plurality of sheets in a straight overlapped condition during an operation of the stapler unit 132.

Since the buffer unit 140 can store the plural sheets in the straight overlapped condition, unlike to a conventional mechanism having a buffer roller, the buffer unit can be more flattened, with the result that the sheet processing apparatus can be made compact and light-weighted. Further, since the sheets can be stored in the straight condition, unlike to the buffer roller, the sheet is not curled to facilitate the handling of the sheet, and, thus, a sheet processing time of the sheet processing apparatus can be shortened accordingly.

The sheet processing apparatus 119 is controlled by the finisher controlling portion 211 shown in FIG. 8. A CPU 221 of the finisher controlling portion 211 includes a ROM 222 for storing a control order (sequence) of the sheet processing apparatus 119 operated on the basis of command or instruction from the CPU circuit portion 200 of the main body of the copier, and a RAM 223 or the like for storing, each time, information required to control the sheet processing apparatus 119. Further, the finisher controlling portion 211 is connected to a sheet surface detecting sensor 224 operated on the basis of an operation of a sheet surface detecting lever 133 which will be described later. The CPU 221 serves to control lifting/lowering of the stack tray 128 on the basis of a detection signal of the sheet surface detecting sensor 224. The finisher controlling portion 211 serves to control, on the basis of the above-mentioned sequence, operations of an inlet conveying motor M2 for rotating the inlet roller pair 121, buffer roller 124 and first sheet discharging roller pair, a stack discharging motor M3 for rotating the rocking roller pair 127 and a return roller 130, and a clutch CL under stack for transmitting and non-transmitting a rotation of the stack discharging motor M3 with respect to a lower roller 127*b*.

Incidentally, the CPU circuit portion 200 and the finisher controlling portion 211 shown in FIG. 2 may be formed integrally with each other.

The clutch CL under stack shown in FIG. 4 is provided to absorb a speed difference, for the reason that, since the lower roller 127*b* and the return roller 130 (described later) are rotated by the common stack discharging motor M3, when the sheet or the sheet stack is conveyed by the lower roller 127*b* and the return roller 130, if slip occurs or if a sheet conveying speed difference occurs between these rollers, the sheet or the sheet stack may be wrinkled or damaged.

(Explanation of Operation for Stapling and Discharging Sheet Stack)

When the operator selects the sheet stapling processing via the operating portion 210 (refer to FIG. 2) of the copier 100, the CPU circuit portion 200 controls various parts of the main body of the apparatus to bring the copier to a copying operation condition and sends a sheet stapling processing signal to the finisher controlling portion 211.

Incidentally, an explanation made with reference to FIGS. 13A to 19 relates to a case where the CPU circuit portion 200 judges that a length of the sheet is great (for example, A3 size) on the basis of sheet size information inputted by the operator via the operating portion 210 or a case where the CPU circuit portion judges that a special sheet such as a thick paper, a thin paper, a tab paper, a color paper or the like having a property different from that of a normal sheet is used on the basis of sheet kind information. That is to say, the explanation made with reference to FIGS. 13A to 19 relates to a case where, after the sheet stack is discharged onto the stack tray 128, an operation for stacking buffer sheets (described later) onto the processing tray 129 is started. Incidentally, of course, regardless of the length of the sheet and/or special sheet or normal sheet, the operation described below may be performed.

The finisher controlling portion 211 starts to rotate the inlet conveying motor M2 and the stack discharging motor M3 on the basis of the sheet stapling processing signal. Further, the finisher controlling portion 211 drives a buffer roller separating plunger SL1 (refer to FIG. 4) to separate the buffer roller 124 from a lower conveying guide plate 123*b* and further drives a plunger (not shown) to separate an upper lower 127*a* of the rocking roller pair 127 from the lower roller 127*b*. Incidentally, the starting and stopping of the inlet conveying motor M2 and the stack discharging motor M3 may be controlled successively in accordance with a movement of the sheet.

A first sheet sent from the discharging roller pair 120 of the main body 101 of the copier 100 (refer to FIG. 1) is conveyed to the inlet roller pair 121 by conveyance of a receiving roller pair 137 shown in FIGS. 3 and 4 and guidance of a flapper 122. The receiving roller pair 137 is rotated by a common conveying motor M1 for rotating the discharging roller pair 120.

Figure 13A:
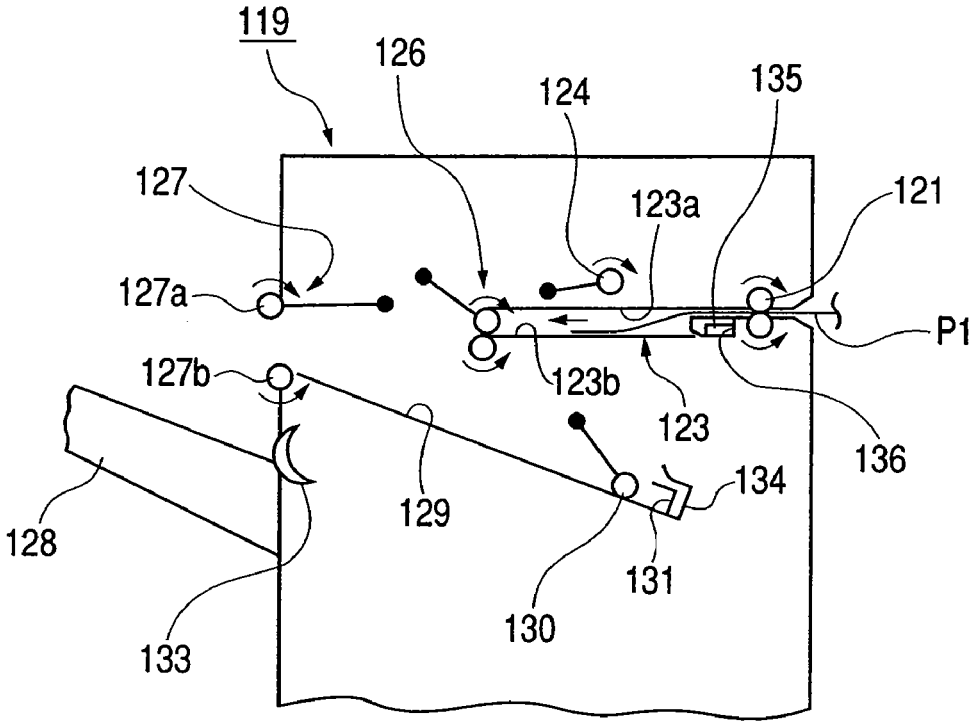
FIGS. 13A and 13B are views for explaining an operation of the sheet processing apparatus in a case where sheets are not required to be stored during sheet processing, where

As shown in FIG. 13A, the inlet roller pair 121 is rotated by the inlet conveying motor M2 (refer to FIG. 4) to convey the first sheet P1. The first sheet P1 is conveyed to the first sheet discharging roller pair 126 while being guided by a guide comprised of an upper conveying guide plate 123*a* and the lower conveying guide plate 123*b*.

Figure 13B:
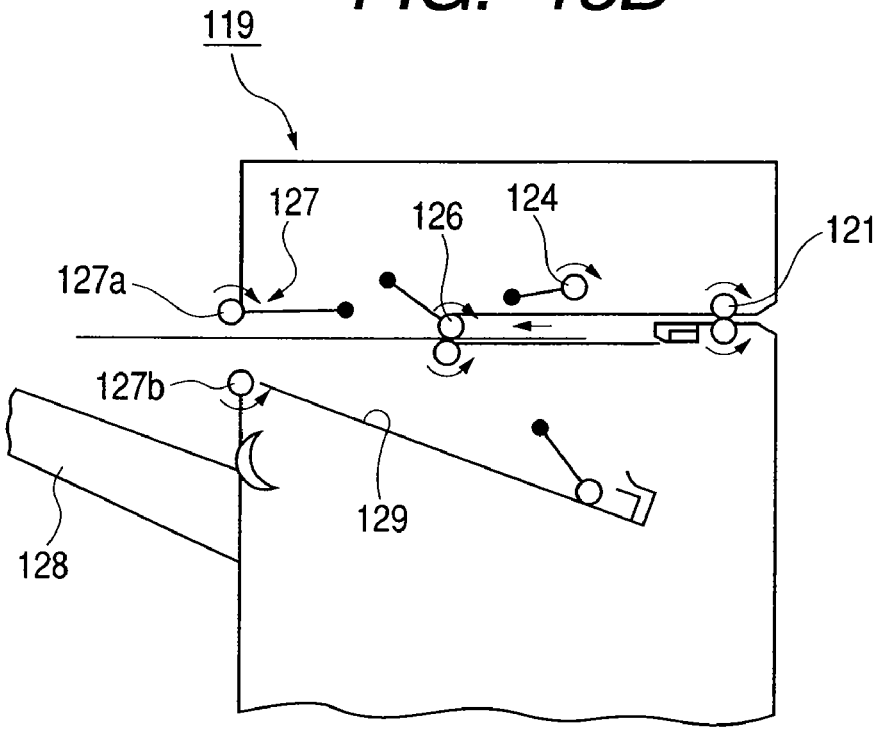
Figure 14A:
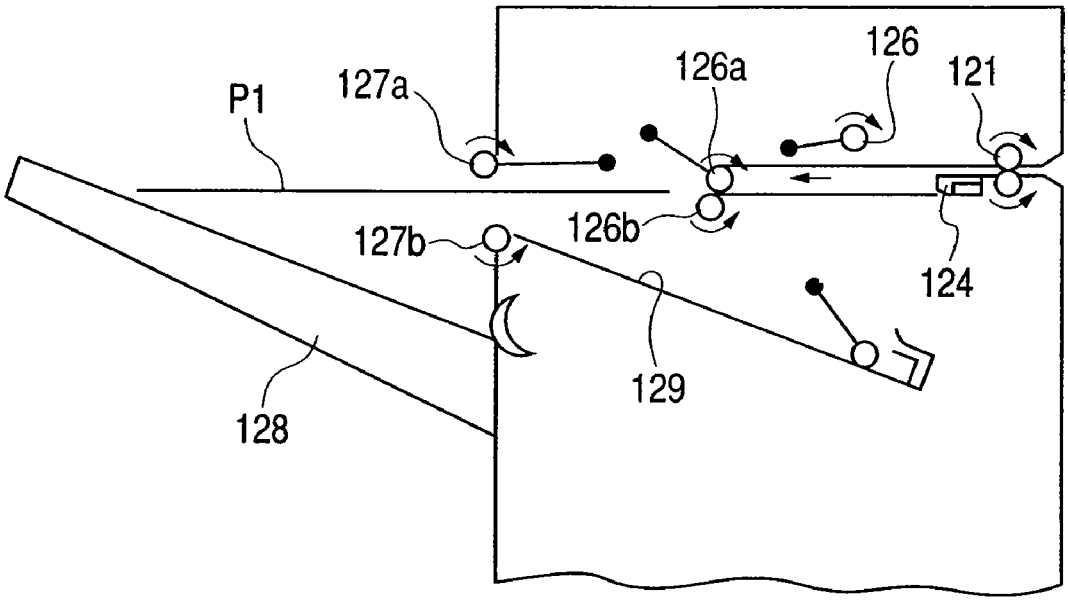
FIGS. 14A and 14B are views for explaining an operation of the sheet processing apparatus following the operations of FIGS. 13A and 13B in the case where the sheets are not required to be stored during the sheet processing, where
Figure 14B:
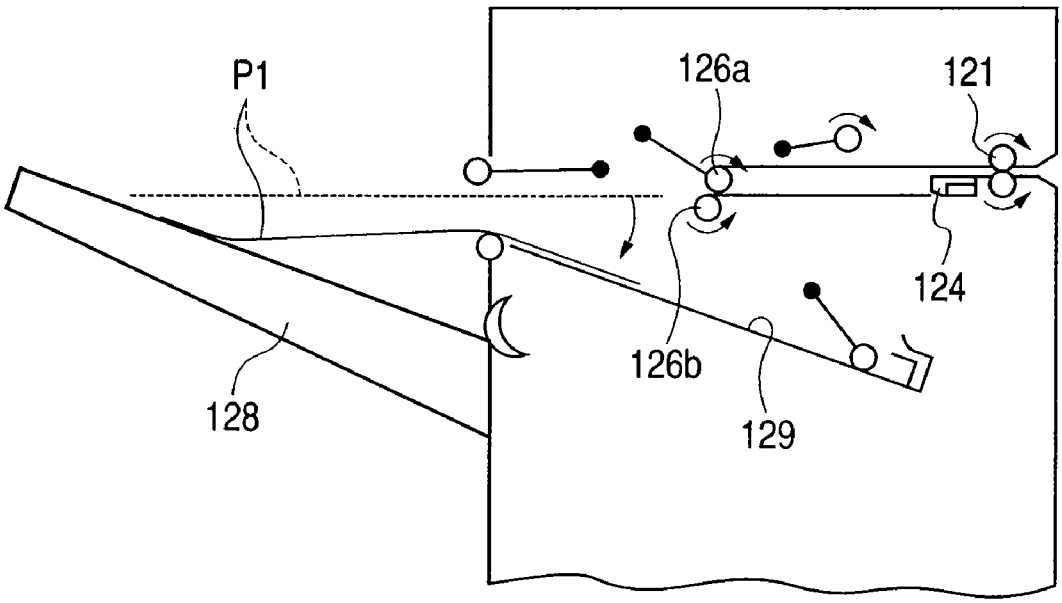
Figure 15A:
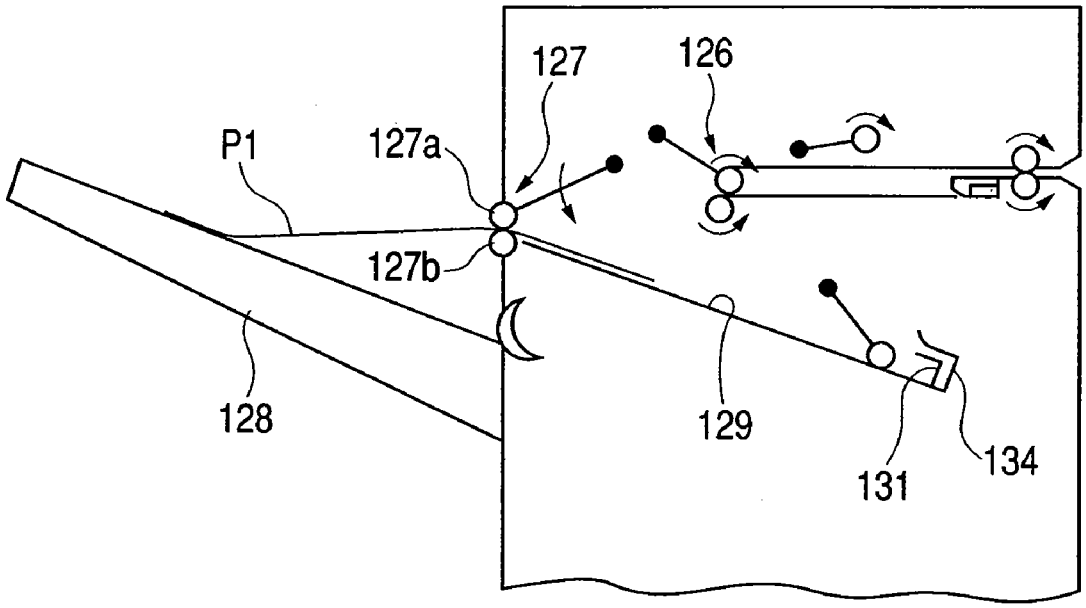
FIGS. 15A and 15B are views for explaining an operation of the sheet processing apparatus following the operations of FIGS. 14A and 14B in the case where the sheets are not required to be stored during the sheet processing, where
Figure 15B:
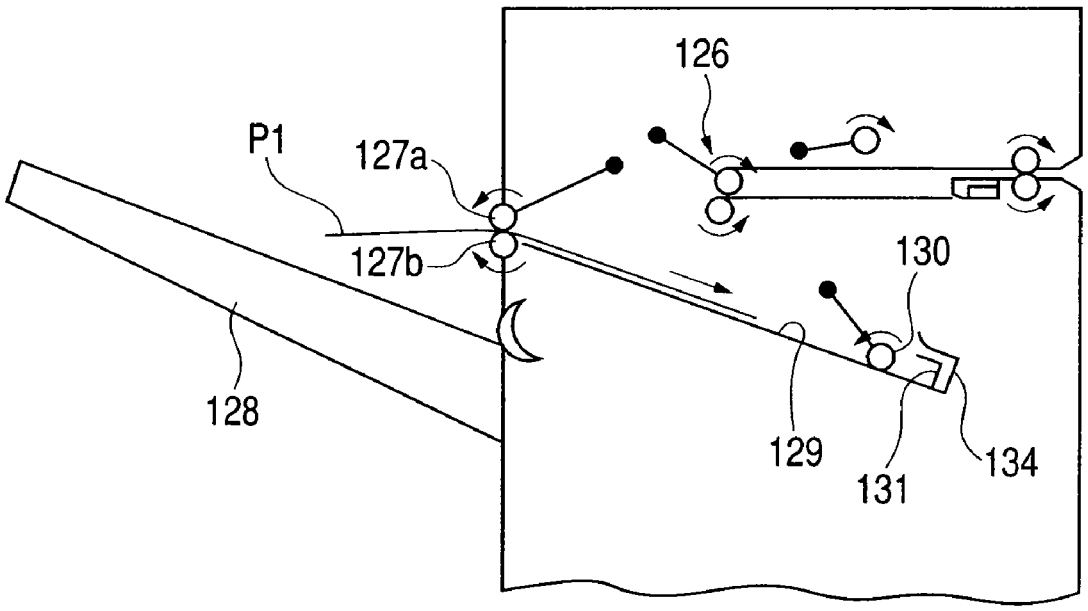

As shown in FIG. 13B, the sheet P1 is further conveyed by the rotation of the first sheet discharging roller pair 126 and, as shown in FIG. 14A, is discharged onto the stack tray 128. As shown in FIG. 14B, the sheet P1 is dropped while straddling between the stack tray 128 and the processing tray 129. Thereafter, as shown in FIGS. 15A and 15B, the upper roller 127*a* is lowered by the plunger (not shown) to pinch the sheet between the upper roller and the lower roller 127*b* (step S101 in FIG. 9).

In this case, the upper roller 127*a* has already been rotated in a direction shown by the arrow by means of the stack discharging motor M3 (refer to FIG. 4). Further, the return roller 130 capable of engaging and disengaging with respect to the processing tray 129 is also rotated in a direction shown by the arrow by means of the stack discharging motor M3 (refer to FIG. 4). However, the lower roller 127*b* is rotated idly by the action (step S102) of the clutch CL under stack (refer to FIG. 4). The reason is that, after the first sheet is stacked on the processing tray 129, when a second sheet, a third sheet and so on are stacked, if the lower roller 127*b* is rotated positively, the lower roller 127*b* also pushes the first sheet toward a stopper 131, so that the first sheet may be wrinkled.

Figure 16A:
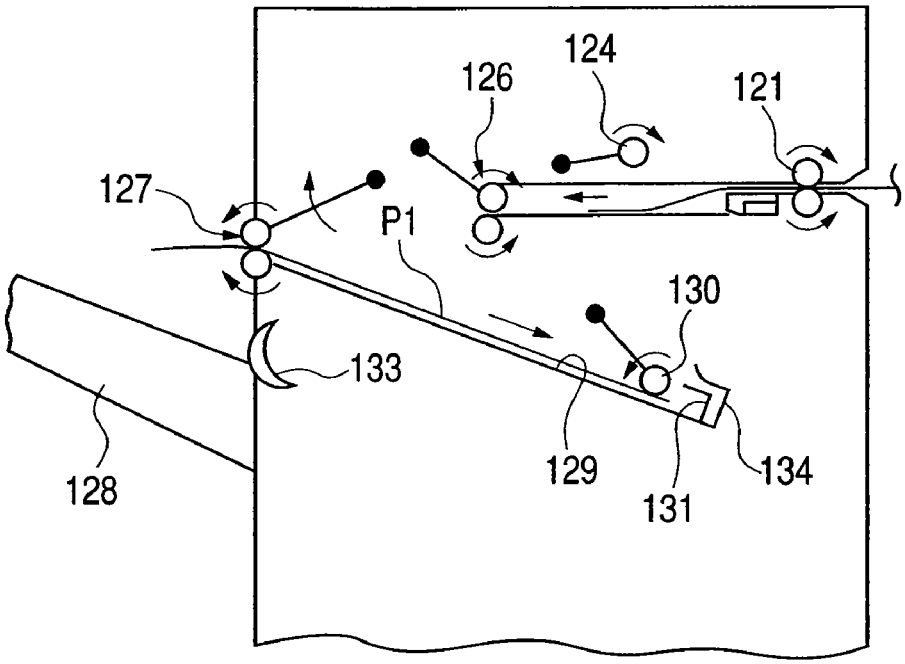
FIGS. 16A and 16B are views for explaining an operation of the sheet processing apparatus following the operations of FIGS. 15A and 15B in the case where the sheets are not required to be stored during the sheet processing, where
Figure 16B:
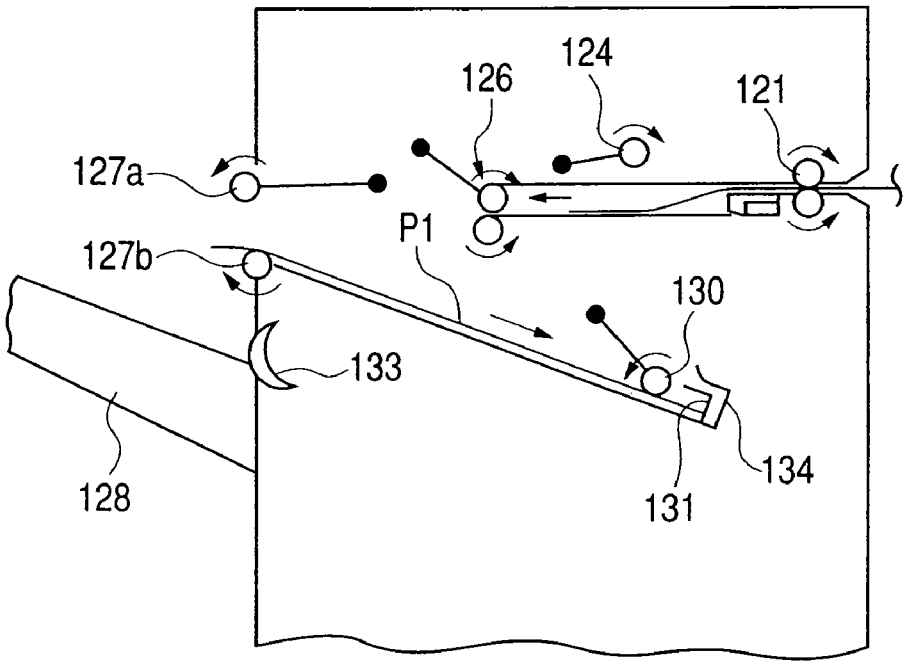

When about 150 msec is elapsed (step S103) after the clutch CL under stack is operated, as shown in FIG. 16A, the sheet is slidingly lowered onto the processing tray 129 inclined downwardly and rightwardly in a direction shown by the arrow by the rotations of the rocking roller pair 127 and the return roller 130. In this case, the trailing end assist 134 is positioned at a waiting (or retraction) position (refer to FIG. 5). Before the sheet P1 abuts against the stopper 131, the upper roller 127*a* is separated from the sheet P1. The sheet P1 abuts against the stopper 131 by the action of the return roller 130. Thereafter, alignment of the sheet in a width-wise direction is performed by a pair of alignment plates 144*a* and 144*b* (refer to FIG. 5) (step S104).

Figure 17:
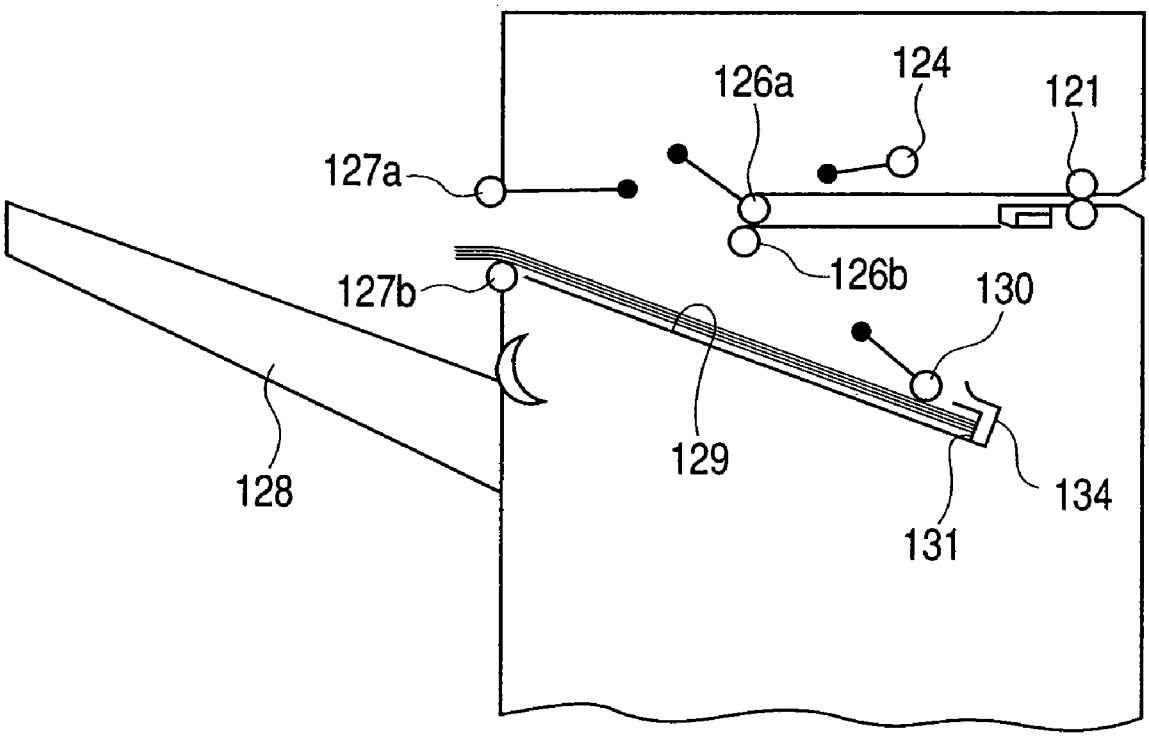
FIG. 17 is a view for explaining an operation of the sheet processing apparatus in the case where the sheets are not required to be stored during the sheet processing, in a condition that a third sheet is stacked on the processing tray.

Thereafter, similarly, succeeding sheets are stacked on the processing tray 129. As shown in FIG. 17, when a predetermined number of sheets are stacked on the processing tray 129, the sheets forming s sheet stack are stapled by the stapler unit 132 shown in FIGS. 3 and 4. Incidentally, in place of the fact that the sheet stack is stapled by the stapler unit 132, the sheet stack may be punched by a punching unit (not shown).

Figure 18A:
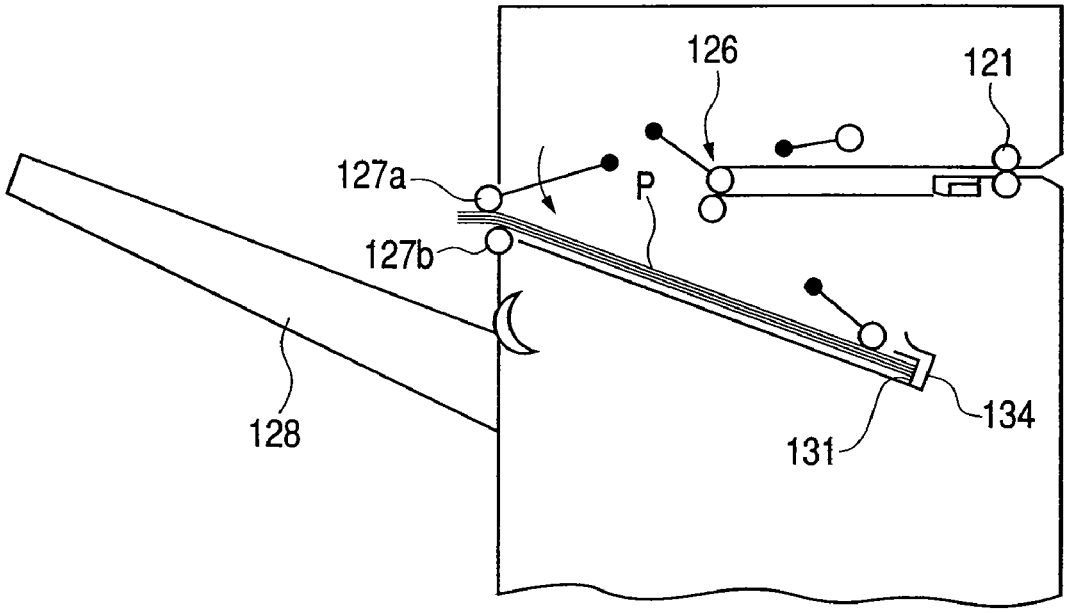
FIGS. 18A and 18B are views for explaining an operation of the sheet processing apparatus following the operation of FIG. 17 in the case where the sheets are not required to be stored during the sheet processing, where

When the sheet stack is stapled, as shown in FIG. 18A, the stack tray is shifted to a position where it can be detected by the sheet surface detecting lever 133 and is waiting (or retracted) at a position where the stack tray can easily receive the sheet stack (step S105).

Figure 5:
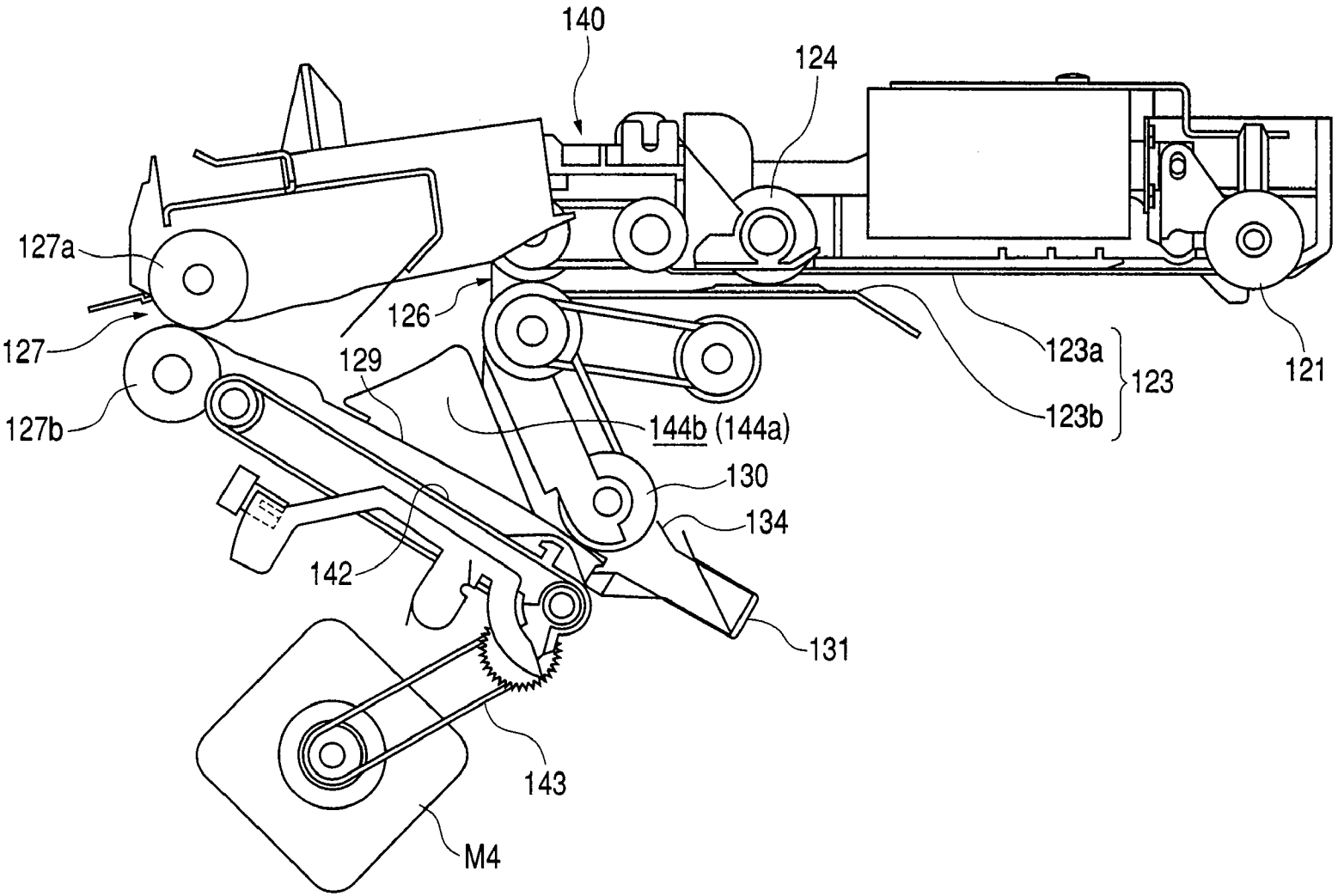
FIG. 5 is an enlarged view showing main parts of the sheet processing apparatus according to the embodiment of the present invention.
Figure 6:
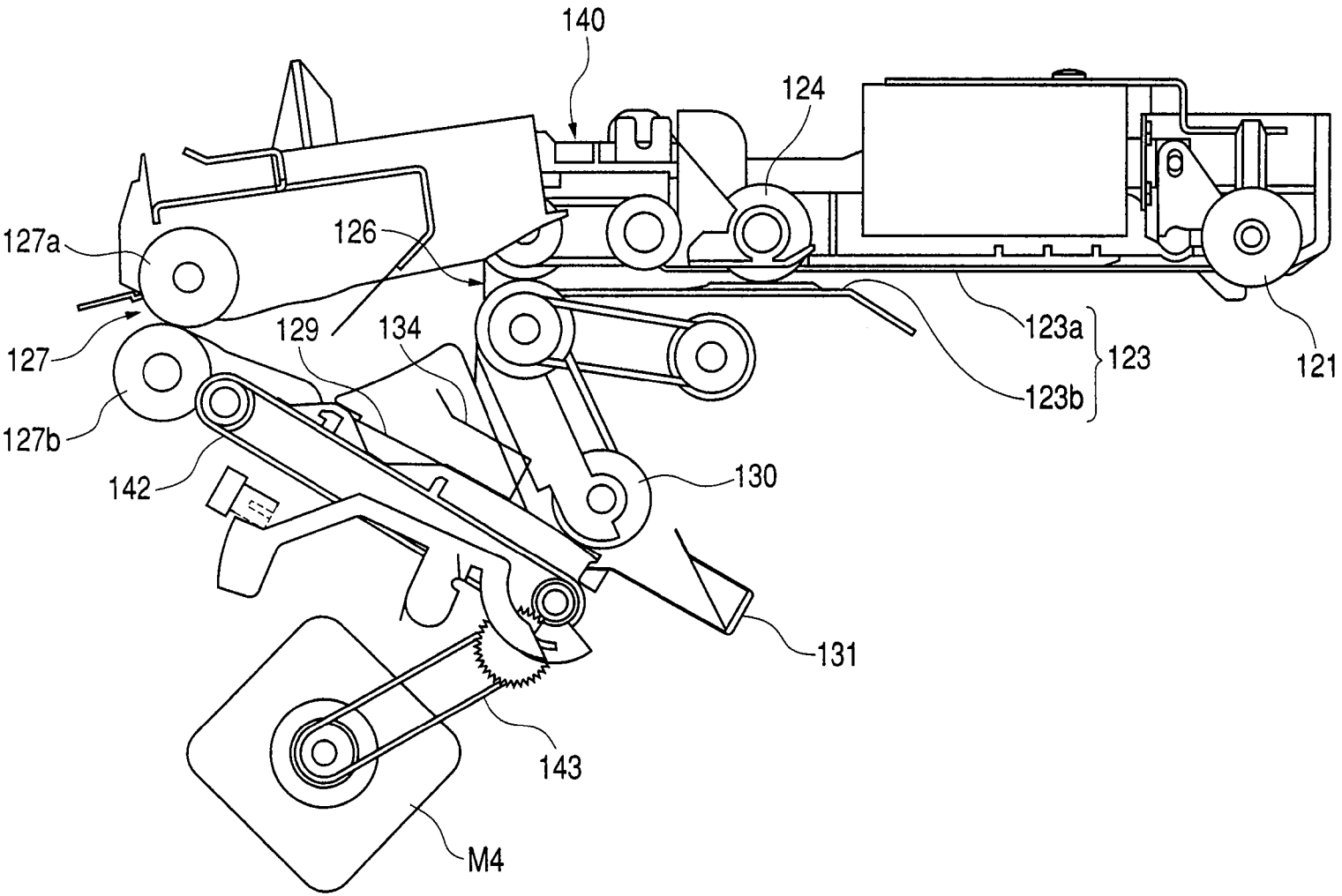
FIG. 6 is a view showing a condition that trailing end assist of FIG. 5 is shifted.
Figure 7:
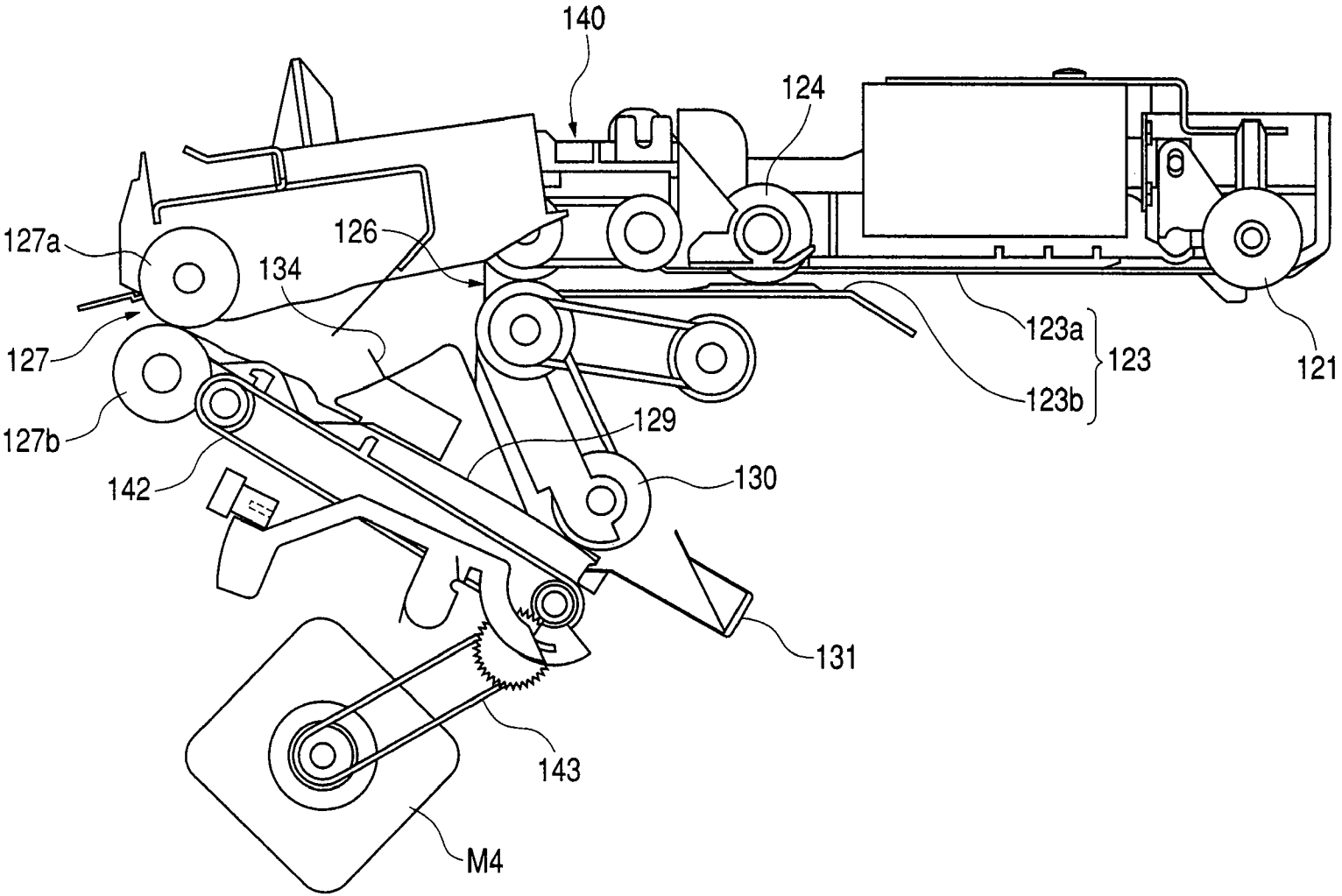
FIG. 7 is a view showing a condition that the trailing end assist is further shifted from the condition of FIG. 6.
Figure 18B:
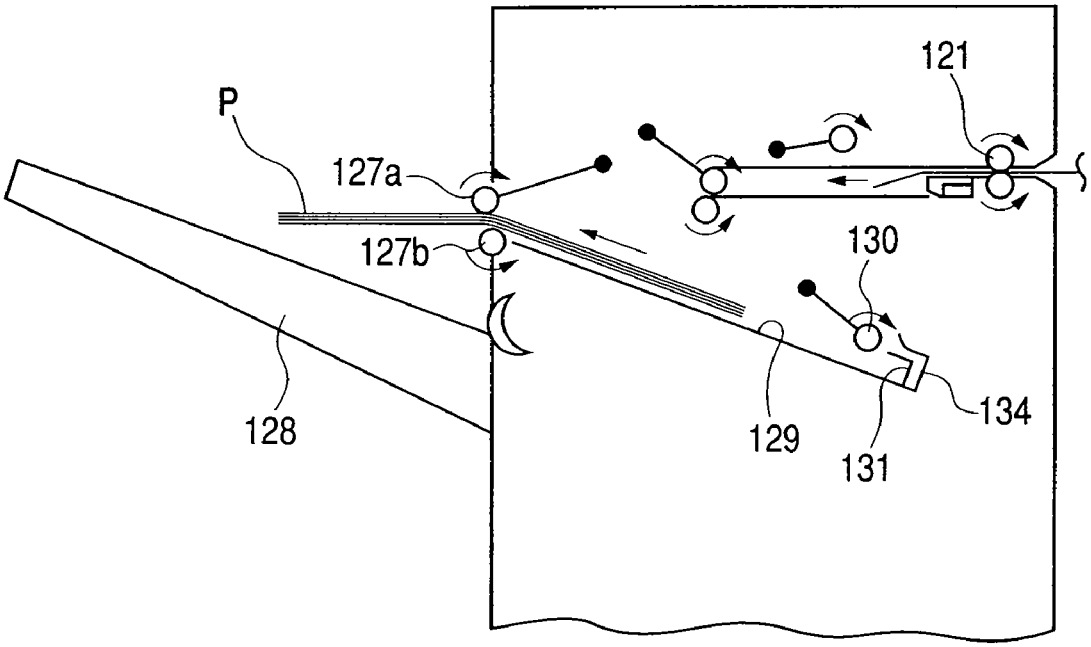

As shown in FIG. 18B, the upper roller 127*a* is rotated in the direction shown by the arrow while pinching the sheet stack P between this roller and the lower roller 127*b*, and the trailing end assist 134 pushes a trailing end of the sheet stack P to discharge the sheet stack onto the stack tray 128 (FIGS. 6 and 7). As shown in FIGS. 5, 6 and 7, the trailing end assist 134 is provided on a belt 142 which can be rotated reversibly by a trailing end assist motor M4.

In this case, as shown in FIGS. 10 and 11, when starting times (T1) and starting speeds (132 mm/sec) of the rocking roller pair 127 and of the trailing end assist 134 are same and a same time (T2) is reaches at a same acceleration finishing speed (500 mm/sec), the rocking roller pair 127 and the trailing end assist 134 can discharge the sheet stack without applying a tensile force or a compression force to the sheet stack (step S106).

However, as shown in FIG. 11, there is a case where the starting speed of the trailing end assist 134 becomes greater than the starting speed (for example, 300 mm/sec) of the rocking roller pair 127 due to the presence of belts 143 and 142 for transmitting a rotational force of the trailing end assist motor M4 to the trailing end assist 134. In such a case, the trailing end assist 134 does not start to shift but is stopped till a time T3 in which the sheet conveying speed of the rocking roller pair 127 reaches 300 mm/sec, and, when the sheet conveying speed of the rocking roller pair 127 is reached, the trailing end assist starts to shift. That is to say, the trailing end assist 134 is started when $\Delta T=(T3-T1)$ is elapsed after the rocking roller pair 127 is started (step S107). Incidentally, if the starting speed of the rocking roller pair 127 is greater than the starting speed of the trailing end assist 134, conversely, the starting speed of the rocking roller pair 127 is delayed by the time $\Delta T$. If the starting speed of the trailing end assist 134 is the same as the starting speed of the rocking roller pair 127, $\Delta T$ is zero.

As such, by providing the time difference $\Delta T$ upon starting, if there is the difference in the starting speed between the rocking roller pair 127 and the trailing end assist 134, the sheet stack can be discharged without applying the tensile force or the compression force to the sheet stack. Further, the rocking roller pair 127 does not form rubbing traces on the sheet stack, with the result that quality of the sheet stack and quality of images on the sheet stack are not deteriorated.

Figure 19:
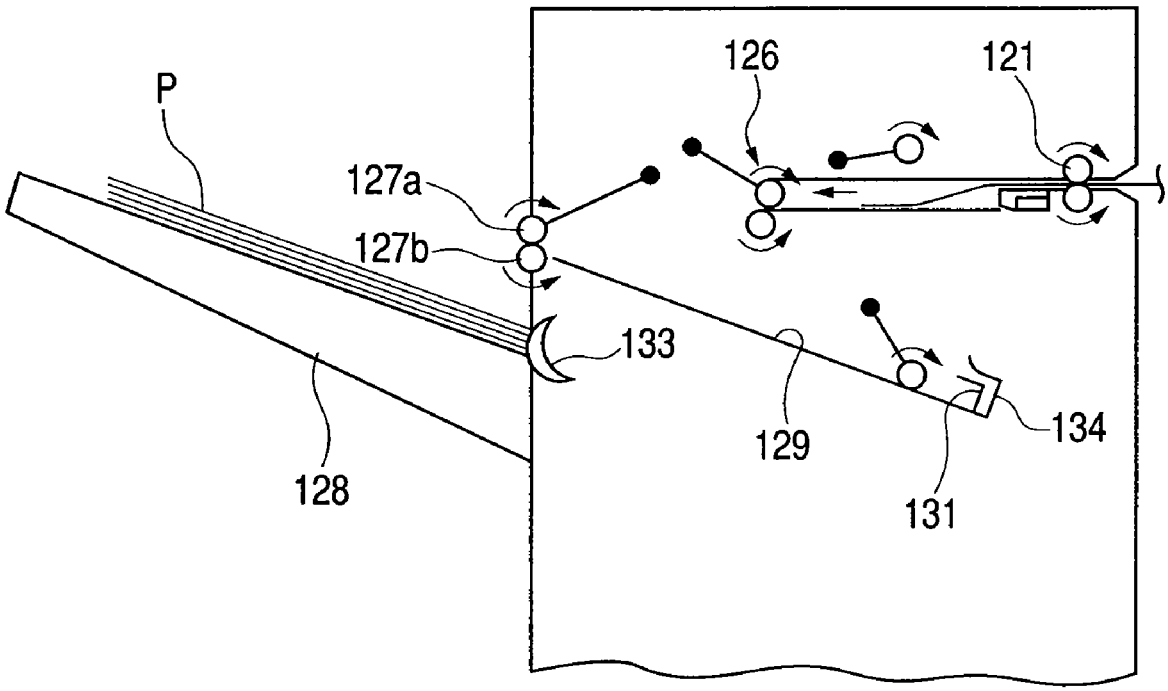
FIG. 19 is a view for explaining an operation of the sheet processing apparatus in the case where the sheets are not required to be stored during the sheet processing, in a condition that the sheet stack was discharged from the processing tray onto the stack tray.

The sheet stack starts to be fed out toward the stack tray 128 by the rocking roller pair 127, trailing end assist 134 and return roller 130 (step S108). The trailing end assist 134 is returned to its original position (home position) (step S110; operation corresponding to HP discharging control in FIG. 12) after it was shifted by about 15 mm (step S109). As shown in FIG. 19, the sheet stack is discharged onto the stack tray 128 by the rocking roller pair 127. Thereafter, at a time when the upper lower 127*a* of the rocking roller pair 127 is separated from the lower roller 127*b*, a series of sheet stack discharging operations are finished (steps S111 and S112).

In FIG. 18B, when the sheet stack starts to be discharged, a first sheet for a next sheet stack has fed into the inlet roller pair 121.

In the sheet processing apparatus 119 according to the illustrated embodiment, since the trailing end assist 134 urges the trailing end of the sheet stack to convey the sheet stack, the surface of the sheet stack is not damaged and the sheet stack can be conveyed positively, unlike to the case where the sheet stack is discharged by urging the rotating rollers against the surfaces of the sheet stack.

(Explanation of Buffering Operation)

Although the above-mentioned operational explanation relates to, for example, the case where the conveying distance between the sheets are long and the stapling processing of the sheet stack can be performed before the next sheet is fed in, the following operational explanation relates to a buffering operation in which the conveying distance between sheets are short and, when succeeding sheets are fed in while the sheet stack is being processed, the succeeding sheets are stored (buffered) during a stapling processing operation.

The sheet processing apparatus 119 performs a buffering operation on the basis of buffering operation command from the finisher controlling portion 211 when the CPU circuit portion 200 of the main body 101 judges that a distance between sheets fed from the main body 101 of the copier 100 is smaller than the sheet stapling processing time. In this case, buffer roller 124 is lowered by the plunger SL1 (refer to FIG. 4) to be contacted with the lower conveying guide plate 123*b*.

Figure 20A:
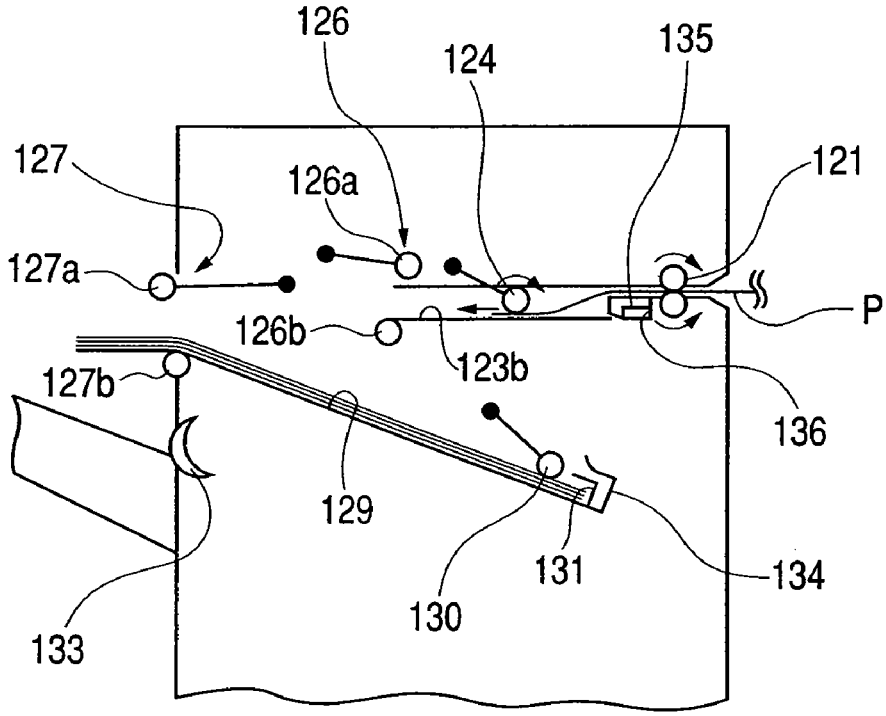
FIGS. 20A and 20B are views for explaining an operation of the sheet processing apparatus in a case where sheets are to be stored during sheet processing, where
Figure 20B:
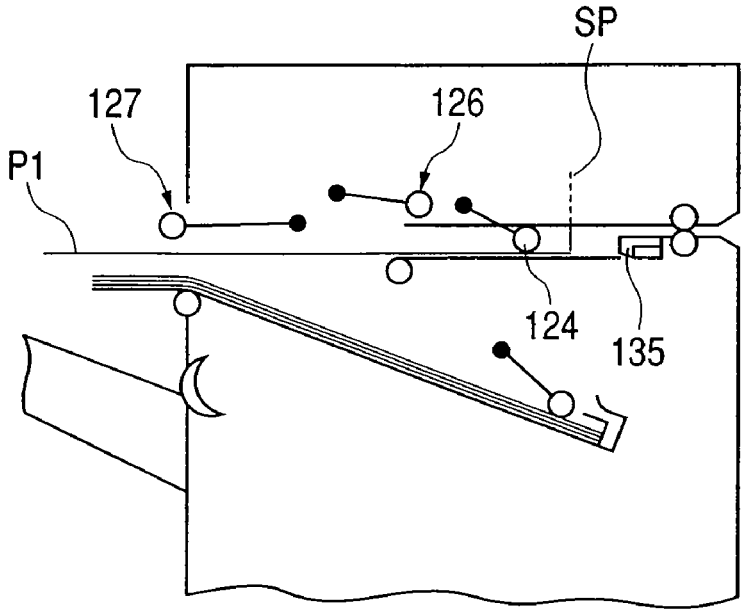

In FIGS. 20A and 20B, it is assumed that the sheet stack is stacked on the processing tray 129 by the aforementioned operation. Further, it is assumed that the stapling processing is performed by the stapler unit 132 (refer to FIGS. 3 and 4) with respect to the sheet stack.

As shown in FIG. 20A, while the stapling processing is being performed with respect to the sheet stack P stacked on the processing tray 129, when a first sheet P1 for a next sheet stack is fed in, the sheet P1 is sent to the buffer roller 124 by the inlet roller pair 121. The buffer roller 124 is rotated by the inlet conveying motor M2 (refer to FIG. 4) to convey the sheet P1 toward a downstream direction. In this case, an upper first sheet discharging roller 126*a* of the first sheet discharging roller pair 126 is separated from a lower first sheet discharging roller 126*b* by a first sheet discharging roller separating plunger SL2 (refer to FIG. 4). Incidentally, in FIG. 4, since the first sheet discharging roller separating plunger SL2 is overlapped with the buffer roller separating plunger SL1 in a viewing direction, the plunger SL2 is not shown in FIG. 4. Further, the upper roller 127*a* of the rocking roller pair 127 is also separated from the lower roller 127*b* by the plunger (not shown).

Figure 21A:
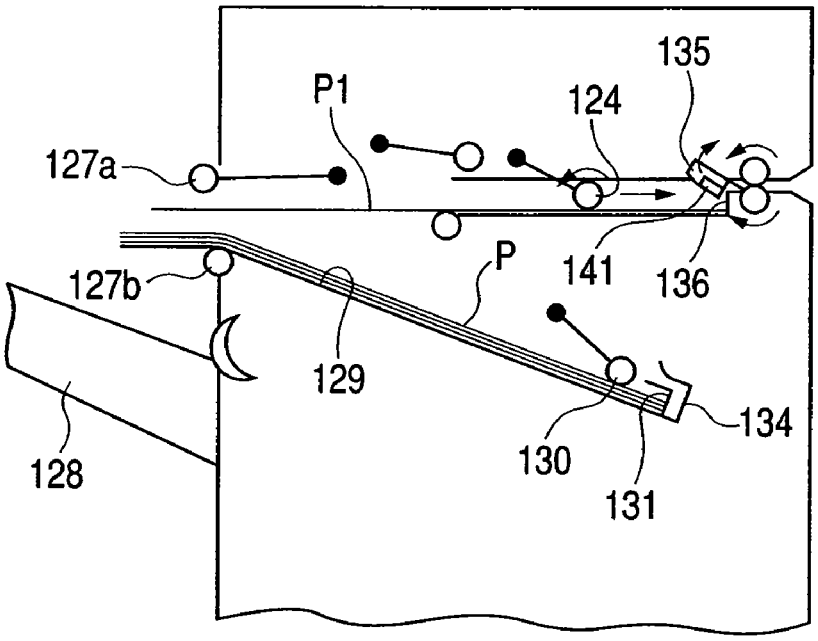
FIGS. 21A and 21B are views for explaining an operation of the sheet processing apparatus following the operations of FIGS. 20A and 20B in the case where the sheets are to be stored during the sheet processing, where

As shown in FIG. 20B, when a trailing end of the sheet P1 reaches a switchback point SP, as shown in FIG. 21A, the sheet P1 is returned toward an upstream direction by a reverse rotation of the buffer roller 124. At substantially the same time, the trailing end pressing member 135 is separated from the lower conveying guide plate 123*b* to open the trailing end receiving stop portion 136. The reaching to the switchback point SP can be detected on the basis of elapse of a predetermined time after the inlet path sensor S1 disposed in the vicinity of a downstream side of the inlet roller pair 121 shown in FIG. 4 is operated by a leading end (downstream end) of the sheet or by counting the number of revolutions of the buffer roller 124.

Figure 21B:
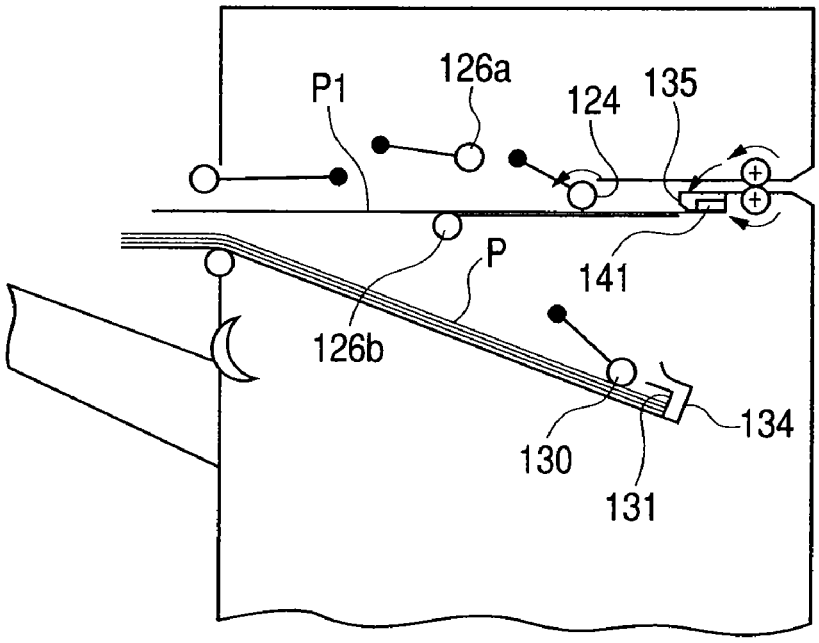

After the downstream end of the sheet is detected, as shown in FIG. 21A, an upstream end of the sheet P1 is received by the trailing end receiving stop portion 136. Thereafter, as shown in FIG. 21B, the trailing end pressing member 135 is returned to its original position, so that the sheet P1 is pressed against the lower conveying guide plate 123*b* by a friction member 141 provided on the trailing end pressing member 135.

Figure 22A:
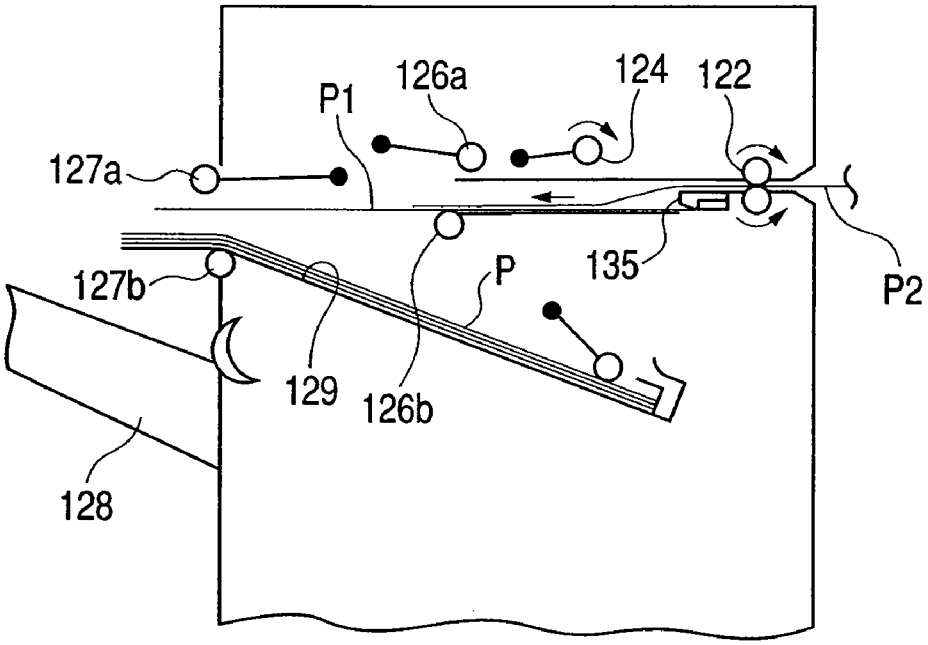
FIGS. 22A and 22B are views for explaining an operation of the sheet processing apparatus following the operations of FIGS. 21A and 21B in the case where the sheets are to be stored during the sheet processing, where
Figure 22B:
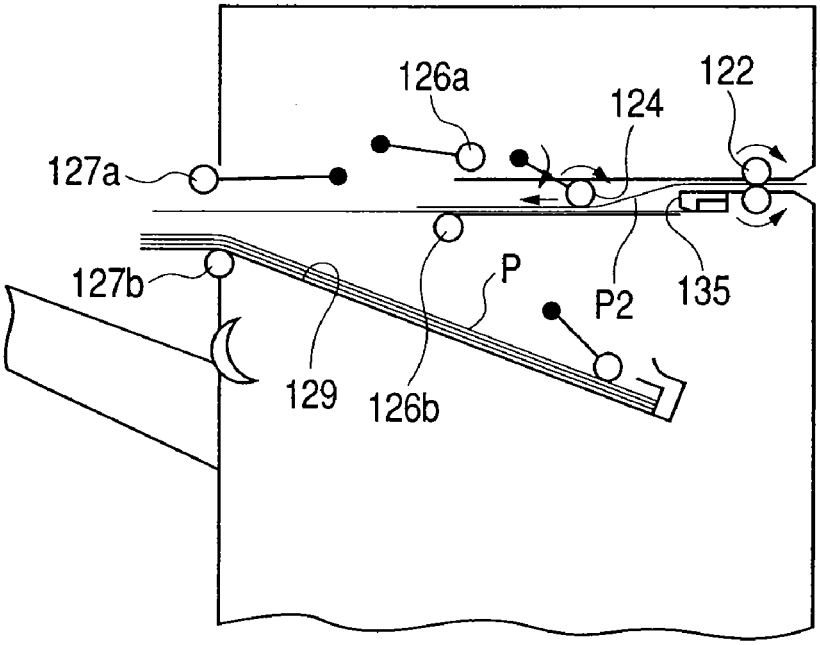

Thereafter, as shown in FIG. 22A, a second sheet P2 is sent in. The second sheet P2 is conveyed by the inlet roller pair 121. In this case, the sheet P2 is passed over the trailing end pressing member 135. Thereafter, as shown in FIG. 22B, the sheet P2 is also conveyed by the buffer roller 124.

In this case, the first sheet P1 is pressed against the lower conveying guide plate 123*b* together with the second sheet P2 by the buffer roller 124, so that the first sheet tries to follow the second sheet P2 to be shifted toward the downstream direction. However, since the first sheet P1 is pressed against the lower conveying guide plate 123*b* by the friction member 141 provided on the trailing end pressing member 135, the first sheet cannot be shifted.

Figure 23A:
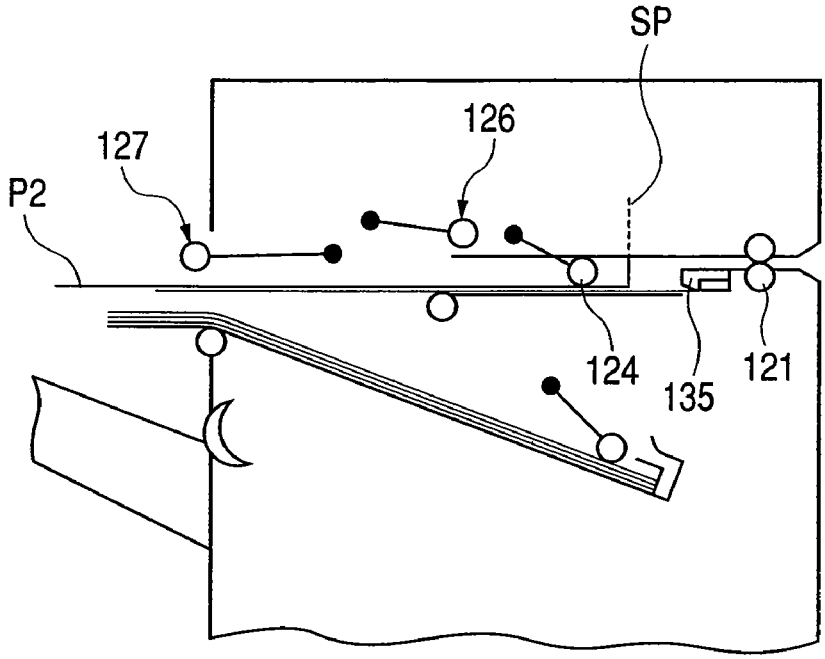
FIGS. 23A and 23B are views for explaining an operation of the sheet processing apparatus following the operations of FIGS. 22A and 22B in the case where the sheets are to be stored during the sheet processing, where
Figure 23B:
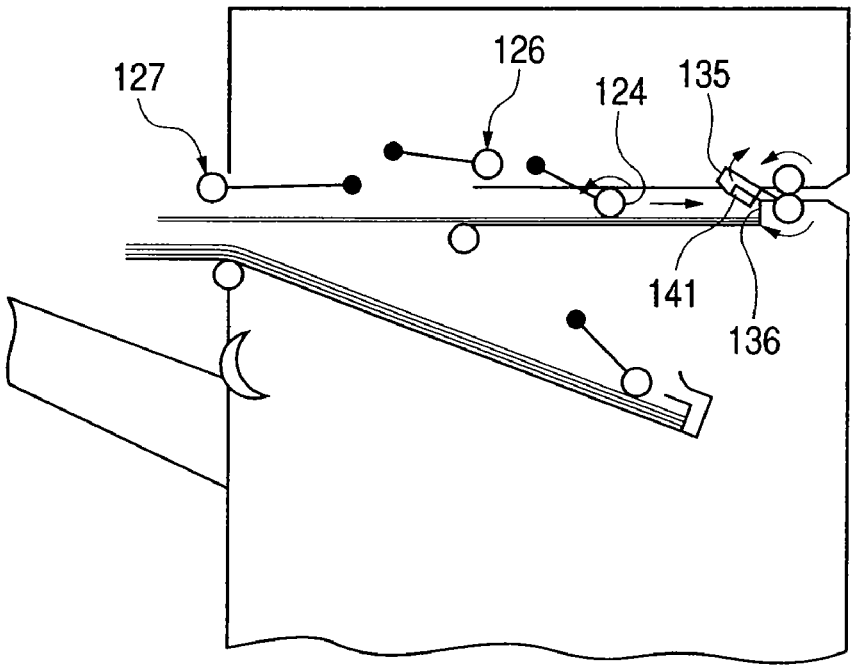
Figure 24:
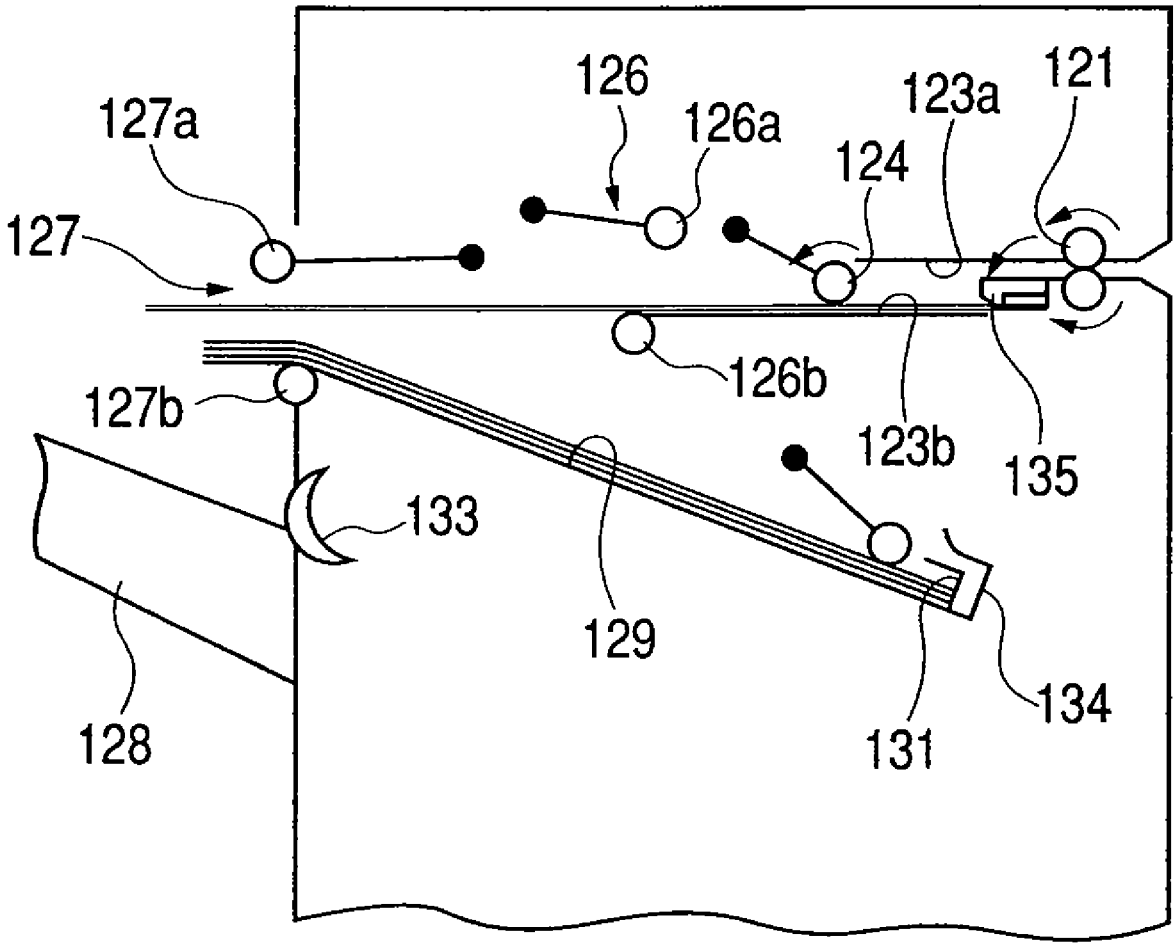
FIG. 24 is a view for explaining an operation of the sheet processing apparatus in the case where the sheets are to be stored during the sheet processing, in a condition that the first and second sheets are pressed down against the lower conveying guide plate by the trailing end pressing member in an overlapped fashion.

Similar to the first sheet P1, the second sheet P2 is also returned toward the upstream direction as shown in FIGS. 23A, 23B and 24 when a trailing end of the second sheet reaches the switchback point SP. Then, the second sheet P2 is pressed against the lower conveying guide plate 123*b* by the friction member 141 of the trailing end pressing member 135 in a condition that the second sheet is overlapped with the first sheet P1.

Figure 25A:
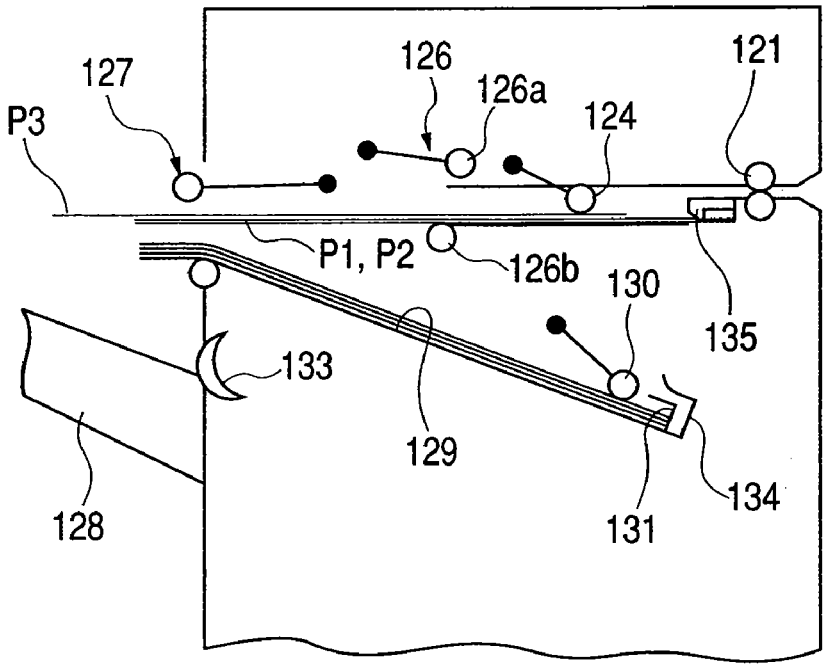
FIGS. 25A and 25B are views for explaining an operation of the sheet processing apparatus following the operation of FIG. 24 in the case where the sheets are to be stored during the sheet processing, where
Figure 25B:
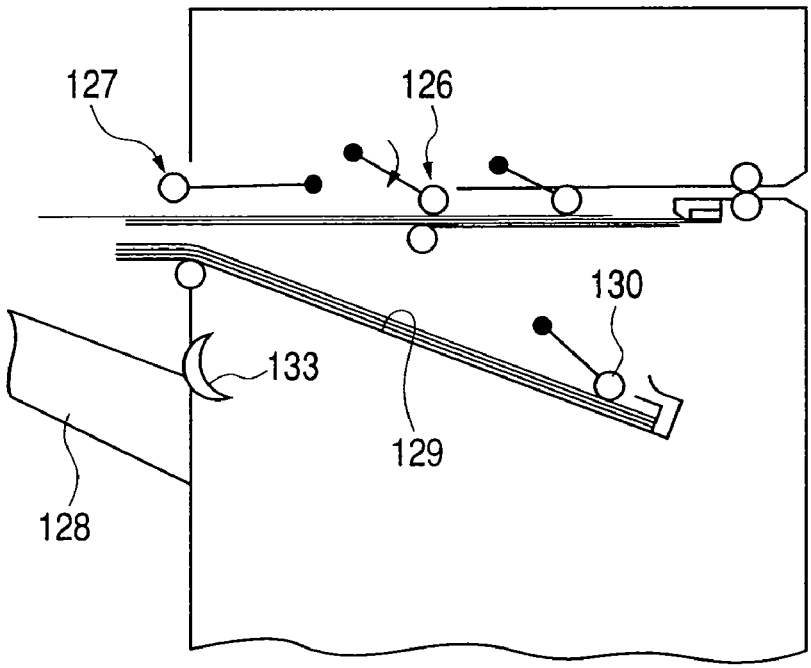
Figure 26A:
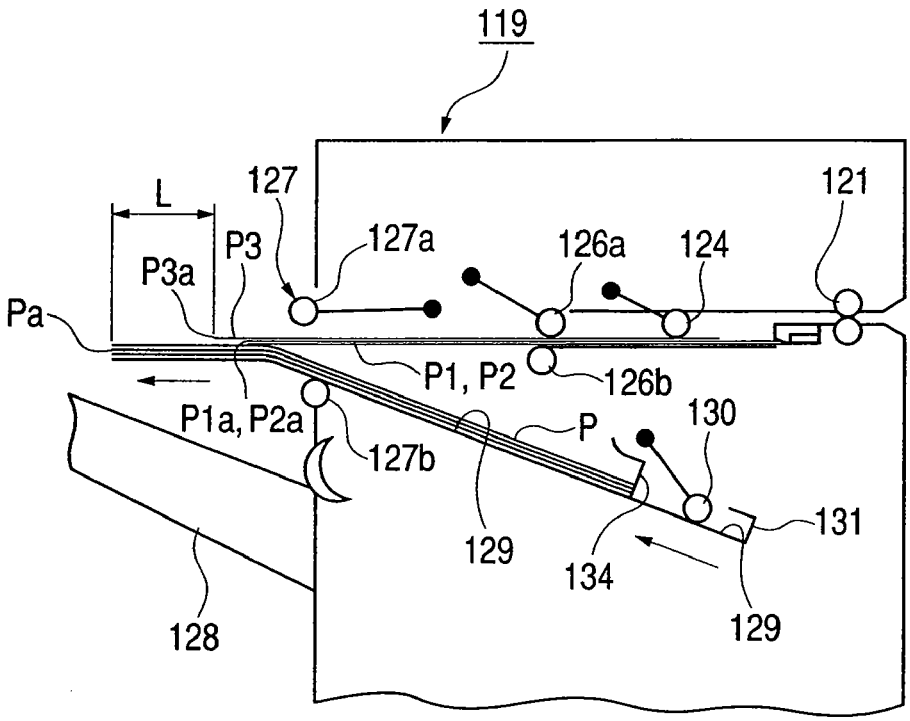
FIGS. 26A and 26B are views for explaining an operation of the sheet processing apparatus following the operations of FIGS. 25A and 25B in the case where the sheets are to be stored during the sheet processing, where

Thereafter, as shown in FIG. 25A, a third sheet P3 is fed, and, when a trailing end of the sheet P3 is passed through the inlet roller pair 121, as shown in FIG. 25B, the upper first sheet discharging roller 126*a* and the lower first sheet discharging roller 126*b* pinch the first to third sheets therebetween. In this case, the third sheet P3 is slightly protruded toward the downstream direction more than the first and second sheets P1 and P2. Further, at this time, since the stapling processing of the sheet stack on the processing tray 129 is finished, as shown in FIG. 26A, the trailing end assist 134 is shifted along the processing tray 129, thereby pushing the trailing end of the sheet stack upwardly. As a result, a downstream end Pa of the sheet stack P is protruded toward the downstream direction more than a downstream end P3*a* of the third sheet P3 by a length of L.

Figure 26B:
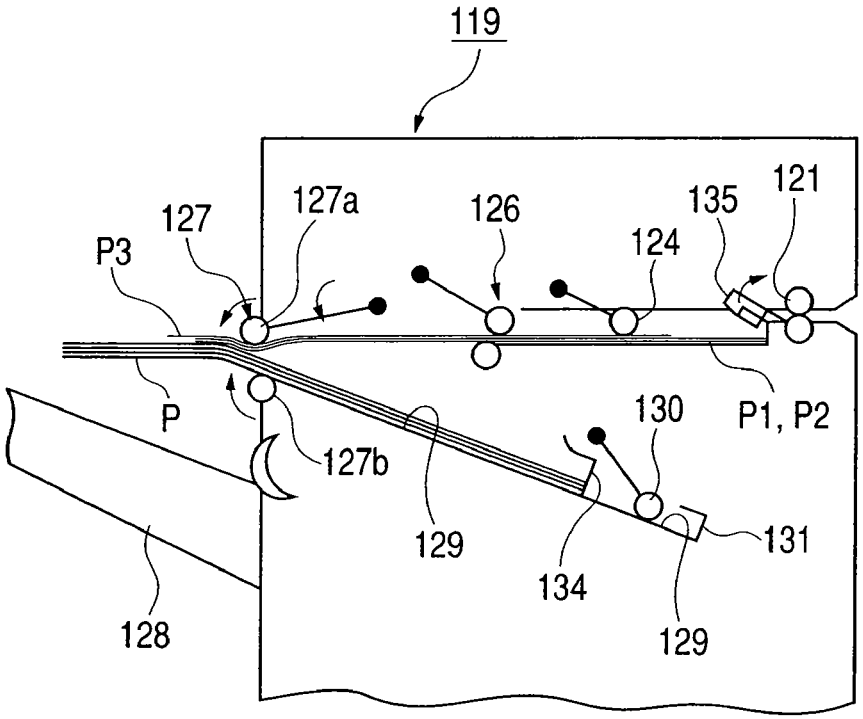

Then, as shown in FIG. 26B, the upper roller 127*a* is also lowered to pinch the three sheets P1 to P3 and the sheet stack P between the upper roller and the lower roller 127*b*. In accordance with this, the trailing end pressing member 135 is separated from the second sheet P2 to release the first sheet P1 and the second sheet P2.

Figure 27A:
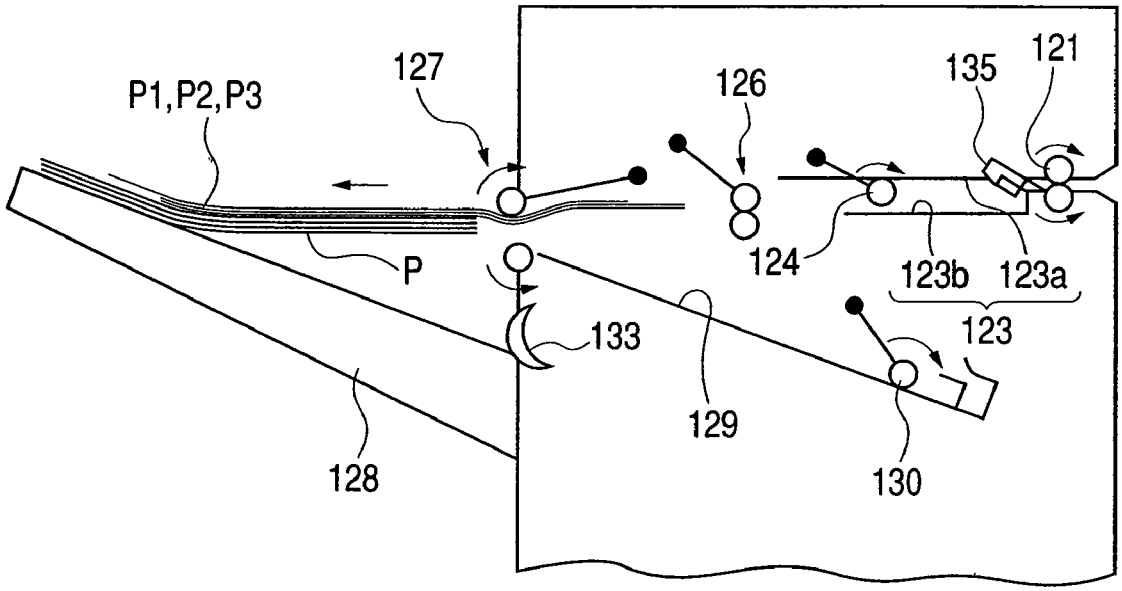
FIGS. 27A and 27B are views for explaining an operation of the sheet processing apparatus following the operations of FIGS. 26A and 26B in the case where the sheets are to be stored during the sheet processing, where
Figure 27B:
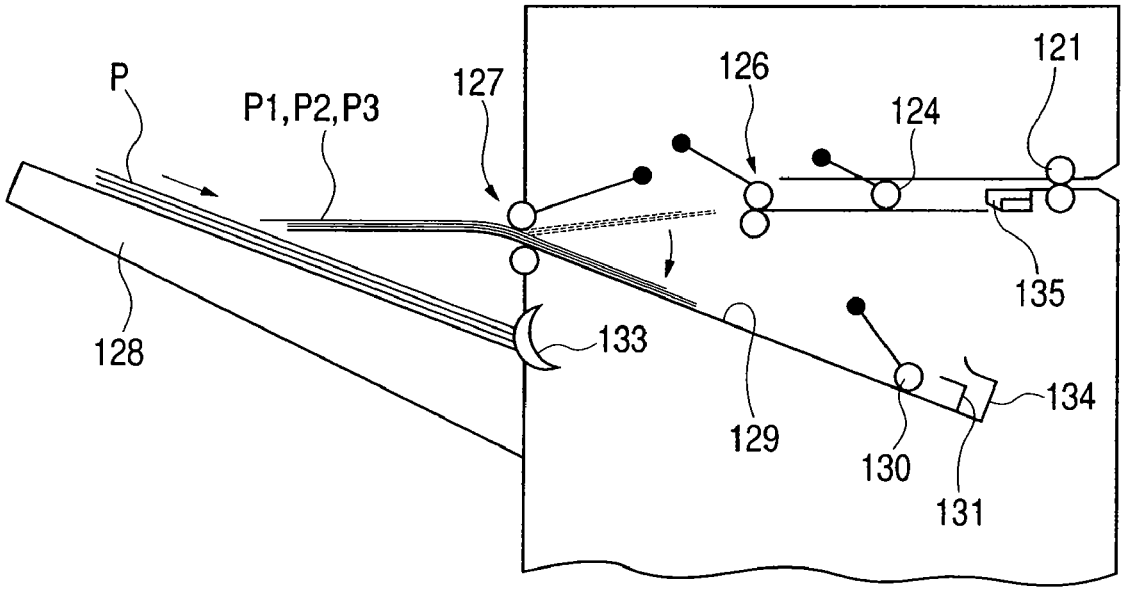

Thereafter, the three sheets P1 to P3 and the sheet stack P are conveyed by the rocking roller pair 127 while being pinched by the rocking roller pair. As shown in FIGS. 27A and 27B, when the sheet stack P is discharged onto the stack tray 128, the trailing ends of the first sheet P1 and the second sheet P2 leave the first sheet discharging roller pair 126 and the upstream end of the third sheet is received by the processing tray 129.

In FIG. 27B, as shown, in a case where the starting times (T1) and the starting speeds (132 mm/sec) of the first sheet discharging roller pair 126, the rocking roller pair 127 and the trailing end assist 134 are the same, when the same time (T2) is reached at the same acceleration finishing speed (500 mm/sec), the first sheet discharging roller pair 126, rocking roller pair 127 and trailing end assist 134 can discharge the sheet stack without applying the tensile force and the compression force to the sheet stack and the three sheets. However, if there is a difference in the starting speed, as is in the step S107 in FIG. 9, by operating the first sheet discharging roller pair, rocking roller pair and trailing end assist with the time difference of $\Delta T$, the sheet stack can be discharged without applying the tensile force and the compression force to the sheet stack and the three sheets. Further, the first sheet discharging roller pair 126 and the rocking roller pair 127 do not form rubbing traces on the sheet stack, with the result that quality of the sheet stack and quality of images on the sheet stack are not deteriorated.

Figure 28A:
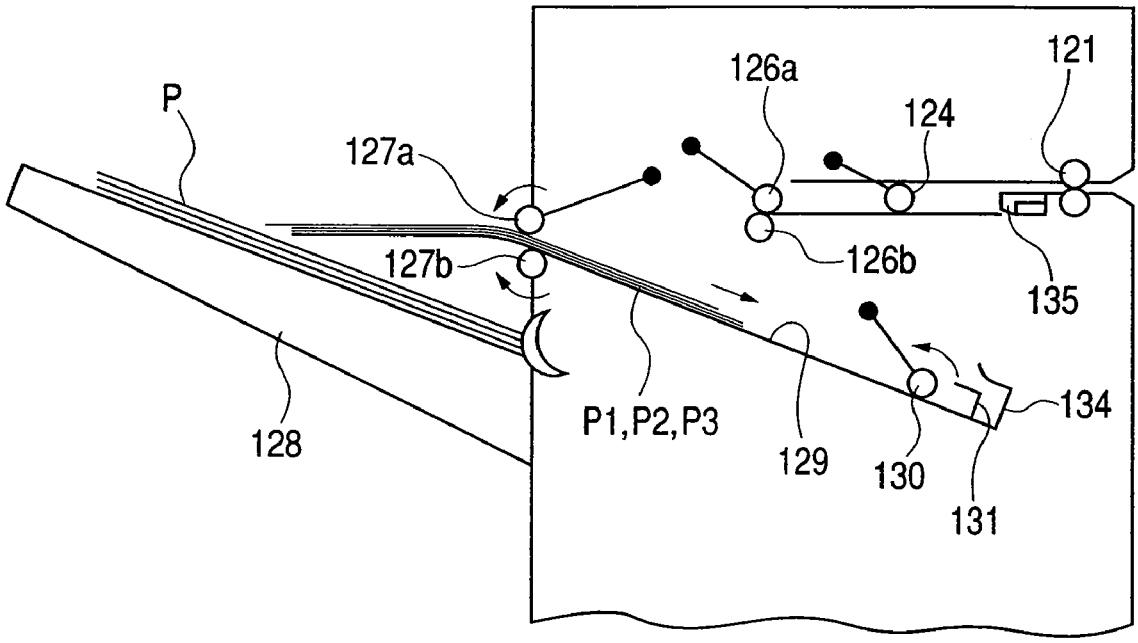
FIGS. 28A and 28B are views for explaining an operation of the sheet processing apparatus following the operations of FIGS. 27A and 27B in the case where the sheets are to be stored during the sheet processing, where
Figure 28B:
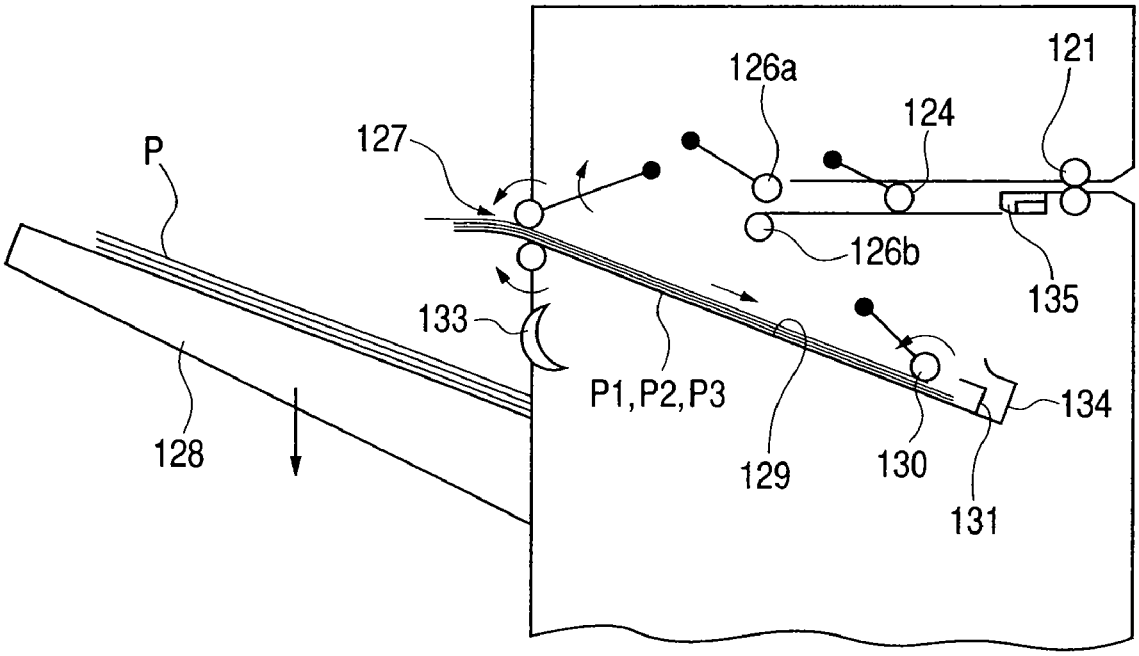

As shown in FIGS. 28A and 28B, the three sheets are slidingly conveyed on the processing tray 129 by the rocking roller pair 127 and the return roller 130 and are received by the stopper 131. Meanwhile, the stack tray 128 is once lowered to lower the upper surface of the sheet stack below the sheet surface detecting lever 133 and then lifted again and is stopped at a time when the sheet surface detecting lever 133 is operated by the upper surface of the sheet stack. As a result, the upper surface of the sheet stack on the stack tray 128 can be maintained at a predetermined height. Thereafter, the sheets are successively stacked on the processing tray 129 without being stored on the lower conveying guide plate 123*b*. When a predetermined number of sheets are stacked, these sheets are stapled. During such stapling operation, first three sheets for a next sheet stack are stored on the lower conveying guide plate 123*b*.

Incidentally, in the above-mentioned explanation, while an example that the three sheets are stored on the lower conveying guide plate 123*b* was explained, the number of sheets (buffer sheets) to be stored is not limited to three since such number is varied with the length of the sheet, stapling time and sheet conveying speed.

As mentioned above, in the sheet processing apparatus 119 according to the illustrated embodiment, as shown FIG. 26A, the downstream end Pa of the sheet stack P is protruded in the downstream direction more than the downstream end P3*a* of the third sheet P3 by the length of L, for the following reason. Incidentally, downstream ends P1*a* and P2*a* of the first and second sheets P1 and P2 are positioned at the upstream side of the downstream end P3*a* of the third sheet P3.

Figure 29:
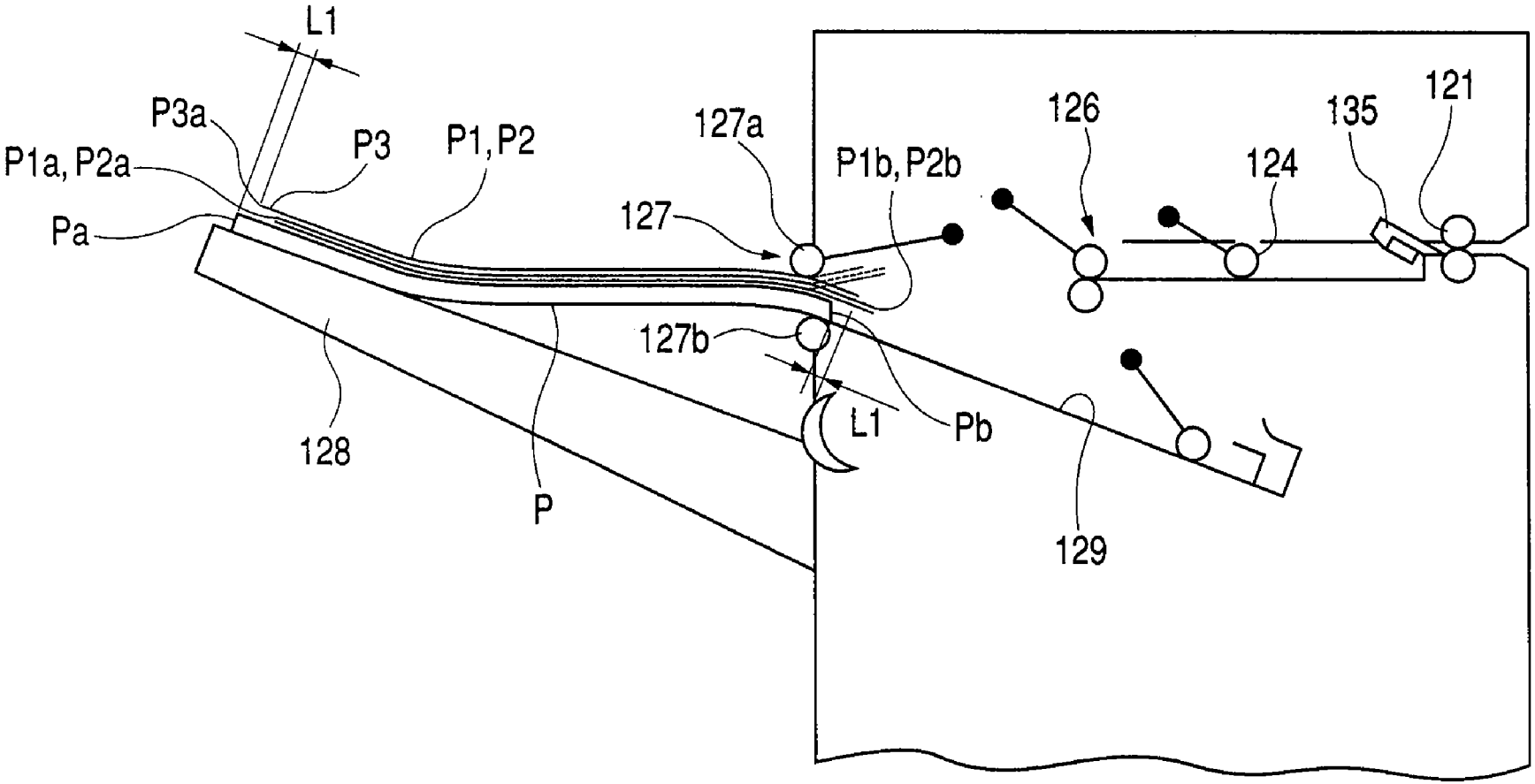
FIG. 29 is a view for explaining an operation in a case where a protruded length of a downstream end of the sheet stack is short from a downstream end of the buffer sheet.

If the protruded length of the downstream end is L1 smaller than the length L, as shown in FIG. 29, the protruded length of the downstream end also becomes L1. Thus, after the sheet stack P is discharged onto the stack tray 128, a length or distance through which the three buffer sheets are grasped by the rocking roller pair 127 becomes shorter, with the result that the rocking roller pair may fail to grasp the three sheets and, thus, the three sheets may not be sent to the processing tray 129 positively. Accordingly, in order that the rocking roller pair 127 can grasp the buffer sheets positively and send them to the processing tray 129, the sheet stack is protruded by the length L with respect to the buffer roller.

Further, if the protruded length is shorter, a contact area between the buffer sheet and the sheet stack becomes greater to contact the sheet stack with the buffer sheet more closely, with the result that the sheet stack tends to be dropped onto the stack tray 128 more slowly. In such a case, when the buffer sheets are fed to the processing tray 129 by the reverse rotation of the rocking roller pair 127, the sheet stack may enter into the rocking roller pair 127 while being closely contacted with the buffer sheet, thereby causing damage of the sheet stack or sheet jam. Accordingly, also in order to improve a separating ability between the sheet stack and the buffer sheet, the sheet stack is protruded by the length L with respect to the buffer roller.

In addition, in the sheet processing apparatus 119 according to the illustrated embodiment, the trailing end of the sheet stack is pushed by the trailing end assist 134. When the trailing end assist 134 pushes the trailing end of the sheet stack to convey the sheet stack, unlike to the case where the sheet stack is discharged while urging the rotating rollers against the surfaces of the sheet stack, the surfaces of the sheet stack are not damaged and the sheet stack can be conveyed positively.

Figure 30:
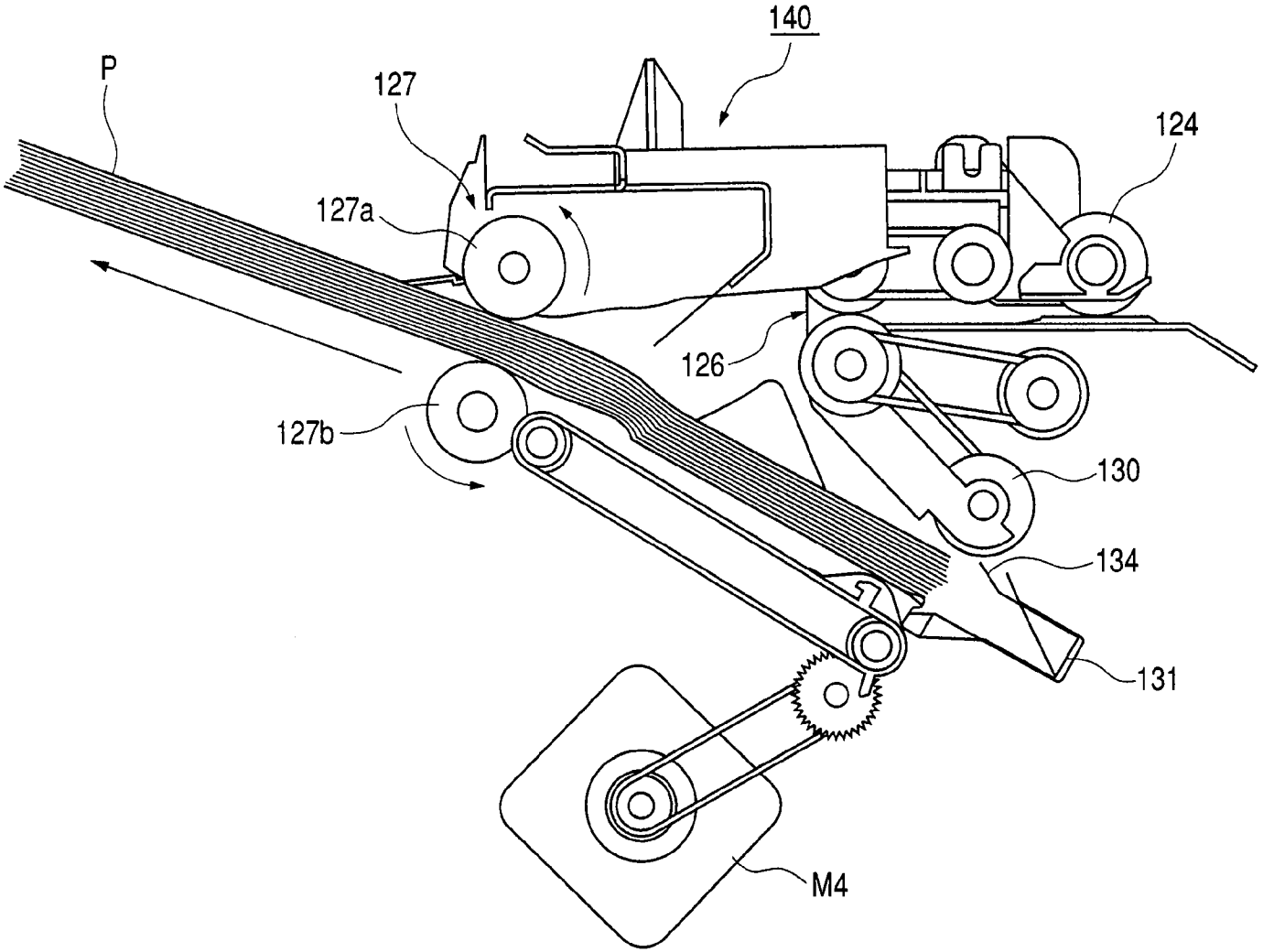
FIG. 30 is a view for explaining a problem caused in a case where the sheet stack is discharged only by a rocking roller.

That is to say, as shown in FIG. 30, if the sheet stack is discharged by the rocking roller pair 127 alone, due to a difference in friction between the upper roller 127*a* and the lower roller 127*b* with respect to the sheet and a difference in a rotational speed between these rollers, sheet conveying amounts attained by these rollers may differ from each other, with the result that deviation may occur between the uppermost sheet and the lowermost sheet. In such a case, the rocking roller pair 127 may be slidingly rotated with respect to the sheet, thereby damaging the sheet. Further, the entire sheet stack may be discharged while being twisted, with the result that the sheet stack may not be discharged smoothly and the processing time may be increased. Further, if the entire sheet stack is twisted, any sheet or sheets may be torn at the stapled area or areas, thereby spoiling the sheet stack.

Further, such a phenomenon is apt to occur in a case where the pinching force of the rocking roller pair 127 with respect to the sheet stack is increased to discharge the sheet stack more positively. Conversely, if the pinching force is decreased, the sheet stack cannot be positively conveyed. Accordingly, it is difficult to set the pinching force of the rocking roller pair 127.

In consideration of the above circumstances, in the sheet processing apparatus according to the illustrated embodiment, since the sheet stack is discharged not only by the rocking roller pair 127 but also by the trailing end assist 134, there are no sliding rotation with respect to the sheet and no twist of the sheet stack as mentioned above, with the result that the sheet and the sheet stack are not damaged and the sheet stack can be discharged smoothly and quickly. Further, the sheet stack can be discharged without managing the pinching force of the rocking roller pair 127 strictly.

Next, an operation of the sheet processing apparatus 119 will be explained in a case where sheet is jammed at an upstream side of the sheet processing apparatus 119 will be explained.

Figure 31:
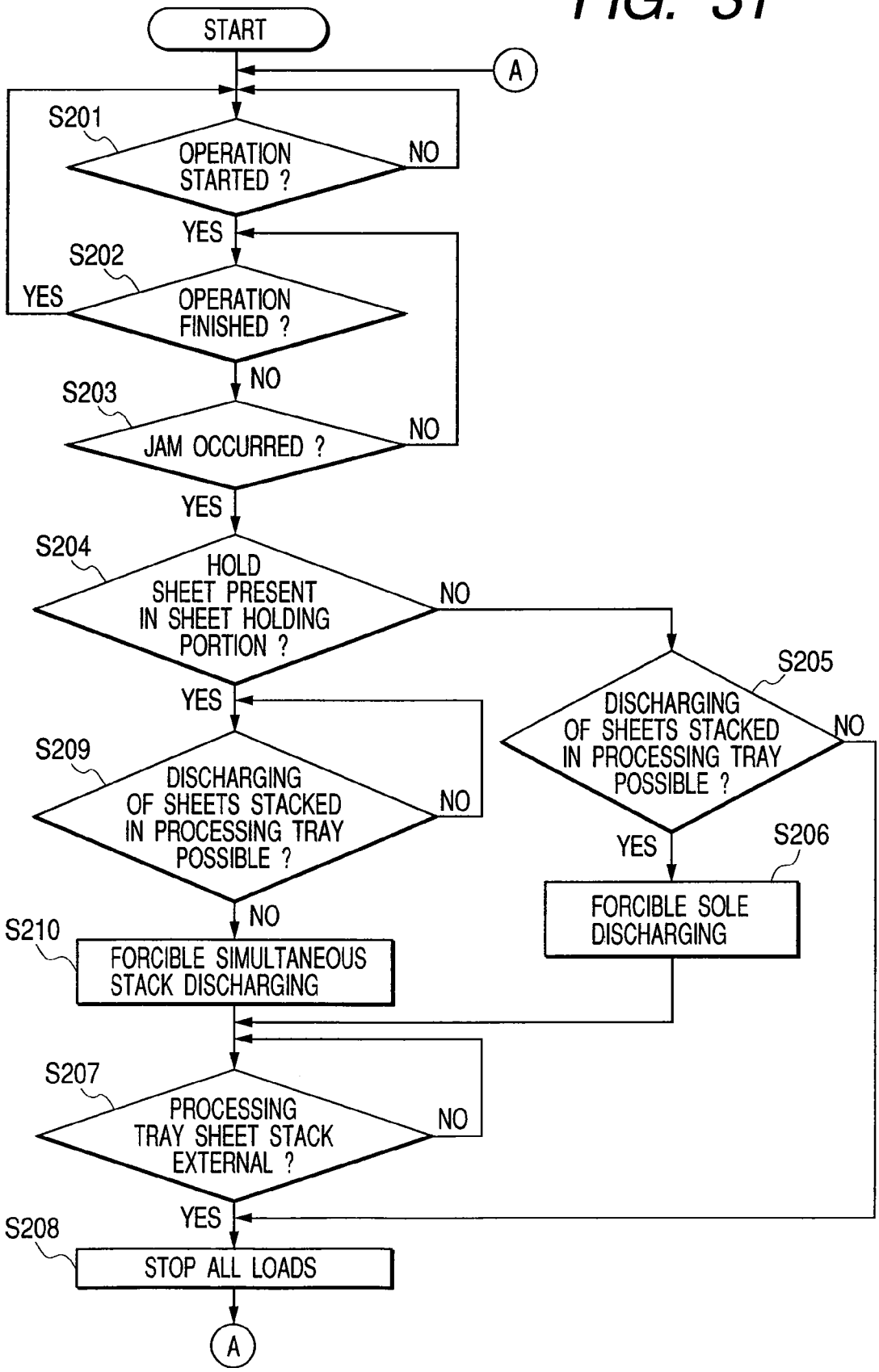
FIG. 31 is a flow chart for explaining an operation if sheet jam occurs at an upstream side of the sheet processing apparatus.

If sheet jam occurs (step S203 in a flow chart of FIG. 31) at an upstream side of the buffer unit 140, i.e., at an upstream side of the inlet roller pair 121 after the copying operation of the copier 100 (FIG. 1) is started (step S201) and before the copying operation is finished (step S202), the CPU circuit portion 200 (refer to FIGS. 2 and 8) of the main body 101 of the copier sends a jam generating signal to the CPU 221 of the finisher controlling portion 211 and stops the rotations of the sheet conveying rollers within the main body 101.

Further, if the jam occurs in the receiving roller pair 137, the CPU 221 stops the rotation of the receiving roller pair 137 and sends a jam generating signal to the CPU circuit portion 200. The CPU circuit portion 200 which received the jam generating signal stops the rotations of the sheet conveying rollers within the main body 101, thereby preventing the sheet from being sent in the sheet processing apparatus 119.

Thereafter, the CPU 221 judges whether or not the hold sheet (buffer sheet) is stacked on the guide 123 (refer to FIG. 4) as the sheet holding portion, on the basis of the detecting operation of the inlet path sensor S1 (step S204). If the inlet path sensor S1 does not detect the holding sheet, the CPU 221 judges that the hold sheet is not stored in the guide 123 and judges whether the sheet stack stacked on the processing tray 129 can be discharged or not (step S205). If it is judged that the number of sheets can be stapled, the program of the CPU is shifted to control for stapling the sheet stack by the stapler unit 132 and for forcibly discharging the sheet stack solely (step S206). On the other hand, if it is judged that the number of sheets cannot be stapled (step S205), the sheet stack is left as it is on the processing tray 129.

The CPU 221 discharges the sheet stack onto the stack tray by the operations shown in FIGS. 17A to 19 (step S207). Thereafter, the CPU 221 stops the operation of the entire sheet processing apparatus 119 (step S208).

In the step S204, when the sheet is detected by the inlet sensor S1, the CPU 221 judges that the hold sheets are stored on the guide 123 and then judges whether the sheet stacked on the processing tray 129 can be discharged or not (step S209). Since the fact that there is the hold sheet on the guide 123 means that a number of sheets which can be discharged are stacked on the processing tray 129, the program of the CPU 221 is shifted to control for stapling the sheet stack by the stapler unit 132 and for forcibly discharging the sheet stack on the processing tray 129 and the hold sheet simultaneously (step S210).

The CPU 221 discharges the sheet stack onto the stack tray 128 by the operations shown in FIGS. 25A to 28B and discharges the hold sheets in the guide 123 onto the processing tray 129 (step S207). Thereafter, the CPU 221 stops the operation of the entire sheet processing apparatus 119 (step S208).

Figure 32:
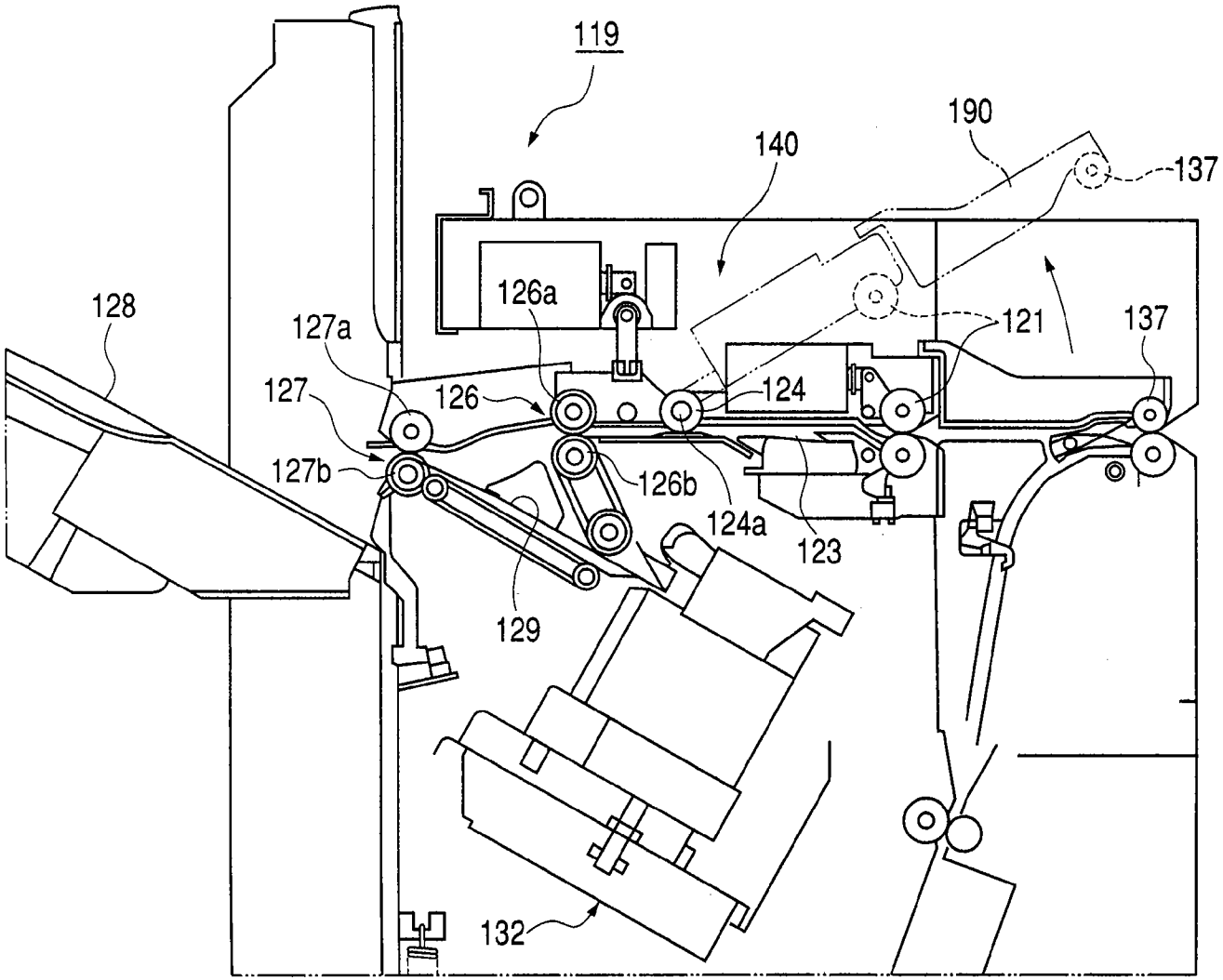
FIG. 32 is a view showing a condition that a receiving roller pair and an inlet roller pair are spaced apart from each other.

The sheet jammed in the receiving roller pair 137 can easily be removed by separating upper rollers of the receiving roller pair 137 and the inlet roller pair 121 from lower rollers thereof to release the guide 123 as shown in FIG. 32. Further, even if the sheet is jammed at a downstream side of the receiving roller pair 137, the jammed sheet can be removed by separating the upper first sheet discharging roller 126*a* and the upper roller 127*a* from the lower first sheet discharging roller 127*b* and the lower roller 127*b*. The upper rollers of the receiving roller pair 137 and of the inlet roller pair 121 are provided on a bracket 190 rotatable around a shaft 124*a* of the buffer roller 124.

As such, in the sheet processing apparatus 119 according to the illustrated embodiment, if the sheet jam occurs at the upstream side of the sheet processing apparatus 119, since the sheets on the processing tray 129 are forcibly discharged onto the stack tray 128 and the sheets held in the buffer unit 140 are forcibly discharged onto the processing tray 129, the stapled sheet stack can be obtained by the operator quickly regardless of occurrence of the sheet jam, thereby enhancing the processing efficiency and operator's operability.

Further, since the sheets held in the buffer unit 140 are forcibly discharged onto the processing tray 129, jam treatment can be facilitated, thereby enhancing a jam treating ability.

In addition, since the sheets held in the buffer unit 140 are forcibly discharged onto the processing tray 129, only sheets for jam recovery can be held within the sheet processing apparatus, with the result that a recovery starting sheet can easily be recognized.

Further, if the sheet stack is left on the processing tray 129 as it is for a long term without finding the sheet jam, for example, the externally protruded portion shown in FIGS. 20A and 20B may be flexed downwardly by its own weight, thereby deforming the sheet stack. However, in the sheet processing apparatus 119 according to the illustrated embodiment, if the jam occurs, since the sheet stack is forcibly discharged, deformation of the sheet stack can be prevented.

Next, an operation of the sheet processing apparatus will be explained with reference to flow charts shown in FIGS. 33 to 40 in a case where the distance between succeeding sheets fed into the sheet processing apparatus 119 is increased in comparison with the previous sheet-to-sheet distance, for example, in a case where the sheet processing apparatus 119 is mounted to a main body of a color copier in which the sheet-to-sheet distance is increased as a result of color image quality adjustment. Incidentally, in the flow charts, a case where two sheets are buffered will be explained.

Figure 33:
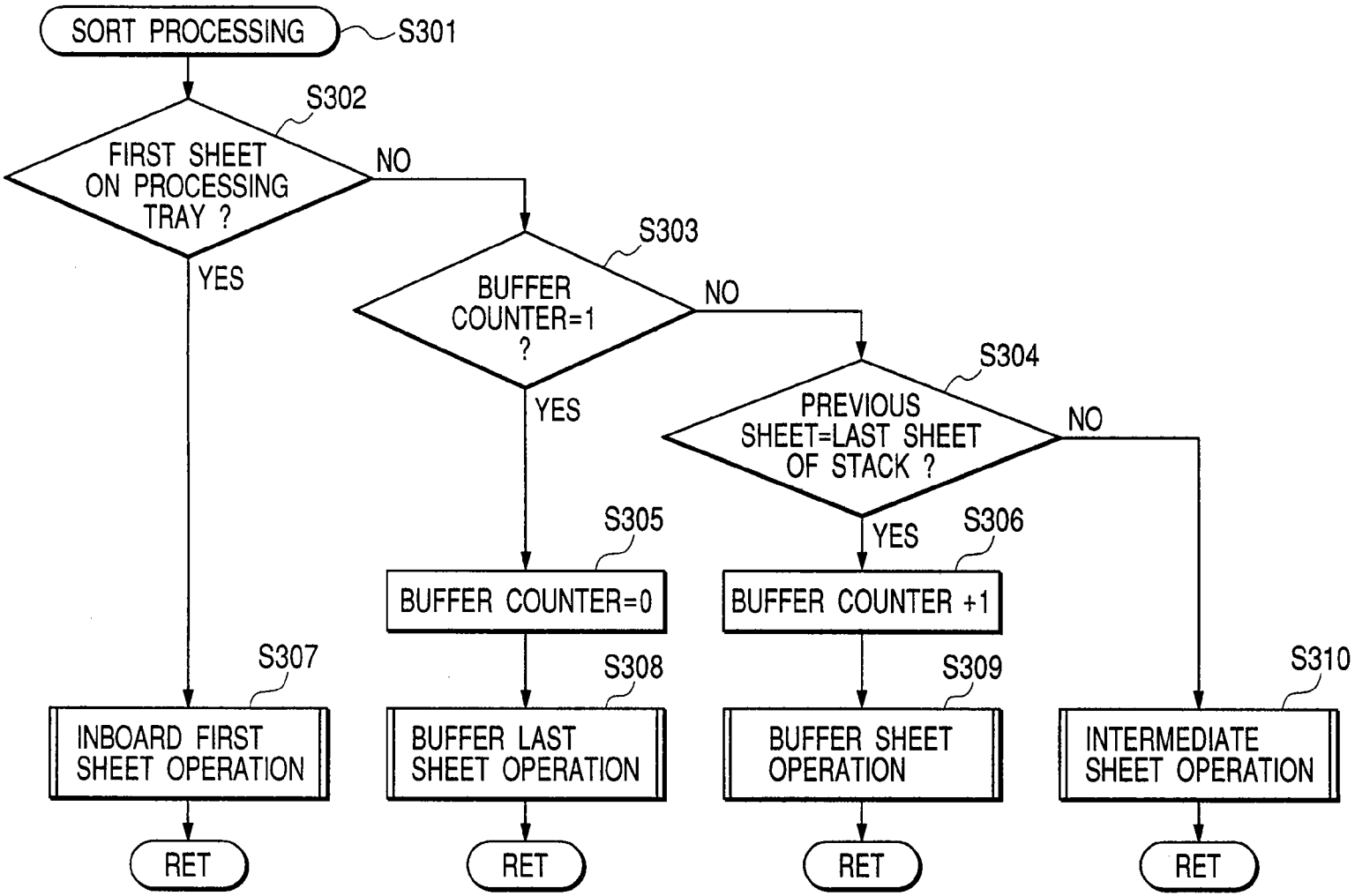
FIG. 33 is a flow chart showing sorting processing.

FIG. 33 is a flow chart for explaining a schematic operation of the entire sheet processing apparatus 119 and is a flow chart for sorting processing. Operations of various parts shown in the flow chart are performed by the finisher controlling portion 211 shown in FIG. 8.

In the sorting processing (step S301), the sheet processing apparatus 119 performs one of operations among an inboard first sheet operation (step S307), a buffer last sheet operation (step S308), a buffer sheet operation (step S309) and an intermediate sheet operation (step S310) on the basis of judgments whether the sheet to be stacked on the processing tray 129 is a first sheet or not (step S302), whether a value of a buffer counter is 1 or not (step S303) and whether a previous sheet is a last sheet for the sheet stack or not (step S304).

Figure 34A:
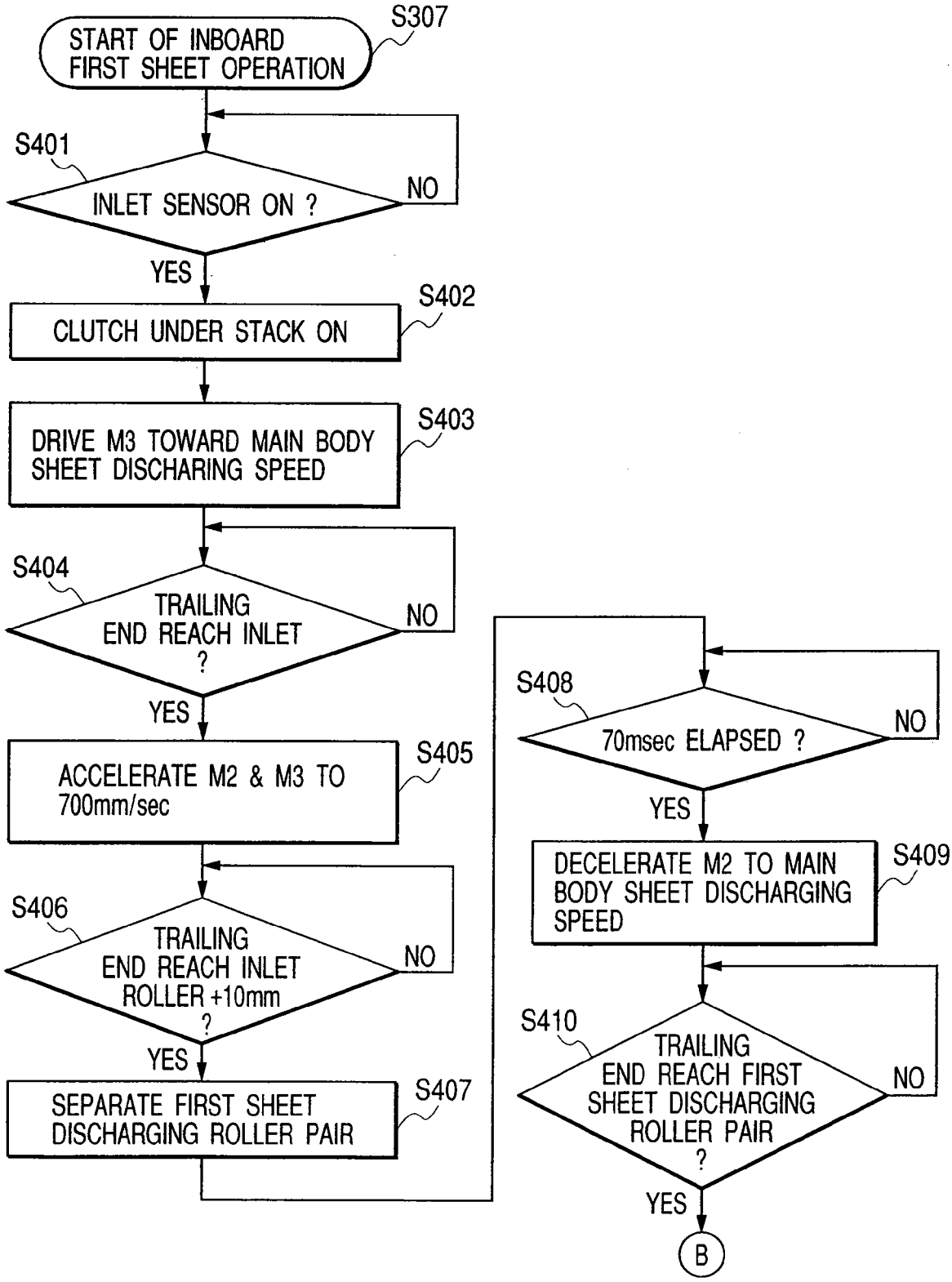
FIGS. 34A and 34B are flow charts for explaining an operation of a first sheet within the apparatus.
Figure 34B:
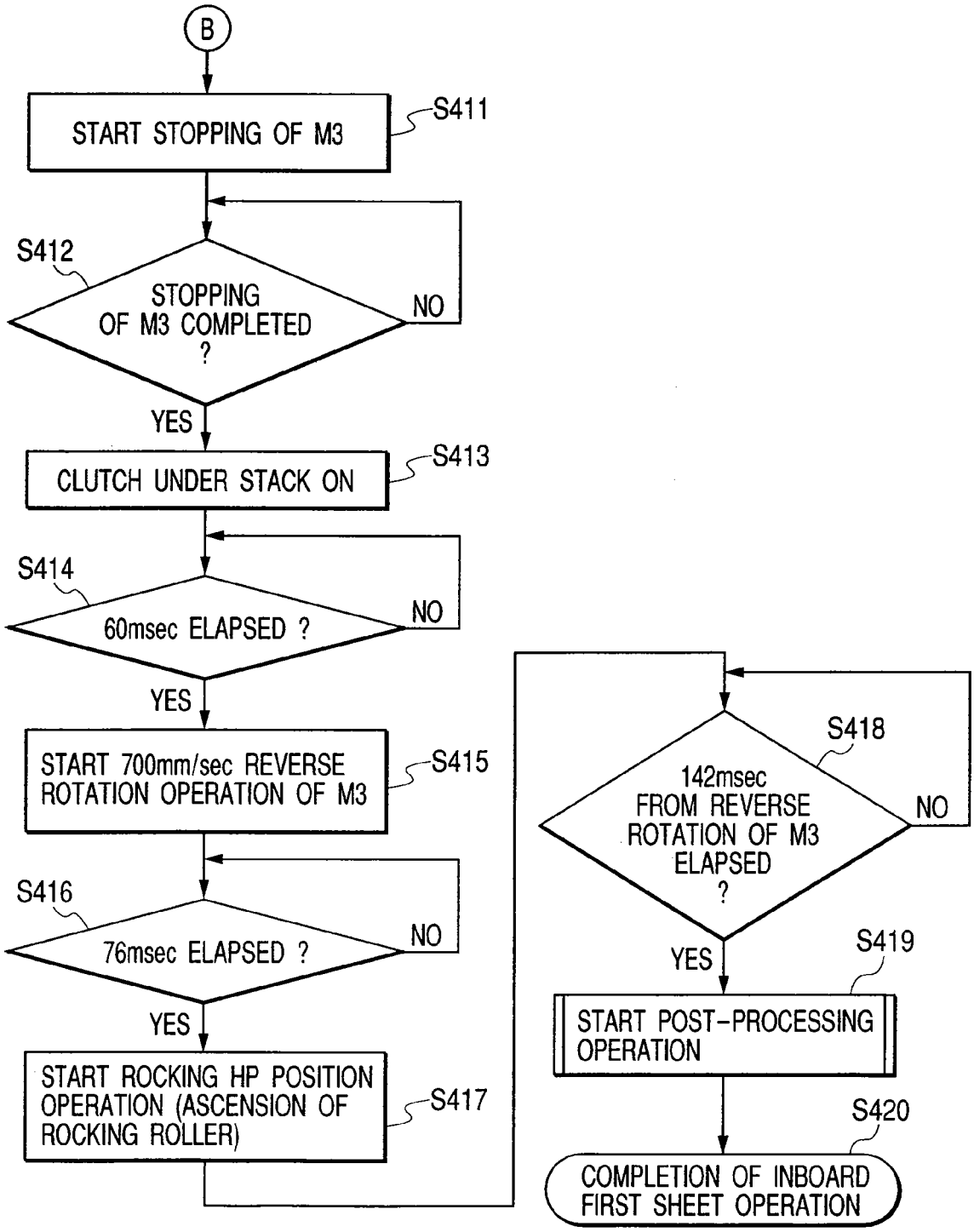

The inboard first sheet operation (step S307) in FIG. 33 is an actions performed from when the first sheet is stacked on the processing tray 129 to when the sheet processing is started, as shown by steps S401 to S420 in FIGS. 34A and 34B.

Figure 35A:
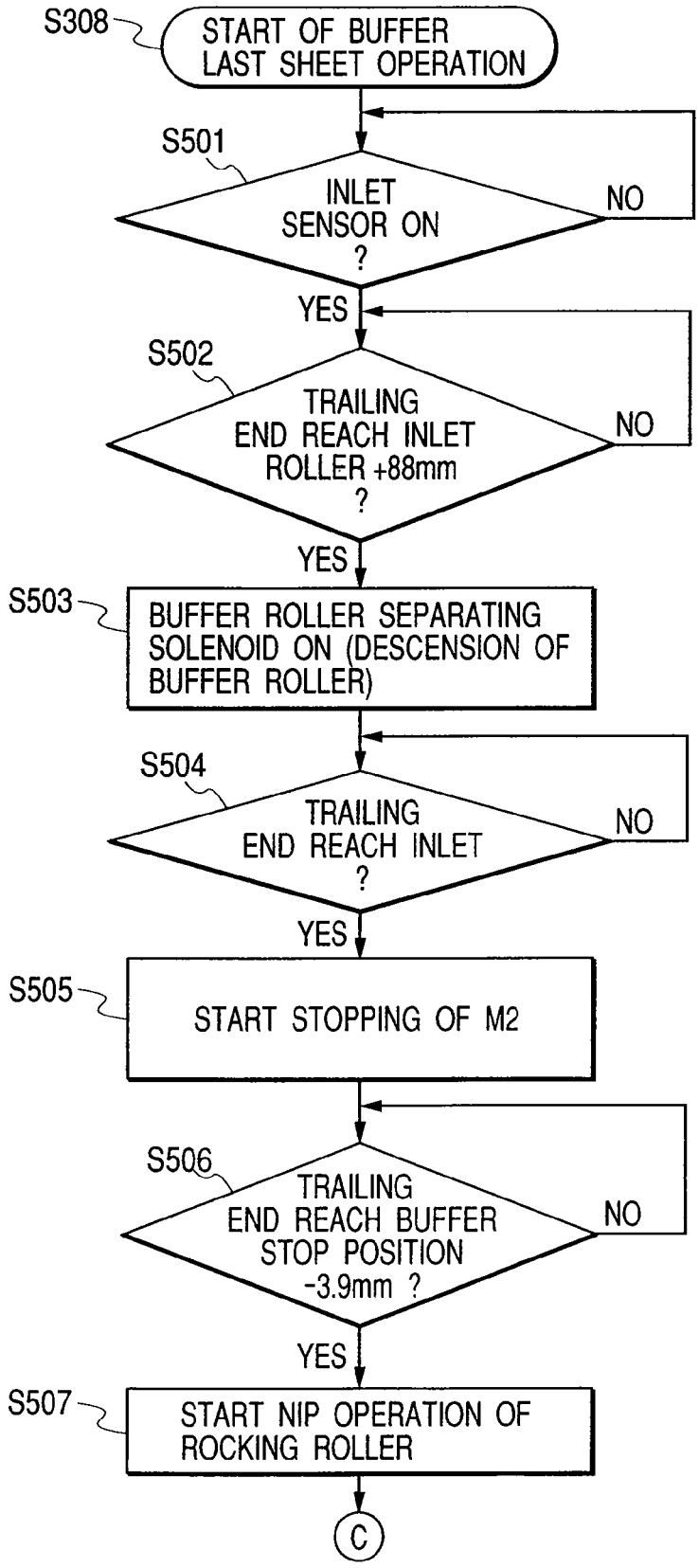
FIGS. 35A and 35B are flow charts for explaining an operation of a buffer last sheet.
Figure 35B:
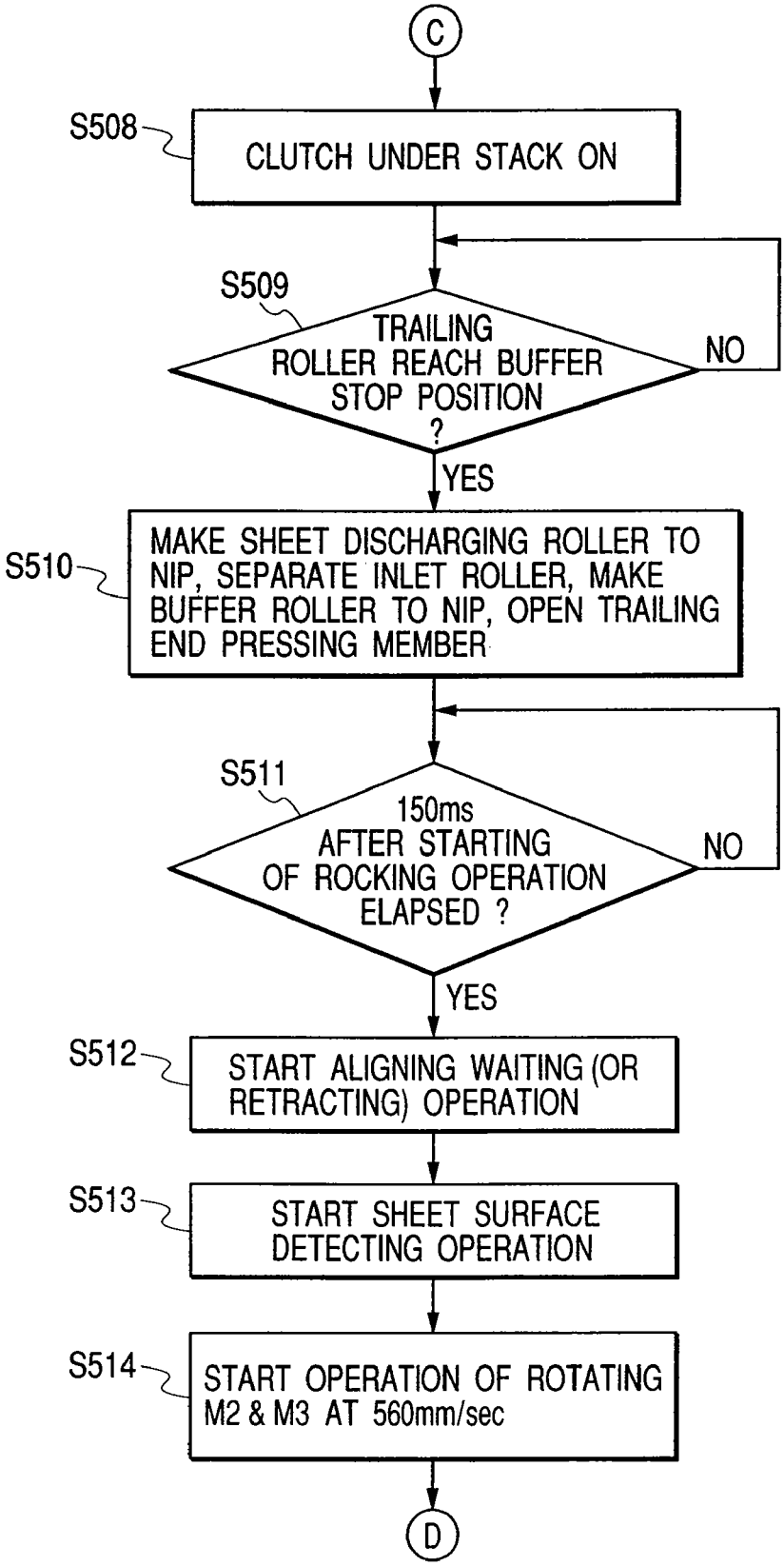
Figure 36A:
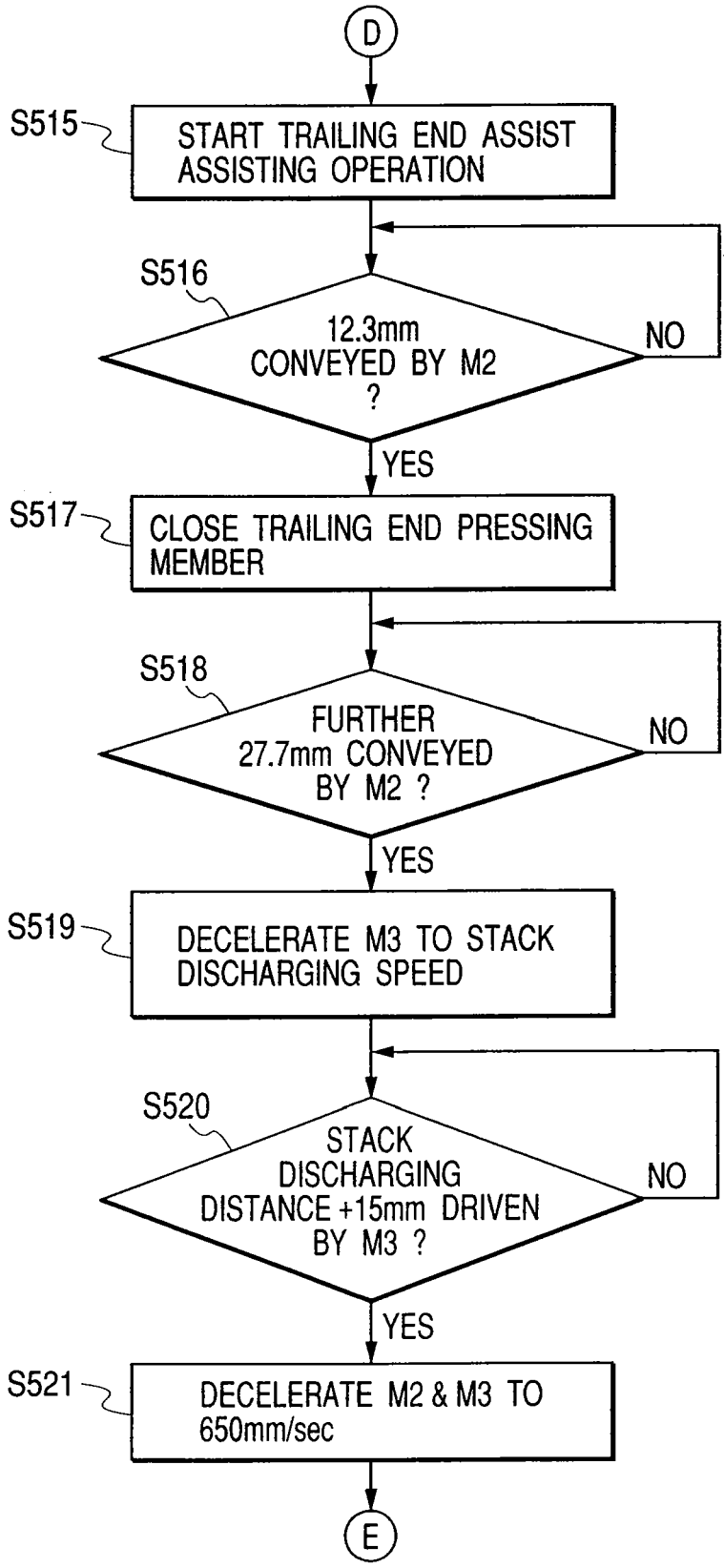
FIGS. 36A, 36B and 36C are flow charts following to FIG. 35.
Figure 36B:
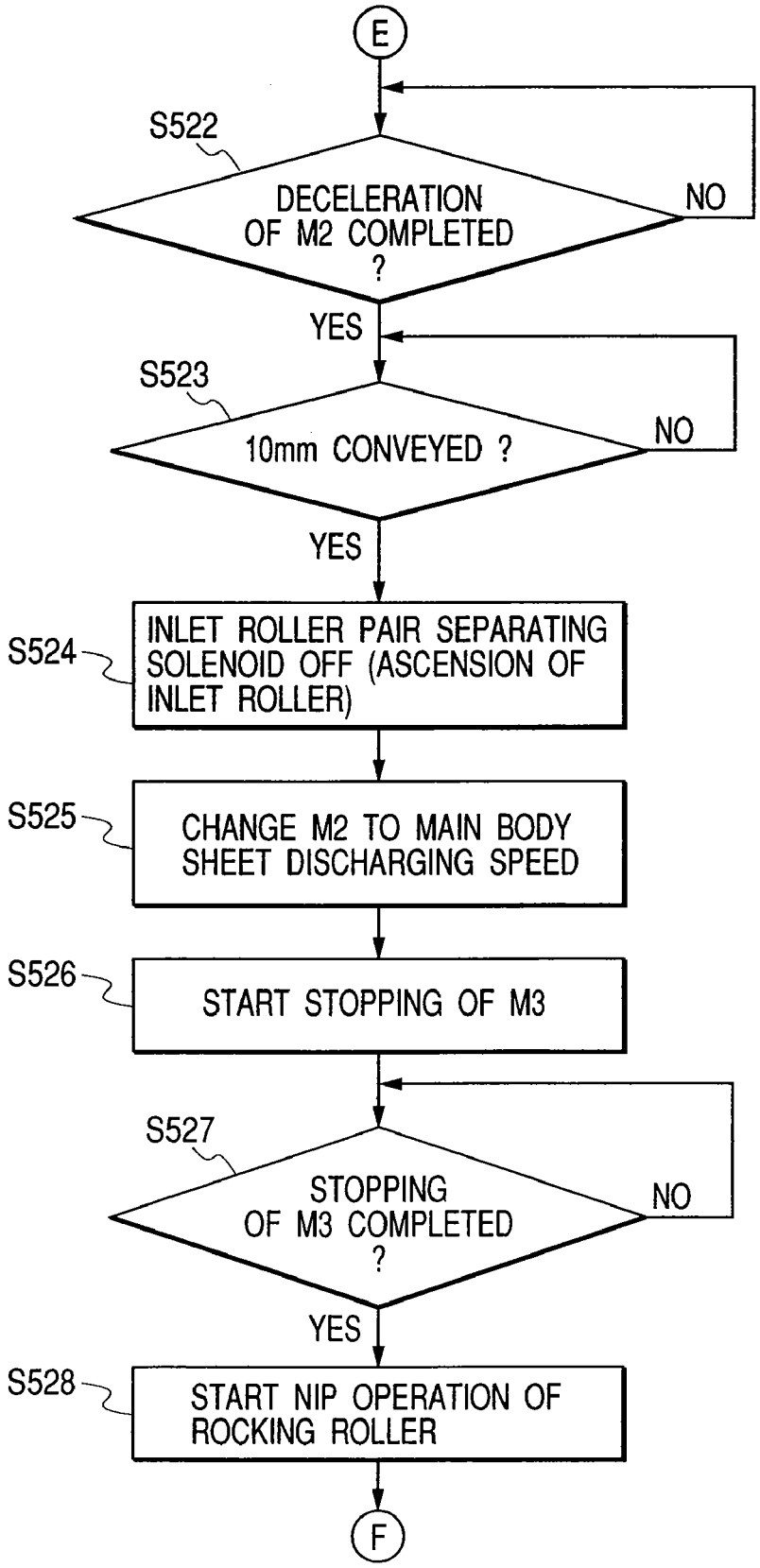
Figure 36C:
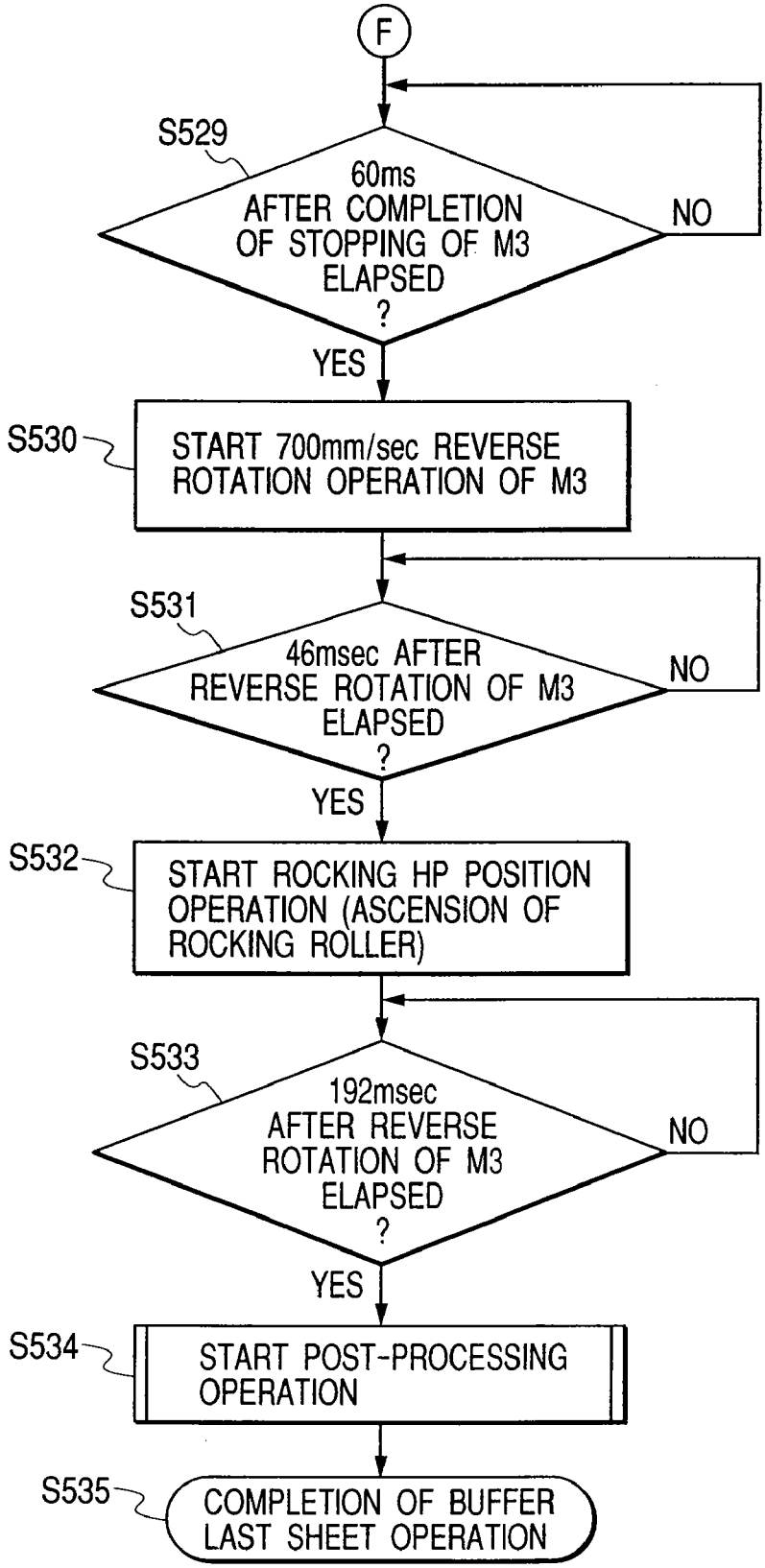

The buffer last sheet operation (step S308) in FIG. 33 is actions performed from when the buffer sheet is stacked on the processing tray 129 to when the post-processing operation is started, as shown by a step S501 in FIG. 35A to a step S535 in FIG. 36C.

Figure 37A:
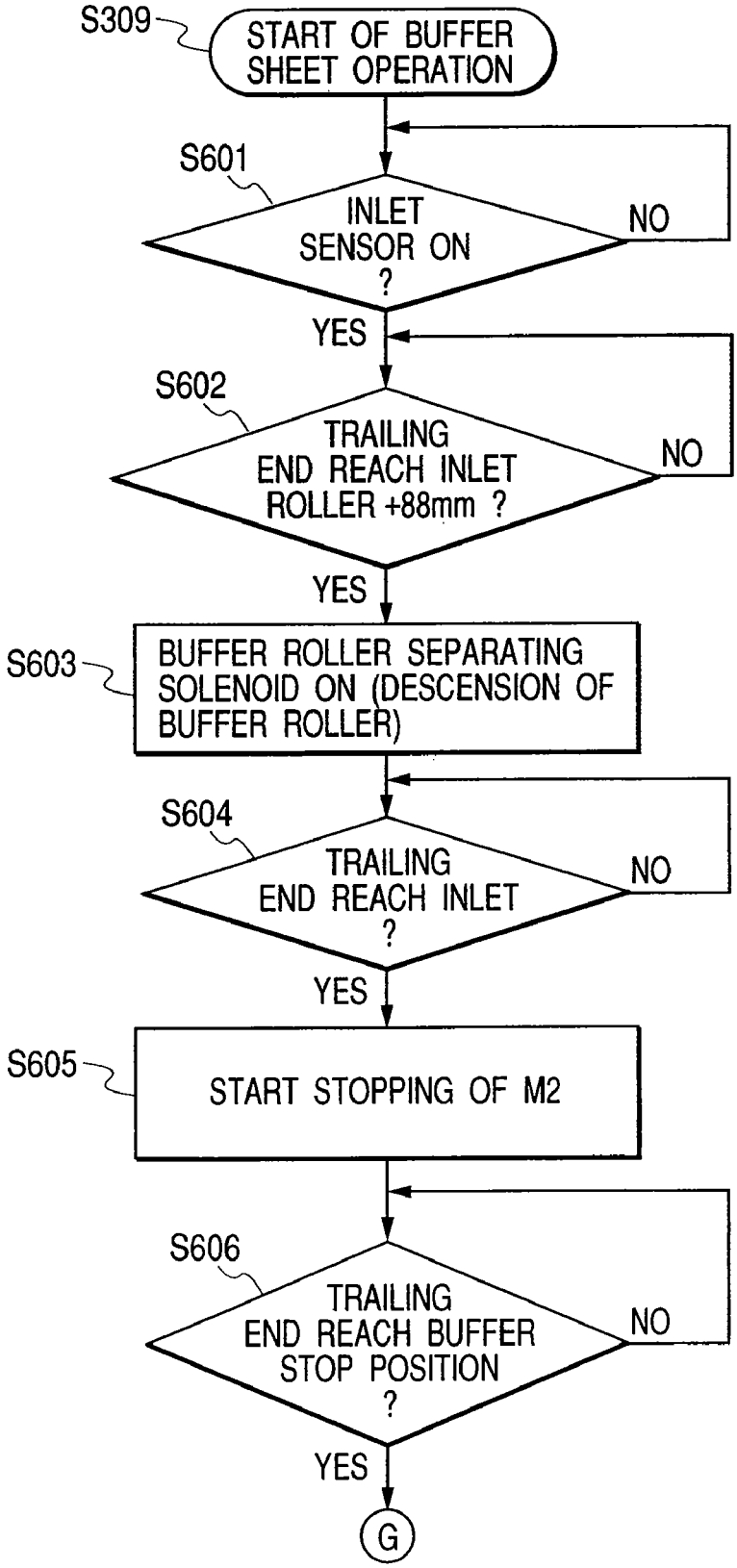
FIGS. 37A and 37B are flow charts for explaining a buffer operation.
Figure 37B:
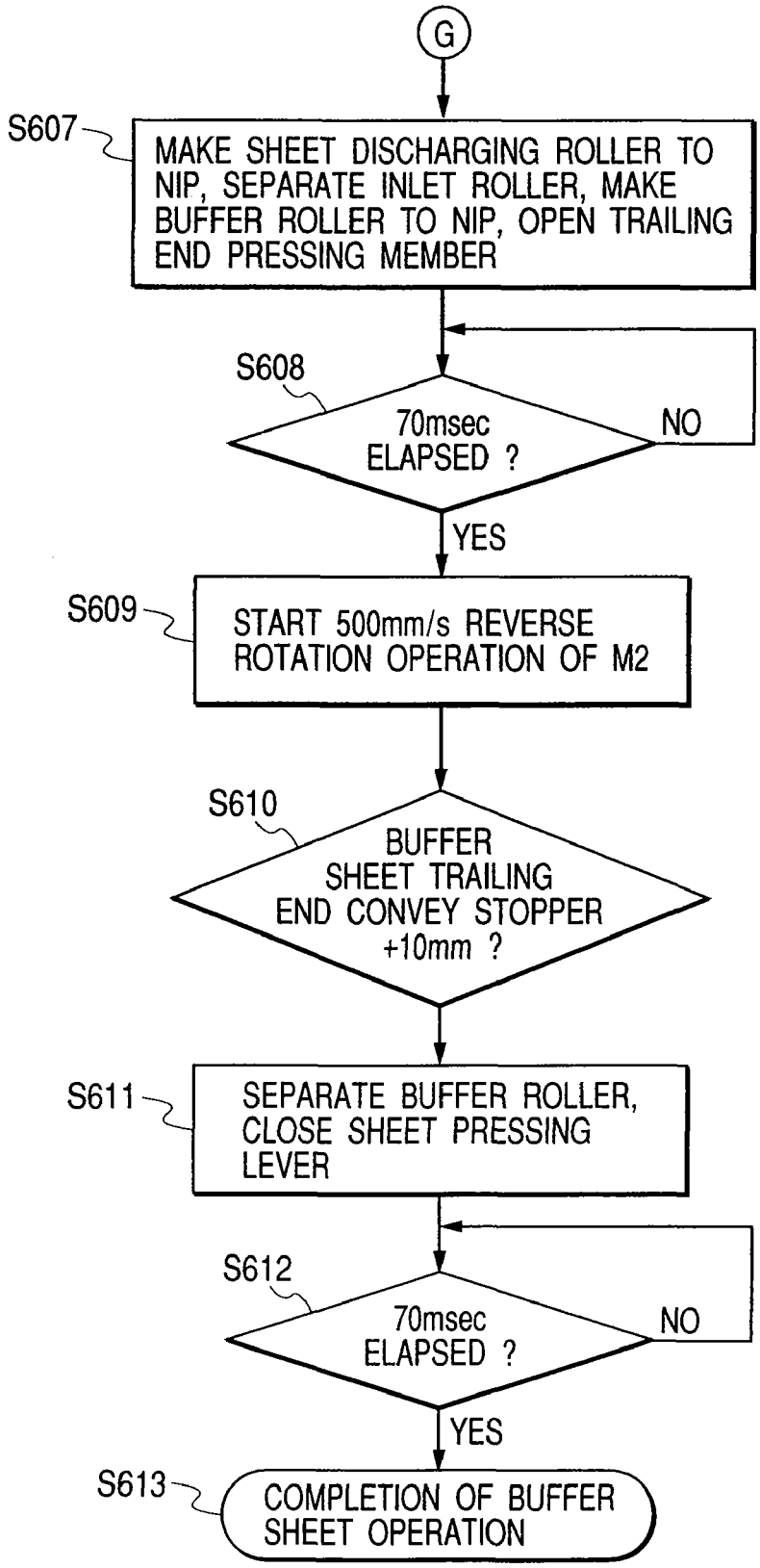

The buffer sheet operation (step S309) in FIG. 33 is actions for storing (buffering) the buffer sheets on the guide 123, as shown by steps S601 to S613 in FIGS. 37A and 37B.

Figure 38A:
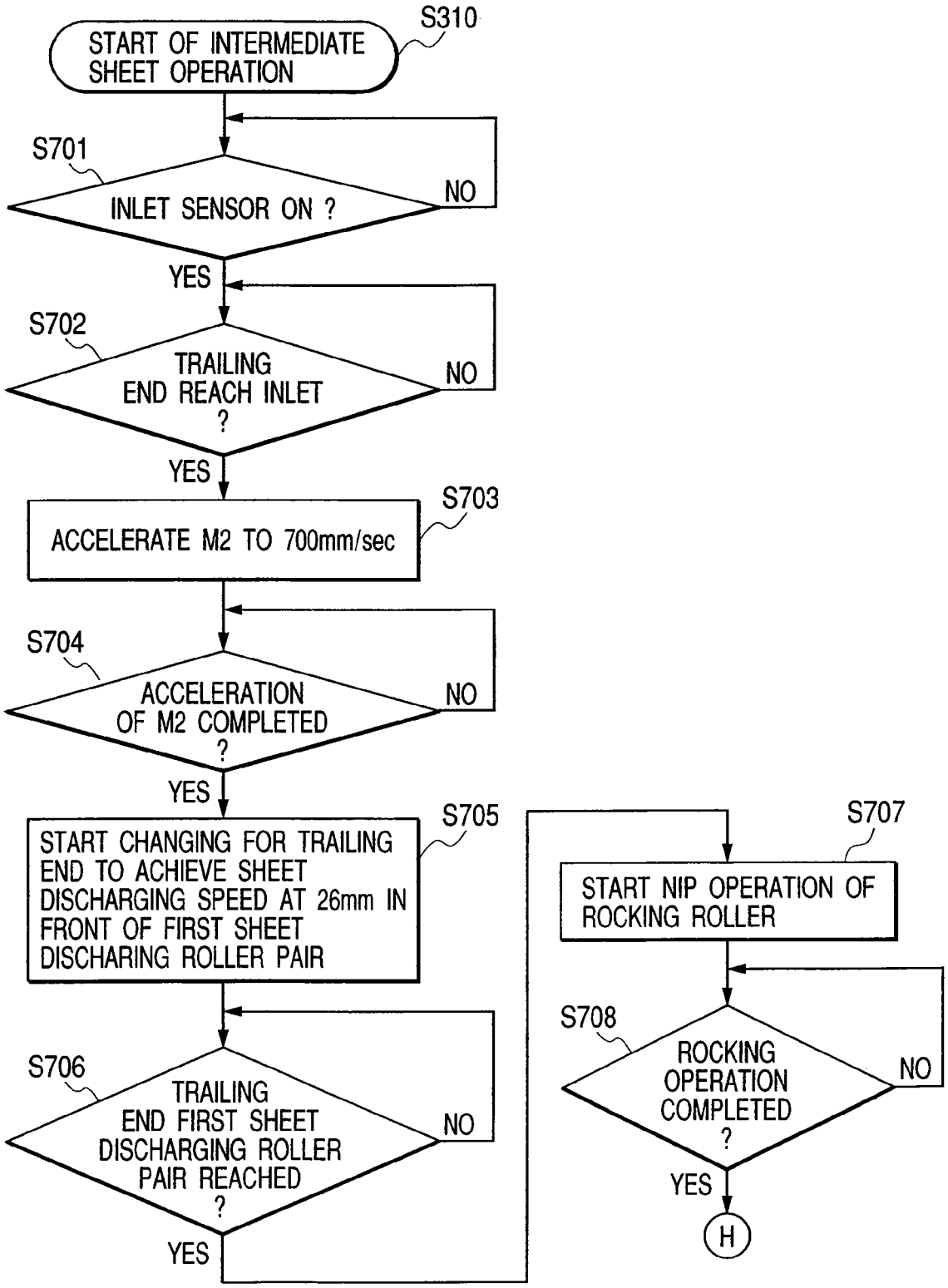
FIGS. 38A and 38B are flow charts for explaining an intermediate operation.
Figure 38B:
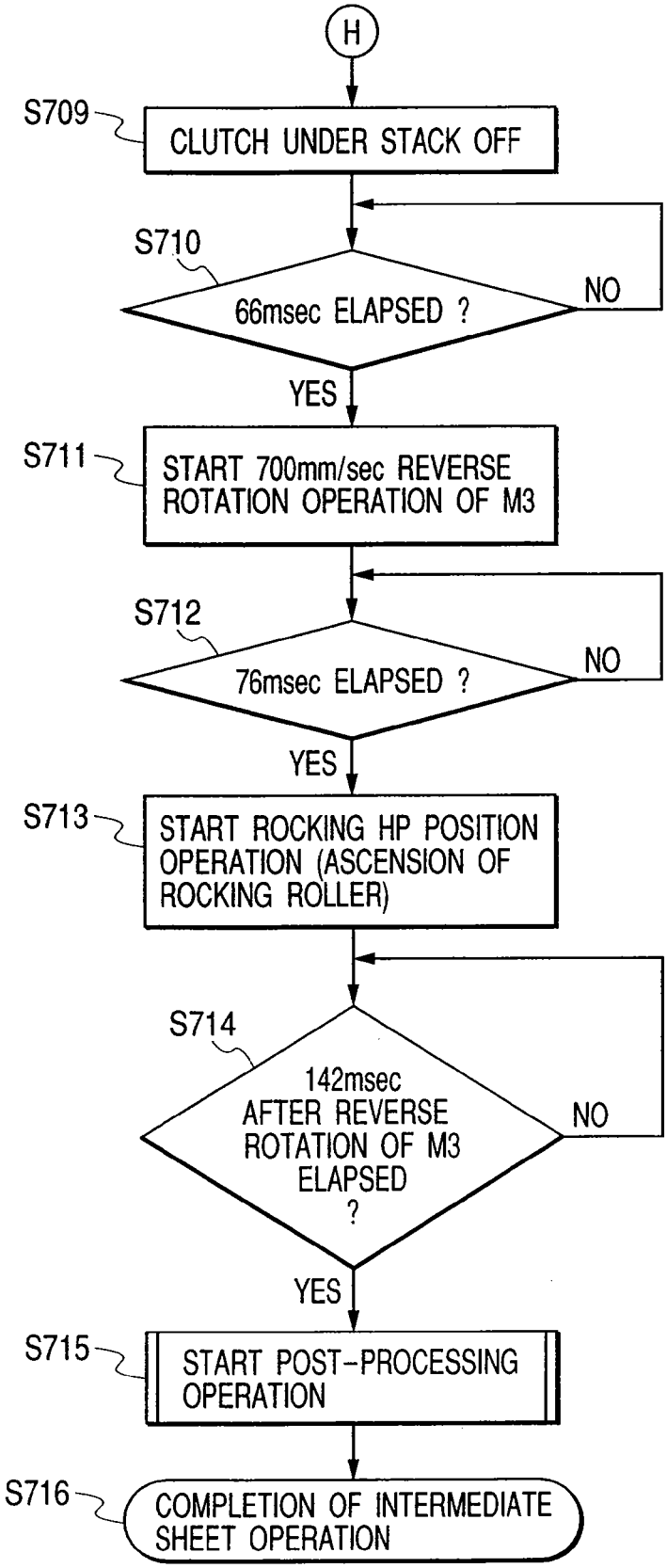

The intermediate sheet operation (S310) in FIG. 33 is actions performed from when the second sheet and so on are stacked on the processing tray 129 to when the sheet processing is started, as shown by steps S701 to S716 in FIGS. 38A and 38B.

Figure 39:
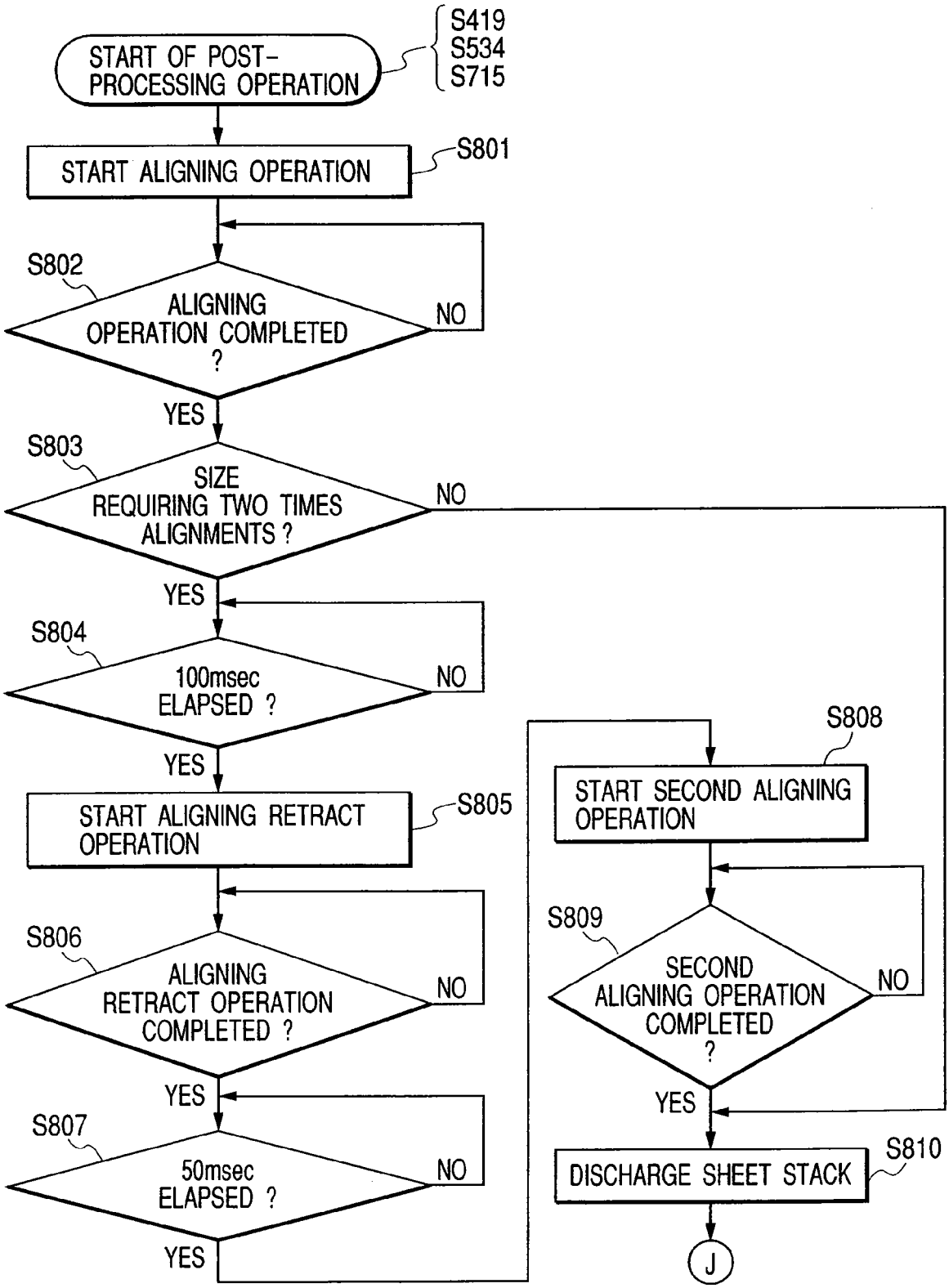
FIG. 39 is a flow chart for explaining a post-processing operation.

A start post-processing in a step S419 of FIG. 34B, a step S534 of FIG. 36C and a step S715 of FIG. 38B is an operation for performing the post-operation after the sheet discharged from the main body 101 of the copier 100 is stacked on the processing tray 129, as shown by steps S810 to S824 in FIG. 39.

First of all, the CPU 221 (refer to FIG. 8) controls a front aligning motor M5 and a rear aligning motor M6 to approach, to the sheet, front and rear aligning plates 144*a* and 144*b* (refer to FIG. 5) which disposed on both sides along the sheet conveying direction and which can be moved toward and away in a direction transverse to the sheet conveying direction, thereby aligning front and rear edges of the sheet (steps S801 and S802). If a large size sheet such as a B4 size sheet which must be aligned by two times is used (step S803), after 100 msec is elapsed (step S804), the front aligning plate 144*a* and the rear aligning plate 144*b* are once separated from the sheet and are retracted (or waiting) (steps S805 and S806). Then, after 50 msec is elapsed (step S807), the front aligning plate 144*a* and the rear aligning plate 144*b* (refer to FIG. 5) are approached to the sheet again to perform a second aligning operation (step S808). After a series of aligning operations are finished (step S809), the CPU 221 control the stack discharging motor M3 to stop the reverse rotation of the rocking roller pair 127 (step S810).

Figure 40:
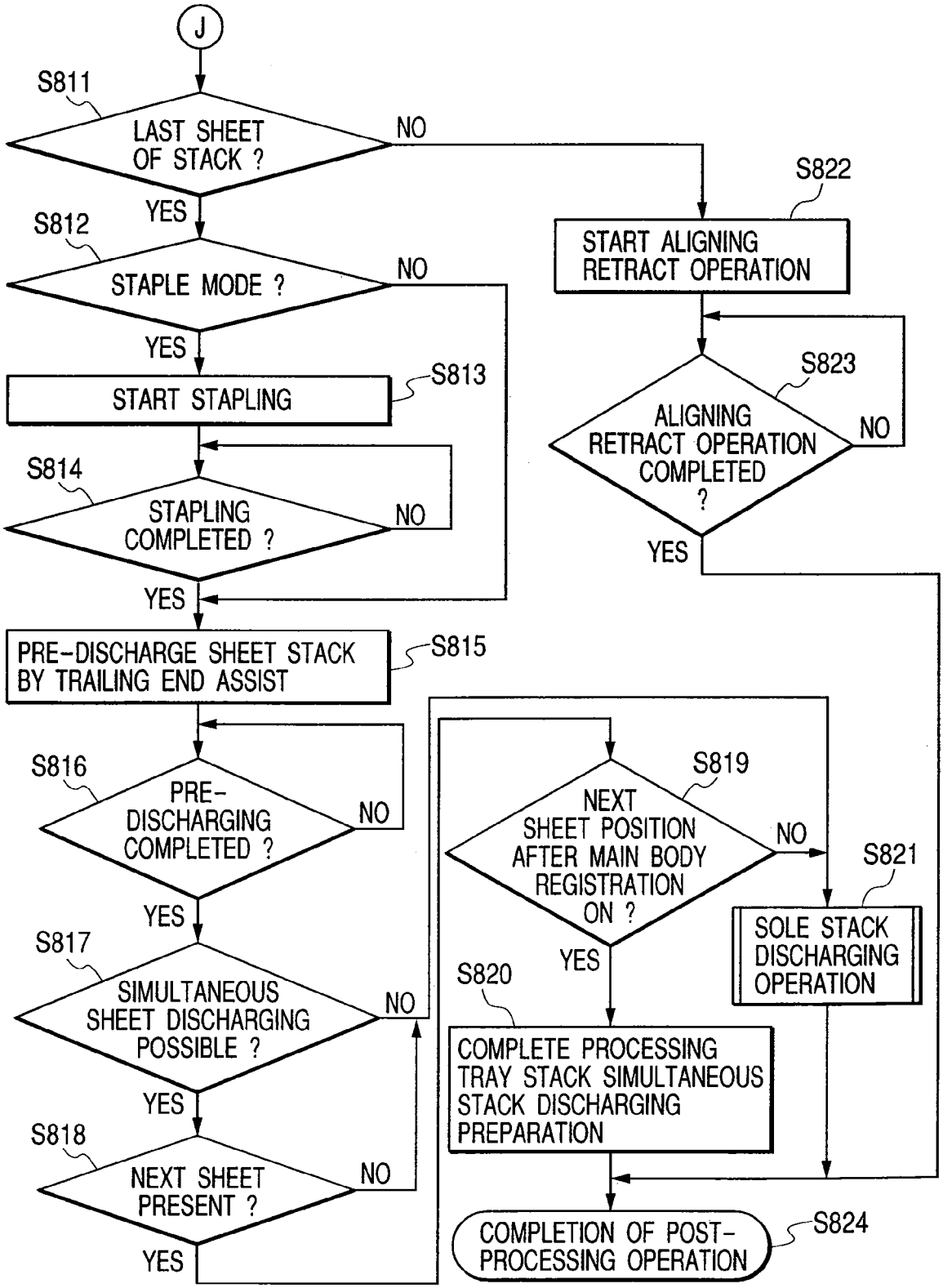
FIG. 40 is a flow chart following to FIG. 39.

Thereafter, the CPU 221 judges whether a fed sheet is the last sheet of the sheet stack or not on the basis of last sheet information regarding the sheet stack from the CPU circuit portion 200 of the main body 101 or the sheet number from the counter for counting the sheet number (step S811 in FIG. 40). If the sheet is not the last sheet, the CPU 221 controls the front aligning motor M5 and the rear aligning motor M6 (refer to FIG. 8) to return the front aligning plate 144*a* and the rear aligning plate 144*b* (refer to FIG. 5) to the retraction (or waiting) position (steps S822 and S823).

In a step S811, if the sheet is the last sheet, when the sheet stack is stapled by the stapler unit 132 (step S812), the CPU 221 controls a stapler shift motor M8 to shift the stapler 166 to a stapling position (position where the sheet stack is stapled) and controls a stapler motor M9 to staple the sheet stack by means of the stapler 166 (steps S813 and S814). Thereafter, the CPU 221 controls the trailing end assist motor M4 (refer to FIGS. 5 to 8) to protrude (pre-protrude) more than the stored sheets by the length L by means of the trailing end assist 134 as shown in FIGS. 26A and 26B (steps S815 and S816).

Thereafter, when the CPU 221 judges that the stapled sheet stack cannot be discharged simultaneously (the sheet stack is not a sheet stack not subjected to simultaneous stack discharging) on the basis of the sheet property information such as a sheet size, a sheet material (paper quality), a thick sheet, a thin sheet, a tab sheet, a color sheet and the like or when the sheet next to the stapled sheet stack cannot be buffered (step S817), the CPU controls the stack discharging motor M3 to discharge only the stapled sheet stack from the processing tray 129 onto the stack tray 128 (sole stack discharging) and the post-processing operation is completed (steps S822, S823 and S824).

Also, if the next sheet is jammed and is not sent to the buffer unit 140, the CPU 221 controls the stack discharging motor M3 to discharge only the stapled sheet stack from the processing tray 129 onto the stack tray 128 (sole stack discharging) and the post-processing operation is completed (steps S818, S821 and S824).

By doing so, in the sheet processing apparatus, since the stapled sheet stack can be discharged onto the stack tray 128 without storing the sheet stack on the processing tray 129 unnecessarily for a long term, the processing efficiency of the sheet processing apparatus 119 can be enhanced, with the result that the sheet stack can be presented by the operator quickly.

Further, since the stapled sheet stack is not left as it is on the processing tray 129 for a long term, for example, the externally protruded portion shown in FIGS. 20A and 20B is not flexed downwardly by its own weight, thereby preventing the deformation of the sheet stack.

Even when the succeeding sheet can be sent to the buffer unit 140, due to the slip of the feeding rollers within the main body 101 of the apparatus and/or image adjustment, if the succeeding sheet is delayed so that the sheet stack on the processing tray 129 becomes possible to be discharged onto the stack stray 128 before the succeeding sheet reaches the buffer unit 140, for example, at the upstream side of the registration roller pair 150 shown in FIG. 1, the CPU 221 controls the stack discharging motor M3 to discharge only the stapled sheet stack from the processing tray 129 onto the stack tray 128 (sole stack discharging) and the post-processing operation is completed (steps S819, S821 and S824).

By dosing so, in the sheet processing apparatus, since the stapled sheet stack can be discharged onto the stack tray 128 without storing the sheet stack on the processing tray 129 unnecessarily for a long term, the processing efficiency of the sheet processing apparatus 119 can be enhanced, with the result that the sheet stack can be presented by the operator quickly.

Further, since the stapled sheet stack is not left as it is on the processing tray 129 for a long term, for example, the externally protruded portion shown in FIGS. 20A and 20B is not flexed downwardly by its own weight, thereby preventing the deformation of the sheet stack.

If both the sheets on the processing tray 129 and the sheets stored on the guide 123 do not satisfy the condition in the steps S818 and S819, the CPU 221 controls the inlet conveying motor M2, stack discharging motor M3 and clutch CL under stack thereby to discharge the sheet stack on the processing tray 129 onto the stack tray 128 and at the same time to discharge the stored sheets from the guide 123 onto the processing tray 129. That is to say, the simultaneous stack discharging is performed (steps S820 and S824).

The sole stack discharging operation (step S821) in FIG. 40 is actions for discharging only the stapled sheet stack stacked on the processing tray 129 without discharging the stapled sheet stack simultaneously with the buffer sheets, as shown in the steps S101 to S112 of FIG. 9.

Figure 41:
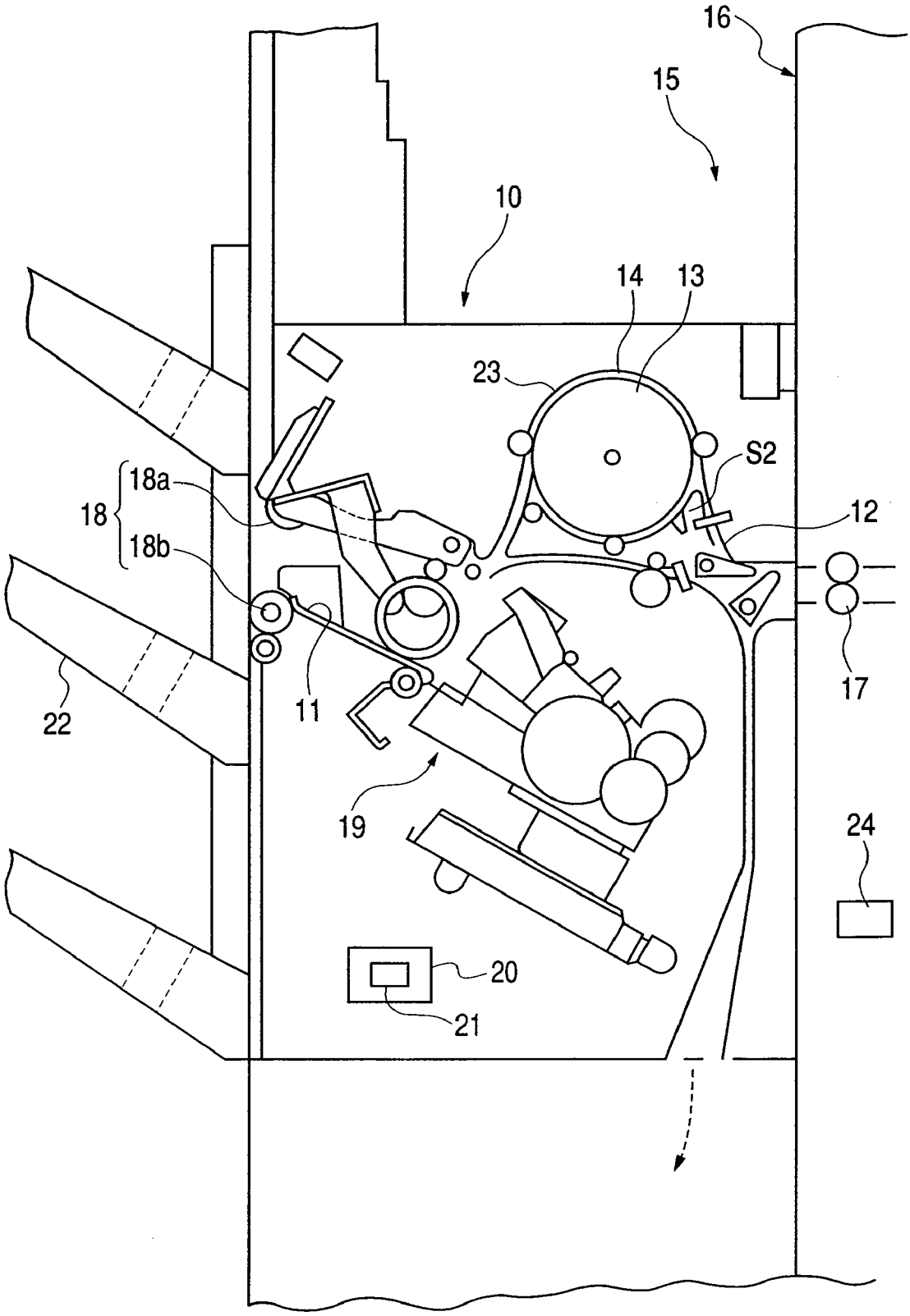
FIG. 41 is a view showing a sheet processing apparatus according to another embodiment of the present invention.

While the above-mentioned sheet processing apparatus was a sheet processing apparatus of simultaneous stack discharging type, present invention can be applied to a sheet processing apparatus of sole stack discharging type as shown in FIG. 41. Such a sheet processing apparatus 10 is mounted to a main body 16 of an image forming apparatus (for example, a copier) and is used as a copier 15.

In this sheet processing apparatus 10, sheets fed from the main body 16 of the apparatus by a sheet discharging roller pair 17 are passed through a straight path 20 and are successively stacked onto a processing tray 11, and, when a predetermined number of sheets are stacked, stacked sheets are stapled by a stapler unit 19. Thereafter, by rotating upper and lower rollers 18*a* and 18*b* of a rocking roller pair 18, these rollers discharge the sheet stack while pinching the sheet stack therebetween.

While the sheet stack is being stapled by the stapler unit 19, supplied sheets are guided by a conveying passage 12 and are stored (buffered) in a buffer roller path 14 formed around a buffer roller 13, and, when a stapling processing operation is finished, the stored sheets are discharged onto the processing tray 11. The number of sheets to be stored (buffer sheets) is the sheet number corresponding to a time required for stapling the sheet stack. The buffer roller 13 and the buffer roller path 14 constitute parts of a buffer unit 23.

Also in such a sheet processing apparatus 10, if a sheet is jammed at an upstream side of the buffer roller path 14, the stapled sheet stack is on the processing tray 11 is discharged by continuing only the operation of the sheet processing apparatus 10 without stopping the operation of the entire sheet processing apparatus 10.

Figure 42:
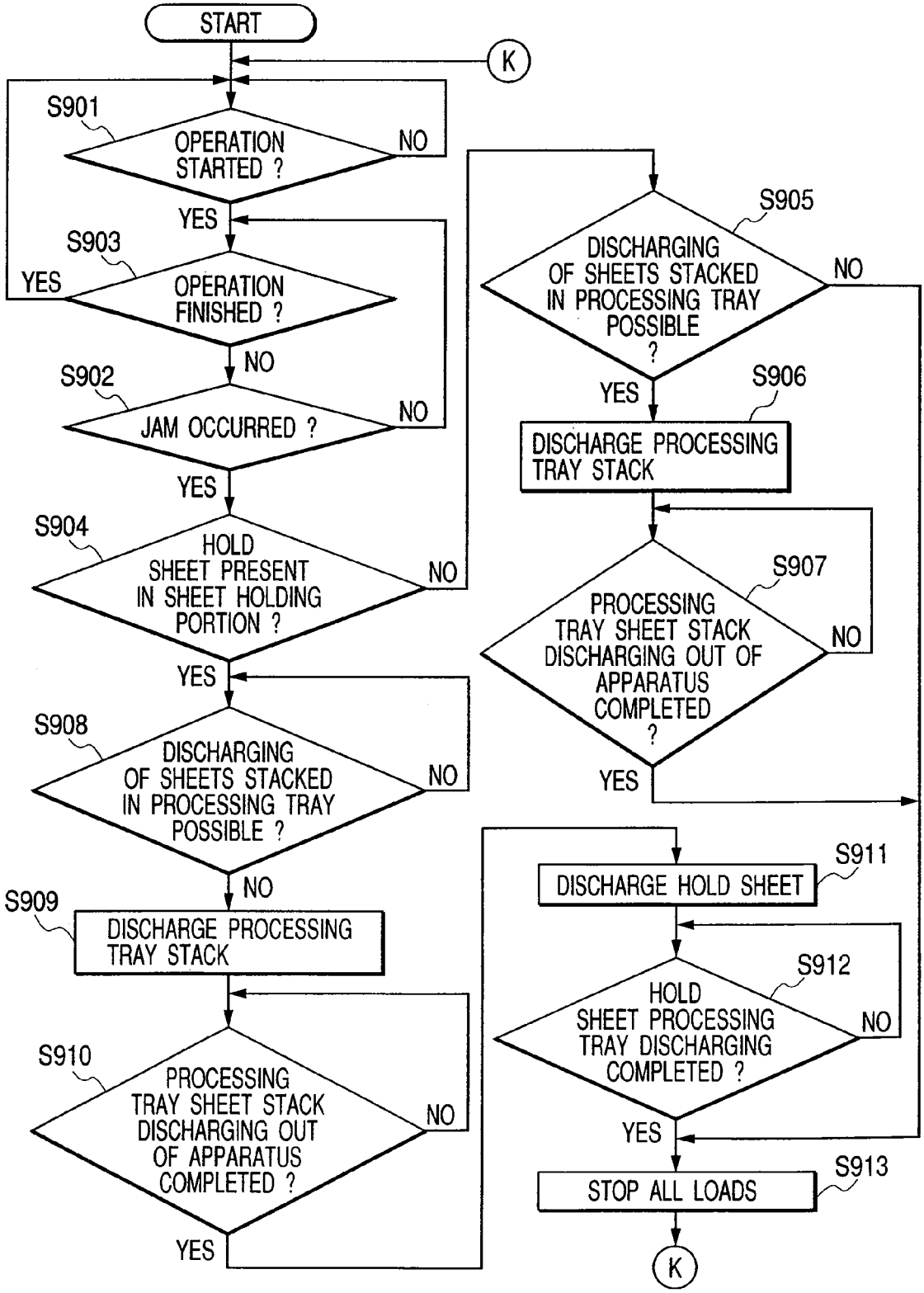
FIG. 42 is a flow chart for explaining an operation if sheet jam occurs at an upstream side in the sheet processing apparatus of FIG. 41.

That is to say, in a flow chart shown in FIG. 42, from when the copier 15 starts a copying operation (step S901) to when copying operation is finished (step S903), if sheet jam occurs at an upstream side of the buffer unit 23, i.e., at an upstream side of the conveying passage 12 (step S902), a CPU circuit portion 24 in the main body 16 of the copier sends a jam generating signal to a CPU 21 of the finisher controlling portion 20 and stops rotation of sheet conveying rollers within the main body 16.

Thereafter, the CPU 21 judges whether or not there is a hold sheet (buffer sheet) in the buffer roller path 14 by a detecting operation of a buffer sensor S2 (step S904). If the hold sheet is not detected by the buffer sensor S2, it is judged that there is no hold sheet in the buffer roller path 14, and, the CPU judges whether the sheets stacked on the processing tray 11 can be discharged or not (step S905). If the sheets can be discharged, sheet stack is forcibly discharged solely (steps S906 and S907). If the sheets cannot be discharged (step S905), the sheet stack remains on the processing tray in a stacked condition. Then, the CPU 21 stops the operation of the entire sheet processing apparatus 10 (step S918).

In the above-mentioned step S904, if the sheet is detected by the buffer sensor S1, the CPU 21 judges that the hold sheet is held in the buffer roller path 14, and, since the sheet stack which can be discharged is stacked on the processing tray 11, the sheet stack is discharged out of the apparatus (steps S909 and S910). Thereafter, the CPU 21 discharges the sheet stored in the buffer roller path 14 onto the processing tray 11 (steps S911 and S912). Lastly, the CPU 21 stops the operation of the entire sheet processing apparatus 10 (step S913).

As such, in the sheet processing apparatus 10 according to the illustrated embodiment, if the sheet jam occurs at the upstream side of the sheet processing apparatus 10, since the sheets held in the buffer roller path 14 are forcibly discharged onto the processing tray 11 after the sheets on the processing tray 11 are forcibly discharged onto the stack tray 22, the operator can obtain the sheet stack quickly regardless of occurrence of the sheet jam, with the result that the processing efficiency can be enhanced and operator's operability can also be enhanced.

Further, since the sheets held in the buffer roller path 14 are forcibly discharged onto the processing tray 11, the jam treatment can be facilitated, thereby enhancing the jam treating ability.

In addition, since the sheets held in the buffer roller path 14 are forcibly discharged onto the processing tray 11, only sheets for jam recovery can be held within the sheet processing apparatus, with the result that a recovery starting sheet can easily be recognized.

Further, if the sheet stack is left on the processing tray 11 as it is for a long term without finding the sheet jam, for example, the externally protruded portion may be flexed downwardly by its own weight, thereby deforming the sheet stack. However, in the sheet processing apparatus 10 according to the illustrated embodiment, if the jam occurs, since the sheet stack is forcibly discharged, deformation of the sheet stack can be prevented.

In the above-mentioned explanation, while an example that the position of the sheet is detected by the sensor was explained, the position of the sheet may be judged on the basis of sheet holding information (memory information) managed within the CPU 221.

Further, in the sheet processing apparatus, although the sheet stack is stapled after width alignment for aligning the sheet stack on the processing tray 129 from both sides and trailing end alignment are performed, the sheet stack may be discharged onto the stack tray 128 after the width alignment and the trailing end alignment without stapling the sheet stack.

As mentioned above, in the sheet processing apparatus, when the succeeding sheet is not supplied to the buffer unit for the predetermined time, since the control portion controls the rocking roller pair and the buffer unit, in such a manner that, after the sheets on the processing tray are discharged onto the stack tray, the sheets held in the buffer unit are discharged onto the processing tray, for example, the operator can obtain the stapled sheet stack quickly regardless of the occurrence of the sheet jam, thereby enhancing the processing efficiency and the operator's operability.

Further, since the sheets held in the buffer roller path are forcibly discharged onto the processing tray, the jam treatment can be facilitated, thereby enhancing the jam treating ability.

In addition, since the sheets held in the buffer roller path are forcibly discharged onto the processing tray, only sheets for jam recovery can be held within the sheet processing apparatus, with the result that a recovery starting sheet can easily be recognized.

Further, if the sheet stack is left on the processing tray as it is for a long term without finding the sheet jam, the externally protruded portion may be flexed downwardly by its own weight, thereby deforming the sheet stack. However, in the sheet processing apparatus, if the jam occurs, since the sheet stack is forcibly discharged, the deformation of the sheet stack can be prevented.

In the sheet processing apparatus, when the succeeding sheet is not supplied to the buffer unit for the predetermined time, since the finisher controlling portion controls the rocking roller pair, in such a manner that the sheets stacked on the processing tray are discharged onto the stack tray and the sheets held in the buffer unit are discharged onto the processing tray, the operator can obtain the stapled sheet stack quickly regardless of the occurrence of the sheet jam, thereby enhancing the processing efficiency and the operator's operability.

Further, since the sheets held in the buffer unit are forcibly discharged onto the processing tray, the jam treatment can be facilitated, thereby enhancing the jam treating ability.

In addition, since the sheets held in the buffer unit are forcibly discharged onto the processing tray, only sheets for jam recovery can be held within the sheet processing apparatus, with the result that a recovery starting sheet can easily be recognized.

Further, if the sheet stack is left on the processing tray as it is for a long term without finding the sheet jam, for example, the externally protruded portion shown in FIGS. 20A and 20B may be flexed downwardly by its own weight, thereby deforming the sheet stack. However, in the sheet processing apparatus, if the jam occurs, since the sheet stack is forcibly discharged, deformation of the sheet stack can be prevented.

In the sheet processing apparatus, when the succeeding sheet is not supplied to the buffer unit for the predetermined time, since the finisher controlling portion controls the buffer unit and the rocking roller pair, in such a manner that the sheets stacked on the processing tray are discharged onto the stack tray and the sheets stored in the buffer unit are stacked onto the processing tray, since the stapled sheet stack can be discharged onto the stack tray without storing the sheet stack on the processing tray unnecessarily for a long term, the processing efficiency of the sheet processing apparatus can be enhanced, with the result that the sheet stack can be presented by the operator quickly.

Further, since the stapled sheet stack is not left as it is on the processing tray for a long term, for example, the externally protruded portion shown in FIGS. 20A and 20B is not flexed downwardly by its own weight, thereby preventing the deformation of the sheet stack.

Further, after the trailing end assist conveys the sheets stacked on the processing tray toward the stack tray by the predetermined amount, since the rocking roller pair conveys the sheet held in the buffer unit and the sheet stacked on the processing tray simultaneously to discharge the sheet stacked on the processing tray onto the stack tray, the overlapped area between the sheet stack and the buffer sheets is reduced by an amount corresponding to the distance through which the sheet stack is conveyed by the predetermined amount, with the result that the sheet stack is separated from the buffer sheets positively, so that the sheet stack can be discharged and stacked onto the stack tray positively. Further, since the sheets are conveyed by the rocking roller pair and the trailing end assist, the sheets can be discharged quickly without generating dispersion in the sheet discharging time, thereby providing an apparatus having a shorter processing time.

In the sheet processing apparatus, the receiving roller pair as a rotary member pair can be engaged and disengaged with respect to each other, jammed sheet can easily be removed.

What is claimed is:

1. A sheet processing apparatus comprising:

a sheet holding unit capable of temporarily storing a supplied sheet;

a sheet stacking unit on which the sheet temporarily stored on said sheet holding unit or a sheet passed without storing on said sheet holding unit is stacked, and on which the sheet is subjected to post-processing;

a sheet conveying unit configured to convey the sheet on said sheet holding unit and the sheet on said sheet stacking unit together or configured to convey the sheet on said sheet stacking unit when no sheet is stored on said sheet holding unit; and a control unit configured to control said sheet conveying unit, wherein said control unit controls said sheet conveying unit in such a manner that when a succeeding sheet is not supplied to said sheet holding unit for a predetermined time while the sheet is stored on said sheet holding unit, the sheet on said sheet holding unit and the sheet on said sheet stacking unit are conveyed together, and after the sheet on said sheet stacking unit is discharged, the sheet on said sheet holding unit is conveyed to said sheet stacking unit.

2. A sheet processing apparatus according to claim 1, wherein said sheet conveying unit comprises a pair of rollers for nipping the sheet on said sheet holding unit and the sheet on said sheet stacking unit in the vertical direction, and wherein when the sheet is stored on said sheet holding unit, said pair of rollers are controlled to nip the sheet on said sheet holding unit and the sheet on said sheet stacking unit and discharge the sheet on said sheet stacking unit, while when no sheet is stored on said sheet holding unit, said pair of rollers are controlled to nip only the sheet on said sheet stacking unit and convey it.

3. A sheet processing apparatus according to claim 2, wherein said sheet conveying unit comprises a trailing end assist adapted to convey the sheet on said sheet stacking unit, subjected to the post-processing, so that an end of the stacked sheet at a downstream side in a sheet conveying direction projects downstream by a predetermined distance ahead of an end of the sheet on said sheet holding unit at the downstream side, and wherein when a succeeding sheet is not supplied to said sheet holding unit for a predetermined time with a state where the sheet is stored in said sheet holding unit, said control unit controls said sheet conveying unit so as to cause said trailing end assist to convey the sheet stacked on said sheet stacking unit and then cause said pair of rollers to nip the sheet on said sheet stacking unit and the sheet on said sheet holding unit with them overlapped, cause said pair of rollers to rotate in a first rotation direction to discharge the sheet on said sheet stacking unit and discharge the sheet on said sheet holding unit from said sheet holding unit, and then cause said pair of rollers in a second rotation direction being reverse to the first rotation direction with a state where said pair of rollers nip the sheet discharged from said sheet holding unit to convey the sheet discharged from said sheet holding unit to said sheet stacking unit by said sheet stacking unit.

4. A sheet processing apparatus according to claim 1, wherein a case where a succeeding sheet is not supplied to said sheet holding unit for a predetermined time is such a case that a roller for conveying the sheet, arranged at an upstream side of said sheet holding unit is slipped on the sheet.

5. A sheet processing apparatus according to claim 1, wherein a case where a succeeding sheet is not supplied to said sheet holding unit for a predetermined time is such a case that a sheet jam occurs at an upstream side of said sheet holding unit.

6. A sheet processing apparatus according to claim 1, further comprising a stapling unit for performing a stapling process as the post-processing on the sheets stacked on said sheet stacking unit.

7. A sheet processing apparatus according to claim 1, further comprising a sheet aligning unit for performing an aligning process as the post-processing on the sheet stacked on said sheet stacking unit.

8. A sheet processing apparatus according to claim 1, wherein when a succeeding sheet is not supplied to said sheet holding unit for a predetermined time while the sheet is not stored on said sheet holding unit, said control unit determines whether or not a number of the sheets on said sheet stacking unit reaches a predetermined number of sheets for performing the post-processing, and (1) if the determination is affirmative, said control unit discharges the sheet stacked on said sheet stacking unit and (2) if the determination is negative, said control unit does not discharge the sheet stacked on said sheet stacking unit.

9. An image forming system comprising:

an image forming unit for forming an image on a sheet;

a sheet holding unit capable of temporarily storing a supplied sheet;

a sheet stacking unit on which the sheet temporarily stored on said sheet holding unit or a sheet passed without storing on said sheet holding unit is stacked, and on which the sheet is subjected to post-processing;

a sheet conveying unit for conveying the sheet on said sheet holding unit and the sheet on said sheet stacking unit together or for conveying the sheet on said sheet stacking unit when no sheet is stored on said sheet holding unit; and a control unit for controlling said sheet conveying unit, wherein said control unit controls said sheet conveying unit in such a manner that when a succeeding sheet is not supplied to said sheet holding unit for a predetermined time while the sheet is stored on said sheet holding unit, the sheet on said sheet holding unit and the sheet on said sheet stacking unit are conveyed together, and after the sheet on said sheet stacking unit is discharged, the sheet on said sheet holding unit is conveyed to said sheet stacking unit.

10. An image forming system according to claim 9, wherein said sheet conveying unit comprises a pair of rollers for nipping the sheet on said sheet holding unit and the sheet on said sheet stacking unit in the vertical direction, and wherein when the sheet is stored on said sheet holding unit, said pair of rollers are controlled to nip the sheet on said sheet holding unit and the sheet on said sheet stacking unit and discharge the sheet on said sheet stacking unit, while when no sheet is stored on said sheet holding unit, said pair of rollers are controlled to nip only the sheet on said sheet stacking unit and convey it.

11. An image forming system according to claim 10, wherein said sheet conveying unit comprises a trailing end assist adapted to convey the sheet on said sheet stacking unit, subjected to the post-processing, so that an end of the stacked sheet at a downstream side in a sheet conveying direction projects downstream by a predetermined distance ahead of an end of the sheet on said sheet holding unit at the downstream side, and wherein when a succeeding sheet is not supplied to said sheet holding unit for a predetermined time with a state where the sheet is stored in said sheet holding unit, said control unit controls said sheet conveying unit so as to cause said trailing end assist to convey the sheet stacked on said sheet stacking unit and then cause said pair of rollers to nip the sheet on said sheet stacking unit and the sheet on said sheet holding unit with them overlapped, cause said pair of rollers to rotate in a first rotation direction to discharge the sheet on said sheet stacking unit and discharge the sheet on said sheet holding unit from said sheet holding unit, and then cause said pair of rollers in a second rotation direction being reverse to the first rotation direction with a state where said pair of rollers nip the sheet discharged from said sheet holding unit to convey the sheet discharged from said sheet holding unit to said sheet stacking unit by said sheet stacking unit.

12. An image forming system according to claim 9, wherein a case where a succeeding sheet is not supplied to said sheet holding unit for a predetermined time is such a case that a roller for conveying the sheet, arranged at an upstream side of said sheet holding unit is slipped on the sheet.

13. An image forming system according to claim 9, wherein a case where a succeeding sheet is not supplied to said sheet holding unit for a predetermined time is such a case that a color image quality adjustment is executed by said image forming unit.

14. An image forming system according to claim 9, wherein a case where a succeeding sheet is not supplied to said sheet holding unit for a predetermined time is such a case that a sheet jam occurs at an upstream side of said sheet holding unit.

15. An image forming system according to claim 9, further comprising a stapling unit for performing a stapling process as the post-processing on the sheets stacked on said sheet stacking unit.

16. An image forming system according to claim 9, further comprising a sheet aligning unit for performing an aligning process as the post-processing on the sheet stacked on said sheet stacking unit.

17. An image forming system according to claim 9, wherein when a succeeding sheet is not supplied to said sheet holding unit for a predetermined time while the sheet is not stored on said sheet holding unit, said control unit determines whether or not a number of the sheets on said sheet stacking unit reaches a predetermined number of sheets for performing the post-processing, and (1) if the determination is affirmative, said control unit discharges the sheet stacked on said sheet stacking unit and (2) if the determination is negative, said control unit does not discharge the sheet stacked on said sheet stacking unit.

* * * * *